US008110761B2

(12) United States Patent
Nakatani et al.

(10) Patent No.: US 8,110,761 B2
(45) Date of Patent: Feb. 7, 2012

(54) SWITCHING DEVICE AND COMMUNICATION APPARATUS AND METHOD RELATED THERETO

(75) Inventors: Tadashi Nakatani, Kawasaki (JP); Satoshi Ueda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 317 days.

(21) Appl. No.: 12/574,324

(22) Filed: Oct. 6, 2009

(65) Prior Publication Data

US 2010/0108480 A1 May 6, 2010

(30) Foreign Application Priority Data

Oct. 31, 2008 (JP) ..... 2008-281311

(51) Int. Cl.
*H01H 57/00* (2006.01)

(52) U.S. Cl. ..... 200/181; 335/78

(58) Field of Classification Search ..... 200/181; 335/78; 438/53; 257/415; 333/262; 455/252.1, 455/333

See application file for complete search history.

(56) References Cited

U.S. PATENT DOCUMENTS

| | | | | |
|---|---|---|---|---|
| 6,373,007 | B1 * | 4/2002 | Calcatera et al. | 200/181 |
| 7,212,091 | B2 * | 5/2007 | Andricacos et al. | 335/78 |
| 7,312,677 | B2 * | 12/2007 | Nakatani et al. | 335/78 |
| 7,362,199 | B2 * | 4/2008 | Chou et al. | 335/78 |
| 7,755,460 | B2 * | 7/2010 | Nguyen et al. | 335/78 |
| 7,782,170 | B2 * | 8/2010 | Robert | 337/85 |
| 7,919,903 | B2 * | 4/2011 | Hong et al. | 310/328 |
| 7,924,122 | B2 * | 4/2011 | Chou et al. | 335/78 |
| 7,944,332 | B2 * | 5/2011 | Hilgers | 335/78 |
| 7,965,159 | B2 * | 6/2011 | Nakatani et al. | 335/78 |
| 2003/0183887 | A1 | 10/2003 | Lee et al. | |
| 2004/0173872 | A1 | 9/2004 | Park et al. | |

FOREIGN PATENT DOCUMENTS

| | | |
|---|---|---|
| JP | 2004-1186 | 1/2004 |
| JP | 2004-311394 | 11/2004 |
| JP | 2005-528751 | 9/2005 |
| WO | 03/102989 | 12/2003 |

* cited by examiner

*Primary Examiner* — Michael Friedhofer
(74) *Attorney, Agent, or Firm* — Staas & Halsey LLP

(57) ABSTRACT

A switching device includes a stationary portion, a movable portion having a movable land portion, and a first beam portion and a second beam portion that couple the movable land portion and the stationary portion with each other. A first signal line extends over the movable land portion, the first beam portion, and the stationary portion, and has a movable contact portion on the movable land portion, a second signal line faces the movable contact portion, a first driving line extends over the movable land portion, the second beam portion, and the stationary portion, and has a movable driving electrode portion on the movable land portion, and a second driving line having a stationary driving electrode portion faces the movable driving electrode portion.

14 Claims, 56 Drawing Sheets

SWITCHING DEVICE AND COMMUNICATION APPARATUS AND METHOD RELATED THERETO

CROSS-REFERENCE TO RELATED APPLICATIONS

This application is based upon and claims the benefit of priority of the prior Japanese Patent Application No. 2008-281311, filed on Oct. 31, 2008, the entire contents of which are incorporated herein by reference.

FIELD

The embodiments relate to a switching device manufactured using MEMS techniques, an apparatus including the switching device and method related to same.

BACKGROUND

In the technical field of wireless communication apparatuses, such as cell phones, a demand for downsizing of an RF circuit has been increased, for example, corresponding to an increase in number of parts mounted on each apparatus with the view of realizing a higher level of performance. To meet such a demand, a further miniaturization of various parts of the circuit has been progressed by utilizing the MEMS (micro-electromechanical systems) techniques.

An MEMS switch is generally known as one of those parts. The MEMS switch is a switching device in which various components are formed in very small sizes by the MEMS techniques, and it includes at least one pair of contacts which are mechanically opened and closed to perform switching, a driving mechanism for achieving the mechanical opening and closing operations of the contact pair, and so on. When the MEMS switch is applied to the switching of a high-frequency signal on the GHz order, in particular, the MEMS switch tends to exhibit a higher degree of isolation in the open state and a lower insertion loss in the closed state than other switching devices using, e.g., PIN diodes and MESFETs. Such a tendency is attributable to the facts that the open state is established by spacing mechanically formed between the contact pair, and that parasitic capacitance is small because the MEMS switch is a mechanical switch. Known MEMS switches are described in, e.g., Japanese Unexamined Patent Application Publication No. 2004-1186 and No. 2004-311394, and Japanese Unexamined Patent Application Publication (Translation of PCT Application) No. 2005-528751.

FIGS. 51 to 53 represent a switching device Z1 as one example of the typical switching devices. Specifically, FIG. 51 is a plan view of the switching device Z1. FIG. 52 is a plan view, partly omitted, of the switching device Z1. FIG. 53 is a sectional view taken along a line LIII-LIII in FIG. 51.

The switching device Z1 includes a substrate S3, a signal line 91, a driving line 92, and a movable line 93 (omitted in FIG. 52). The signal line 91 is formed by patterning on the substrate S3. As illustrated in FIG. 53, the signal line 91 has a contact portion 91*a* capable of contacting the movable line 93. The driving line 92 is formed by patterning on the substrate S3, and it has a driving electrode portion 92*a*. The movable line 93 is formed in a shape protruding upwards from the substrate S3, as illustrated in FIG. 53, by a plating process, for example. The movable line 93 includes a projected portion or a contact portion 93*a*, which is capable of contacting the signal line 91, and a portion positioned to face the driving electrode portion 92*a* of the driving line 92. The signal line 91, the driving line 92, and the movable line 93 are each made of a predetermined conductive material.

In the switching device Z1 having the above-described structure, when a predetermined driving voltage is applied to the movable line 93 in a state where the driving line 92 is connected to the ground, an electrostatic attraction force is generated between the driving electrode portion 92*a* of the driving line 92 and the movable line 93, whereby the movable line 93 is partly operated or elastically deformed until the contact portion 93*a* of the movable line 93 comes into contact with the contact portion 91*a* of the signal line 91. The closed state of the switching device Z1 is thus established. In the closed state, the signal line 91 and the movable line 93 are connected to each other so that a current is allowed to pass between the signal line 91 and the movable line 93. With such a switching-on operation, the on-state of a high-frequency signal can be achieved.

On the other hand, when, in the switching device Z1 in the closed state, the application of the voltage to the movable line 93 is stopped to extinguish the electrostatic attraction force acting between the driving electrode portion 92*a* and the movable line 93, the movable line 93 returns to its natural state and the contact portion 93*a* of the movable line 93 moves away from the contact portion 91*a* of the signal line 91. The open state of the switching device Z1 is thus established. In the open state, the signal line 91 and the movable line 93 are electrically separated from each other, whereby a current is prevented from passing between the signal line 91 and the movable line 93. With such a switching-off operation, the off-state of a high-frequency signal can be achieved. Further, the switching device Z1 in the open state can be changed again to the closed state, i.e., the on-state, with the switching-on operation described above.

In the switching device Z1, the movable line 93 serves as, together with the signal line 91, a passage route for the high-frequency signal, and the driving voltage is applied to the movable line 93 having the portion that is positioned to face the driving electrode portion 92*a* of the driving line 92 (namely, the movable line 93 serves as not only a signal line, but also a driving line). Because the parasitic capacitance between the movable line 93 and the driving electrode portion 92*a* positioned to face the movable line 93 is comparatively large, the high-frequency signal that is to pass through the movable line 93 is apt to leak to the driving line 92 through a region where the driving electrode portion 92*a* and the movable line 93 are positioned to face each other. In other words, an insertion loss is apt to generate in the switching device n. As the frequency of the signal becomes higher, an extent of signal leakage to the driving line 92 increases and the insertion loss also tends to increase. In that type of the switching device Z1, a superior high-frequency characteristic is hard to obtain.

FIGS. 54 to 56B illustrate a switching device Z2 as another example of the known switching devices. FIG. 54 is a plan view of the switching device Z2. FIG. 55 is a plan view, partly omitted, of the switching device Z2. FIGS. 56A and 56B are sectional views taken along a line LVIA-LVIA and a line LVIB-LVIB in FIG. 54, respectively.

The switching device Z2 includes a substrate S4, a stationary portion 94, a movable portion 95, a signal line 96A, a pair of signal lines 96B (omitted in FIG. 55), a driving line 97A, and a driving line 97B (omitted in FIG. 55). As illustrated in FIGS. 56A and 56B, the stationary portion 94 is joined to the substrate S4 through a boundary layer 98. As most clearly illustrated in FIG. 55, the movable portion 95 includes a fixed end 95*a* fixed to the stationary portion 94, and a free end 95*b*, and it is surrounded by the stationary portion 94 with a slit 99 interposed there between. The stationary portion 94 and the movable portion 95 are integrally formed on a single silicon substrate. As most clearly illustrated in FIG. 55, the signal line 96A is disposed on the movable portion 95 near the free end 95*b* thereof and has contact portions 96*a* capable of contacting the signal lines 96B, respectively. The signal lines 96B are each formed in a shape protruding upwards from the stationary portion 94, as illustrated in FIG. 56A, by a plating process, for example. Further, each of the signal lines 96B has a projected portion or a contact portion 96*b*, which is capable of contacting the signal line 96A. As most clearly illustrated in FIG. 55, the driving line 97A is disposed to extend over the stationary portion 94 and the movable portion 95 and has a driving electrode portion 97*a* on the movable portion 95. The driving line 97B is formed in a shape protruding upwards from the stationary portion 94, as illustrated in FIG. 56B, by a plating process, for example, and has a portion positioned to face the driving electrode portion 97*a* of the driving line 97A. The signal lines 96A and 96B and the driving lines 97A and 97B are each made of a predetermined conductive material.

In the switching device Z2 having the above-described structure, when a predetermined driving voltage is applied to the driving line 97A in a state where the driving line 97B is connected to the ground, an electrostatic attraction force is generated between the driving electrode portion 97*a* of the driving line 97A and the driving line 97B. When the electrostatic attraction force is sufficiently large, the movable portion 95 is operated or elastically deformed until the contact portions 96*a* of the signal line 96A come into contact with the contact portions 96*b* of the signal lines 96B. The closed state of the switching device Z2 is thus established. In the closed state, the pair of signal lines 96B are electrically bridged there between through signal line 96A so that a current is allowed to pass between the pair of signal lines 96B. With such a switching-on operation, the on-state of a high-frequency signal can be achieved.

On the other hand, when, in the switching device Z2 in the closed state, the application of the voltage to the driving line 97A is stopped to extinguish the electrostatic attraction force acting between the driving electrode portion 97*a* and the driving line 97B, the movable portion 95 returns to its natural state and the contact portions 96*a* of the signal line 96A on the movable portion 95 move away from the contact portions 96*b* of the signal lines 96B. The open state of the switching device Z2 is thus established. In the open state, the pair of signal lines 96B are electrically separated from each other, whereby a current is prevented from passing between the pair of signal line 96B. With such a switching-off operation, the off-state of a high-frequency signal can be achieved. Further, the switching device Z2 in the open state can be changed again to the closed state, i.e., the on-state, with the switching-on operation described above.

In the switching device Z2, two gaps G' between the two pairs of contact portions 96*a* and 96*b*, illustrated in FIG. 56A, may differ from each other due to variations occurred in manufacturing operations when the switching device Z2 is not driven (i.e., when the movable portion 95 is in its natural state). In such a case, even when the predetermined voltage is applied to the driving line 97A, the movable portion 95 is not elastically deformed to such an extent that one pair of contact portions 96*a* and 96*b*, which form the larger gap G', can be brought into the closed state, thus causing a failure that the switching device Z2 is not turned to the on-state. When the two gaps G' illustrated in FIG. 56A differ from each other in the not-driven state, the movable portion 95 can be elastically deformed, by applying a sufficiently high voltage to the driving line 97A, such that after one pair of contact portions 96*a* and 96*b* forming the smaller gap G' have been brought into the closed state, the other pair of contact portions 96*a* and 96*b* forming the larger gap G' are also brought into the closed state. With such a voltage application, however, because an excessive load is eventually imposed between the contact portions 96*a* and 96*b* which have been brought into the closed state at earlier timing, a sticking failure, i.e., a phenomenon of sticking to the contact state due to application of excessive pressure, tends to occur between the contact portions 96*a* and 96*b* which have been brought into the closed state at the earlier timing. Such a tendency to cause the sticking failure is not preferable including in realizing a long contact opening/closing life.

SUMMARY

According to an aspect of the embodiment, a switching device includes a stationary portion, a movable portion having a movable land portion, a first beam portion and a second beam portion coupling the movable land portion and the stationary portion with each other, a first signal line disposed to extend over the movable land portion, the first beam portion, and the stationary portion, and having a movable contact portion on the movable land portion, a second signal line having a stationary contact portion positioned to face the movable contact portion and fixed to the stationary portion, a first driving line disposed to extend over the movable land portion, the second beam portion, and the stationary portion, and having a movable driving electrode portion on the movable land portion, and a second driving line having a stationary driving electrode portion positioned to face the movable driving electrode portion and fixed to the stationary portion.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

Additional aspects and/or advantages will be set forth in part in the description which follows and, in part, will be apparent from the description, or may be learned by practice of the invention.

BRIEF DESCRIPTION OF THE DRAWINGS

These and/or other aspects and advantages will become apparent and more readily appreciated from the following description of the embodiments, taken in conjunction with the accompanying drawings of which.

DESCRIPTION OF EMBODIMENTS

Figure 1:
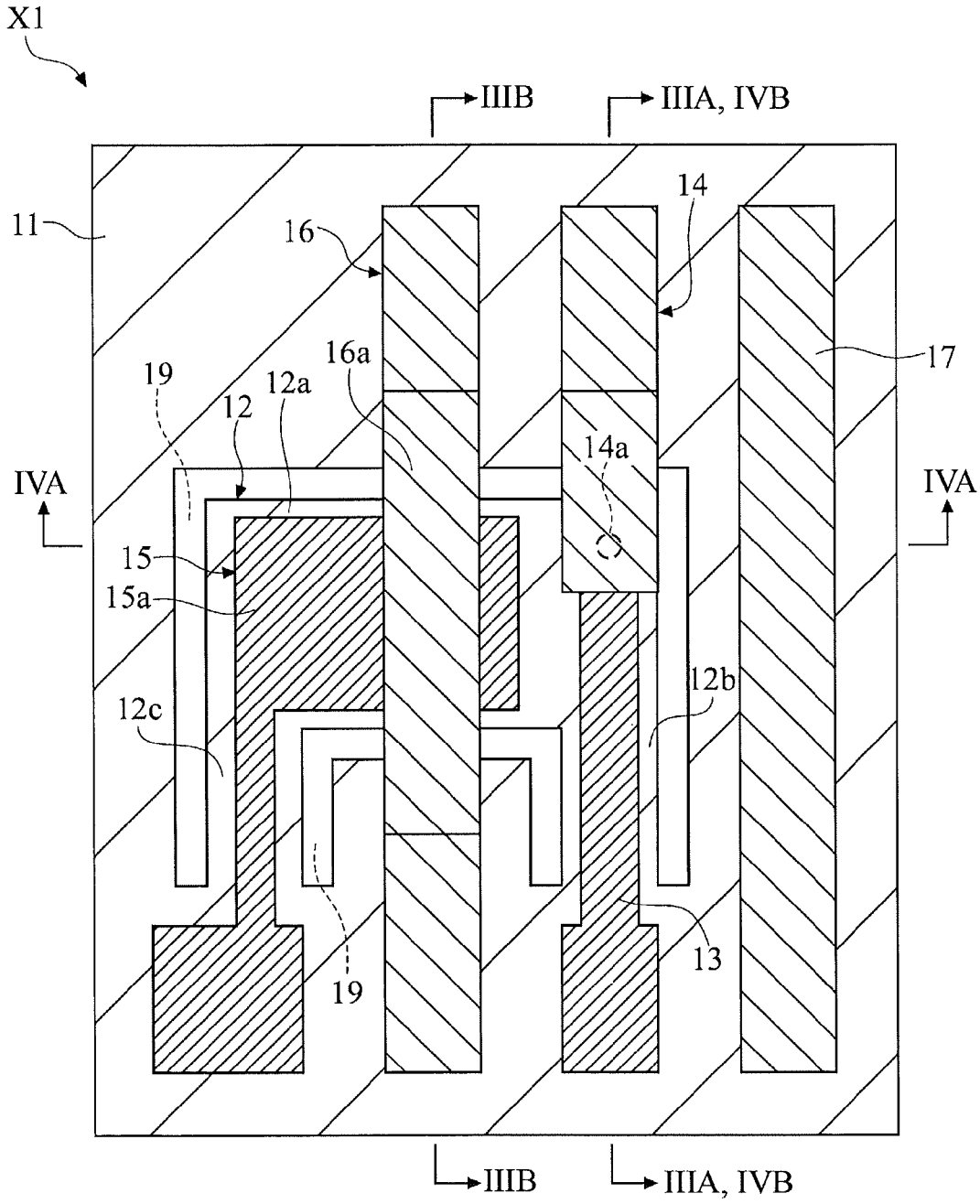
FIG. 1 is a plan view of a switching device according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

The present invention has been conceived in view of the above-described situations in the art, and an object of the present invention is to provide a switching device in which a signal line and a driving line are electrically separated from each other and which is suitable for realizing a long contact opening/closing life, and to provide a communication apparatus including the switching device.

According to an embodiment of the present invention, a switching device is provided. The switching device comprises a stationary portion, a movable portion having a movable land portion, a first beam portion, and a second beam portion, the first and second beam portions coupling the movable land portion and the stationary portion with each other, and a first signal line disposed to extend over the movable land portion, the first beam portion, and the stationary portion, and having a movable contact portion on the movable land portion, a second signal line having a stationary contact portion positioned to face the movable contact portion and fixed to the stationary portion. The switching device according to an embodiment includes a first driving line disposed to extend over the movable land portion, the second beam portion, and the stationary portion, and having a movable driving electrode portion on the movable land portion, and a second driving line having a stationary driving electrode portion positioned to face the movable driving electrode portion and fixed to the stationary portion. According to an embodiment the first and second beam portions are extended, for example, in parallel between the movable land portion and the stationary portion. The movable portion may be supported to the stationary portion in such a cantilevered structure. Alternatively, the movable portion may be supported to the stationary portion in a both-end supported structure.

In a switching device of an embodiment, the first signal line is disposed to extend over the movable land portion, the first beam portion, and the stationary portion, and it has the movable contact portion on the movable land portion. The second signal line has the stationary contact portion positioned to face the movable contact portion and is fixed to the stationary portion. Passage and non-passage of, e.g., a high-frequency signal between the first and second signal lines are selected respectively by closing and opening between the movable contact portion of the first signal line on the movable land portion and the stationary contact portion of the second signal line. Stated another way, this switching device includes a single opening/closing point (single contact). The switching device thus constructed is less susceptible to the problems existing in current switching devices including the sticking failure that has been described above in connection with the known switching device Z2. Accordingly, this switching device is suitable for realizing a long contact opening/closing life.

Also, in a switching device according to an embodiment, the first driving line is disposed to extend over the movable land portion, the second beam portion, and the stationary portion, and it has the movable driving electrode portion on the movable land portion. The second driving line has the stationary driving electrode portion positioned to face the movable driving electrode portion and is fixed to the stationary portion. With a driving voltage applied between the movable driving electrode portion of the first driving line on the movable land portion and the stationary driving electrode portion of the second driving line, an electrostatic attraction force is generated between those driving electrode portions so that the movable land portion to which the movable driving electrode portion is joined is operated or elastically deformed toward the stationary driving electrode portion. The first driving line is disposed separately from the first signal line (namely, the first driving line is routed from the movable land portion to the stationary portion while passing the second beam portion differing from the first beam portion on which the first signal line passes). Also, the second driving line is disposed separately from the second signal line. Stated another way, in this switching device, the signal lines are electrically separated from the driving lines. The switching device thus constructed is less susceptible to the signal leakage from the signal line to the driving line, which has been described above in connection with the known switching device Z1. Accordingly, this switching device is suitable for not only reducing an insertion loss, but also obtaining a superior high-frequency characteristic.

According to an embodiment of the present invention, a switching device is provided. The switching device comprises a stationary portion, a movable portion having a movable land portion, a first beam portion, and a second beam portion, the first and second beam portions coupling the movable land portion and the stationary portion with each other, a first signal line disposed to extend over the first beam portion of the movable portion and the stationary portion, and having a movable contact portion on the first beam portion, a second signal line having a stationary contact portion positioned to face the movable contact portion and fixed to the stationary portion, a first driving line disposed to extend over the movable land portion, the second beam portion, and the stationary portion, and having a movable driving electrode portion on the movable land portion, and a second driving line having a stationary driving electrode portion positioned to face the movable driving electrode portion and fixed to the stationary portion. The first and second beam portions are extended, for example, in parallel between the movable land portion and the stationary portion. The movable portion may be supported to the stationary portion in such a cantilevered structure. Alternatively, the movable portion may be supported to the stationary portion in a both-end supported structure.

In this switching device, the first signal line is disposed to extend over the first beam portion and the stationary portion, and it has the movable contact portion on the first beam portion. The second signal line has the stationary contact portion positioned to face the movable contact portion and is fixed to the stationary portion. Passage and non-passage of, e.g., a high-frequency signal between the first and second signal lines are selected respectively by closing and opening between the movable contact portion of the first signal line on the movable land portion and the stationary contact portion of the second signal line. Stated another way, this switching device includes a single opening/closing point (single contact). The switching device thus constructed is less susceptible to the sticking failure that has been described above in connection with the known switching device Z2. Accordingly, this switching device is suitable for realizing a long contact opening/closing life.

Also, in this switching device, the first driving line is disposed to extend over the movable land portion, the second beam portion, and the stationary portion, and it has the movable driving electrode portion on the movable land portion. The second driving line has the stationary driving electrode portion positioned to face the movable driving electrode portion and is fixed to the stationary portion. With a driving voltage applied between the movable driving electrode portion of the first driving line on the movable land portion and the stationary driving electrode portion of the second driving line, an electrostatic attraction force is generated between those driving electrode portions so that the movable land portion to which the movable driving electrode portion is joined is operated or elastically deformed toward the stationary driving electrode portion. The first driving line is disposed separately from the first signal line (namely, the first driving line is routed from the movable land portion to the stationary portion while passing the second beam portion differing from the first beam portion on which the first signal line passes). Also, the second driving line is disposed separately from the second signal line. Stated another way, in this switching device, the signal lines are electrically separated from the driving lines. The switching device thus constructed is less susceptible to the signal leakage from the signal line to the driving line, which has been described above in connection with the known switching device Z1. Accordingly, this switching device is suitable for not only reducing an insertion loss, but also obtaining a superior high-frequency characteristic.

In preferred embodiments, the movable portion further has a third beam portion coupling the movable land portion and the stationary portion with each other. The switching device further comprises a third driving line disposed to extend over the movable land portion, the third beam portion, and the stationary portion, and having an additional movable driving electrode portion that is spaced from the movable driving electrode portion on the movable land portion, and a fourth driving line having an additional stationary driving electrode portion positioned to face the additional movable driving electrode portion and fixed to the stationary portion. The movable contact portion of the first signal line is positioned between the movable driving electrode portion and the additional movable driving electrode portion in a direction in which the movable driving electrode portion and the additional movable driving electrode portion are spaced from each other. In the above-described arrangement, the first beam portion, the second beam portion, and the third beam portion are extended, for example, in parallel between the movable land portion and the stationary portion, and the first beam portion is positioned between the second beam portion and the third beam portion. The movable portion may be supported to the stationary portion in such a cantilevered structure. As an alternative, the second beam portion and the third beam portion are extended in parallel between the movable land portion and the stationary portion, and the first beam portion couples the movable land portion and the stationary portion with each other on a side opposite to the second beam portion and the third beam portion. The movable portion may be supported to the stationary portion in such a both-end supported structure.

In those preferred embodiments, an opening/closing point (i.e., the movable contact portion and the stationary contact portion) is positioned between two locations where the electrostatic attraction forces are generated (the two locations corresponding to a gap between the movable driving electrode portion and the stationary driving electrode portion and a gap between the additional movable driving electrode portion and the additional stationary driving electrode portion) in the direction in which those two electrostatic-attraction-force generated locations are spaced from each other. Therefore, after the movable contact portion and the stationary contact portion have been brought into contact with each other, uniform loads can be more easily applied to that contact point from both sides of that contact point when this switching device is driven. As a result, stable contact can be more easily realized in that contact point.

In a preferred embodiment, the first signal line has an additional movable contact portion on the movable land portion. This switching device further comprises a third signal line having an additional stationary contact portion positioned to face the additional movable contact portion and fixed to the stationary portion, a third driving line disposed to extend over the movable land portion, the second beam portion, and the stationary portion, and having an additional movable driving electrode portion that is spaced from the movable driving electrode portion on the movable land portion, and a fourth driving line having an additional stationary driving electrode portion positioned to face the additional movable driving electrode portion and fixed to the stationary portion. The additional movable contact portion is spaced from the movable contact portion in a direction in which the movable driving electrode portion and the additional movable driving electrode portion are spaced from each other. The movable land portion is positioned between the first beam portion and the second beam portion, the first and second beam portions defining an axis for swing motion of the movable land portion. The axis extends between the movable driving electrode portion and the additional movable driving electrode portion and between the movable contact portion and the additional movable contact portion as viewed in the direction in which the movable driving electrode portion and the additional movable driving electrode portion are spaced from each other. This switching device may be constituted as such an SPDT switch (having one input and two outputs).

Preferably, the switching device further comprises a first ground line having a shape extending along at least the first signal line and the second signal line, and a second ground line having a shape extending along at least the first signal line and the second signal line on the side opposite to the first ground line. The first ground line and/or the second ground line are extended, for example, along the first signal line and the second signal line. Such coplanar passages may be used in the switching device. Using the coplanar passages is preferable including in suppressing the signal leakage from the signal lines.

Preferably, the first driving line has, in part thereof on the movable portion, a pattern shape that is congruent to a pattern shape of the first signal line on the movable portion. Such a symmetrical arrangement is preferable including in suppressing generation of improper deformation (such as torsional deformation) in the movable portion that is elastically deformed when the switching device is driven.

Preferably, the switching device further comprises a stopper portion positioned to face the movable land portion on the side where the movable contact portion is disposed. The provision of the stopper portion is preferable including in preventing the movable driving electrode portion and the stationary driving electrode portion from contacting with each other and from short-circuiting when driven.

Preferably, the first signal line has a thicker portion on the first beam portion. Such a construction is preferable including in suppressing a signal loss occurred in the first signal line. In that case, the first driving line has a thicker portion on the second beam portion. Such a symmetrical arrangement is also preferable including in suppressing generation of improper deformation in the movable portion when driven.

According to an embodiment of the present invention, a communication apparatus is provided. The communication apparatus includes the switching device according to any of embodiments of the present invention described herein. For example, the communication apparatus according to an embodiment is an RF communication apparatus, which includes the switching device according to any of the embodiments described herein as a transmission/reception selector switch, a band selector switch, or a switch constituting one component of a variable phase shifter.

Figure 2:
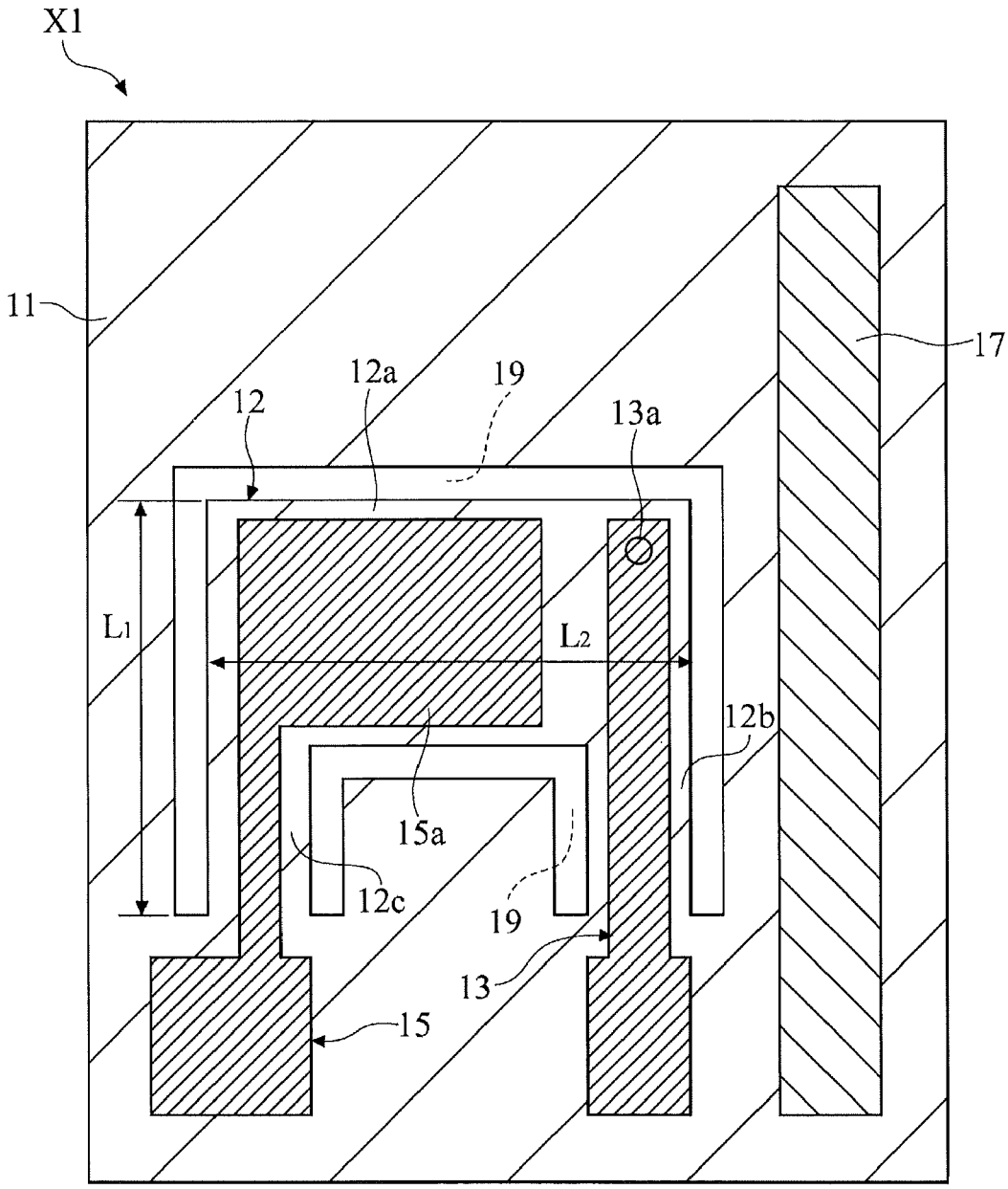
FIG. 2 is a plan view, partly omitted, of the switching device illustrated in FIG. 1.
Figure 3A:
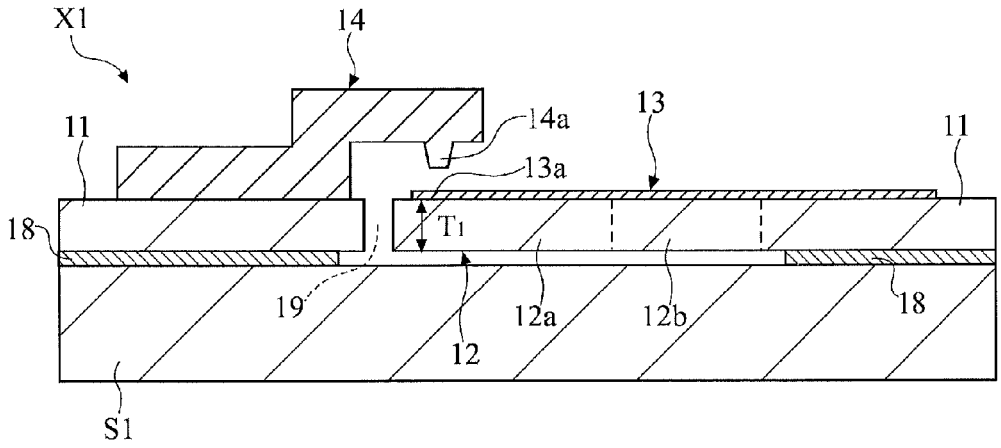
FIG. 3A is a sectional view taken along a line IIIA-IIIA in FIG. 1.
Figure 3B:
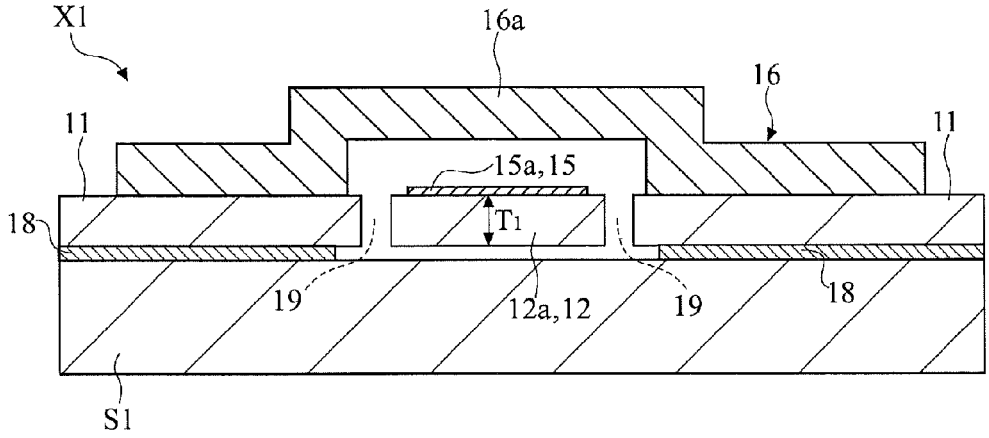
FIG. 3B is a sectional view taken along a line IIIB-IIIB in FIG. 1.
Figure 4A:
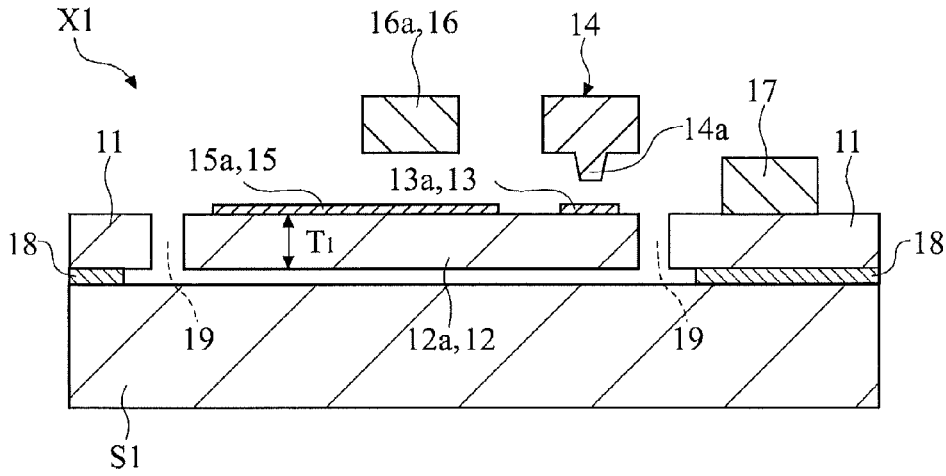
FIG. 4A is a sectional view taken along a line IVA-IVA in FIG. 1.

FIGS. 1, 2, 3A, 3B and 4A illustrate a switching device X1 according to an embodiment of the present invention. FIG. 1 is a plan view of the switching device X1. FIG. 2 is a plan view, partly omitted, of the switching device X1. FIGS. 3A, 3B and 4A are sectional views taken along lines IIIA-IIIA, IIIB-IIIB, and IVA-IVA in FIG. 1, respectively.

The switching device X1 includes a substrate S1, a stationary portion 11, a movable portion 12, a signal line 13, a signal line 14 (omitted in FIG. 2), a driving line 15, a driving line 16 (omitted in FIG. 2), and a ground line 17.

As illustrated in FIGS. 3A to 4A, the stationary portion 11 is joined to the substrate S1 through a boundary layer 18 and is made of a silicon material, e.g., single-crystal silicon. The silicon material constituting the stationary portion 11 preferably has resistivity of 1000 Ω·cm or more. The boundary layer 18 is made of, e.g., silicon oxide. In an embodiment, the stationary portion 11 corresponds, together with the substrate S1, to a stationary portion.

As illustrated in FIGS. 1 and 2, for example, the movable portion 12 has a movable land portion 12*a* and beam portions 12*b* and 12*c*, and it is surrounded by the stationary portion 11 with a slit 19 interposed therebetween. Each of the beam portions 12*b* and 12*c* couples the stationary portion 11 and the movable land portion 12*a* with each other. In an embodiment, the beam portions 12*b* and 12*c* extend side by side parallel to each other between the stationary portion 11 and the movable land portion 12*a*. In other words, the movable portion 12 is supported in a cantilevered structure by the stationary portion 11. The movable portion 12 has a thickness $T_1$, denoted in FIGS. 3A to 4A, of 15 μm or less, for example. Also, the movable portion 12 has a length $L_L$, denoted in FIG. 2, of 200 to 400 μm, for example, and a length $L_2$ of 300 to 500 for example. The slit 19 has a width of 1.5 to 2.5 μm, for example. The movable portion 12 is made of, e.g., single-crystal silicon.

As most clearly illustrated in FIG. 2, the signal line 13 is disposed to extend over the movable land portion 12*a*, the beam portion 12*b*, and the stationary portion 11. Also, the signal line 13 has, on the movable land portion 12*a*, a contact portion 13*a* capable of contacting the signal line 14. The signal line 13 has a thickness of 0.5 to 2 μm, for example. Further, the signal line 13 is connected to a predetermined circuit, which is a switching target, through predetermined wiring (not shown). The signal line 13 is made of a predetermined conductive material and has a multilayered structure comprising, for example, an undercoat film of Mo and an Au film overlying the undercoat film. The signal line 13 thus formed corresponds to a first signal line according to an embodiment.

As illustrated in FIG. 3A, the signal line 14 is formed in a shape protruding upwards from the stationary portion 11 and has a region positioned to face the signal line 13. The signal line 14 includes, in its region positioned to face the signal line 13, a projected portion or a contact portion 14*a* extending toward the signal line 13. The signal line 14 has a thickness of 10 μm or more, for example. Further, the signal line 14 is connected to a predetermined circuit, which is a switching target, through predetermined wiring (not shown). The signal line 14 can be made of Au. The signal line 14 thus formed corresponds to a second signal line according to an embodiment.

As most clearly illustrated in FIG. 2, the driving line 15 is disposed to extend over the movable land portion 12*a*, the beam portion 12*c*, and the stationary portion 11. Also, the driving line 15 has a driving electrode portion 15*a* on the movable land portion 12*a*. The driving electrode portion 15*a* corresponds to a movable driving electrode portion according to an embodiment. The driving line 15 has a thickness of 0.5 to 2 μm, for example. The driving line 15 can be made of the same material as that of the signal line 13. The driving line 15 thus formed corresponds to a first driving line according to an embodiment.

As illustrated in FIG. 3B, the driving line 16 is formed in a shape protruding upwards from the stationary portion 11 and straddling over the driving electrode portion 15*a* of the driving line 15. The driving line 16 has a driving electrode portion 16*a* positioned to face the driving electrode portion 15*a*. The driving electrode portion 16*a* corresponds to a stationary driving electrode portion according to an embodiment. The driving line 16 has a thickness of 10 μm or more, for example. Further, the driving line 16 is disposed to extend along the signal lines 13 and 14 as illustrated in FIG. 1, and is connected to the ground through predetermined wiring (not shown) (hence the driving line 16 serves also as a ground line). The driving line 16 can be made of the same material as that of the signal line 14. The driving line 16 thus formed corresponds to a second driving line according to an embodiment.

The ground line 17 is disposed to extend along the signal lines 13 and 14 as illustrated in FIG. 1, and is connected to the ground through predetermined wiring (not shown). The ground line 17 can be made of the same material as that of the signal line 14.

Figure 4B:
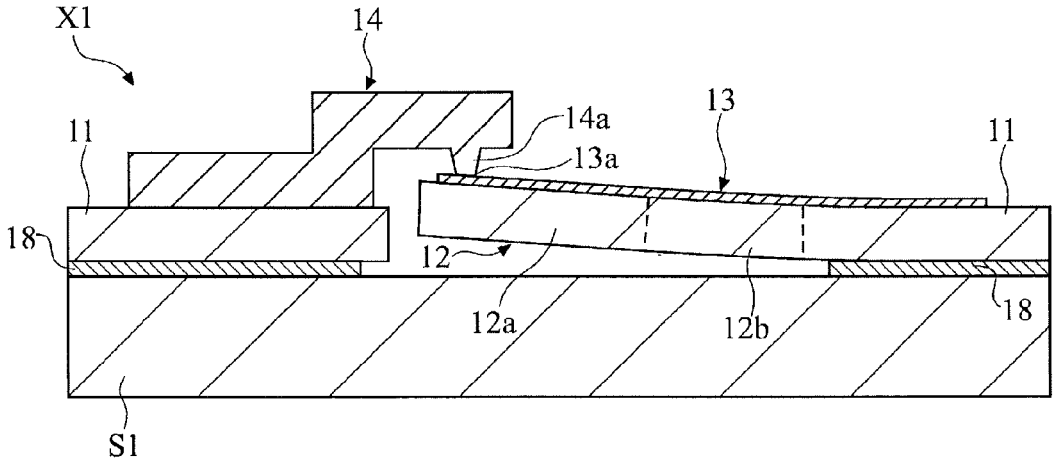
FIG. 4B is a sectional view taken along the line IVB-IVB in FIG. 1, the view illustrating a closed state.

In the switching device X1 having the above-described structure, when a voltage is applied to the driving line 15, an electrostatic attraction force is generated between the driving electrode portion 15*a* of the driving line 15 and the driving electrode portion 16*a* of the driving line 16 (connected to the ground). When the applied voltage is sufficiently high, the movable portion 12 is operated or elastically deformed until the contact portion 13*a* of the signal line 13 comes into contact with the contact portion 14*a* of the signal line 14. The closed state (contact state) of the switching device X1 is thus established as illustrated in FIG. 4B. In the closed state (contact state), the signal lines 13 and 14 are connected to each other so that a current is allowed to pass between the signal lines 13 and 14. With such a switching-on operation, the on-state of, e.g., a high-frequency signal can be achieved.

On the other hand, when, in the switching device X1 in the closed state, the application of the voltage to the driving line 15 is stopped to extinguish the electrostatic attraction force acting between the driving electrode portions 15*a* and 16*a*, the movable portion 12 returns to its natural state and the signal line 13, specifically the contact portion 13*a*, moves away from the signal line 14, specifically from the contact portion 14*a*. The open state of the switching device X1 is thus established as illustrated in FIGS. 3A and 4A. In the open state, the signal lines 13 and 14 are electrically separated from each other, whereby a current is prevented from passing between the signal lines 13 and 14. With such a switching-off operation, the off-state of, e.g., a high-frequency signal can be achieved. Further, the switching device X1 in the open state can be changed again to the closed state, i.e., the on-state, with the switching-on operation described above.

In the switching device X1, the signal line 13 is disposed to extend over the movable land portion 12*a*, the beam portion 12*b*, and the stationary portion 11, and has the contact portion 13*a* on the movable portion 12, specifically on the movable land portion 12*a*. The signal line 14 has the contact portion 14*a* positioned to face the contact portion 13*a* and is fixed to the stationary portion 11. Passage and non-passage of, e.g., a high-frequency signal between the signal lines 13 and 14 are selected respectively by closing and opening between the contact portions 13*a* and 14*a*. Stated another way, the switching device X1 includes a single opening/closing point (single contact). The switching device X1 thus constructed is less susceptible to the sticking failure that has been described above in connection with the known switching device Z2. Accordingly, the switching device X1 is suitable for realizing a long contact opening/closing life.

In the switching device X1, the driving line 15 is disposed to extend over the movable land portion 12*a*, the beam portion 12*c*, and the stationary portion 11, and has the driving electrode portion 15*a* on the movable land portion 12*a*. The driving line 16 has the driving electrode portion 16*a* positioned to face the driving electrode portion 15*a* and is fixed to the stationary portion 11. With the driving voltage applied between the driving electrode portions 15*a* and 16*a*, an electrostatic attraction force is generated between the driving electrode portions 15*a* and 16*a* so that the movable land portion 12*a* to which the driving electrode portion 15*a* is joined is operated or elastically deformed toward the driving electrode portion 16*a*. The driving line 15 is disposed separately from the signal line 13 (namely, the driving line 15 is routed from the movable land portion 12*a* to the stationary portion 11 while passing the beam portion 12*c* differing from the beam portion 12*b* on which the signal line 13 passes). Also, the driving line 16 is disposed separately from the signal line 14. Stated another way, in the switching device X1, the signal lines 13 and 14 are electrically separated from the driving lines 15 and 16. The switching device X1 thus constructed is less susceptible to the signal leakage from the signal line to the driving line, which has been described above in connection with the known switching device Z1. Accordingly, the switching device X1 is suitable for not only reducing an insertion loss, but also obtaining a superior high-frequency characteristic.

In the switching device X1, as illustrated in the plan view of FIG. 1, a signal path constituted by the signal lines 13 and 14 is disposed between the driving line 16 (ground line) and the ground line 17, and the driving line 16 and the ground line 17 have shapes extending along the signal path (namely, the signal path, the driving line 16, and the ground line 17 are disposed parallel to one another). In other words, the signal path (i.e., the signal lines 13 and 14) and two ground lines (i.e., the driving line 16 and the ground line 17) constitute coplanar passages. Using the coplanar passages is preferable including in suppressing the signal leakage from the signal lines 13 and 14.

FIGS. 5A to 8C illustrate a method of manufacturing the switching device X1 as successive changes in sections corresponding to part of FIG. 3A, part of FIG. 3B, and part of FIG. 4A.

Figure 5A:
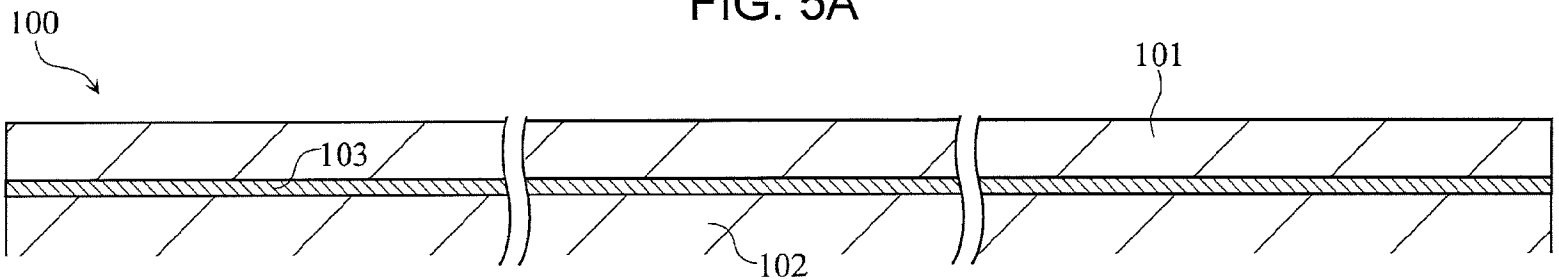
FIGS. 5A, 5B and 5C illustrate successive operations in part of a method of manufacturing the switching device illustrated in FIG. 1.

In the manufacturing method, a material substrate 100 illustrated in FIG. 5A is first prepared. The material substrate 100 is an SOI (silicon on insulator) substrate. The material substrate 100 has a multilayered structure comprising a first layer 101, a second layer 102, and an intermediate layer 103 interposed between the first and second layers 101 and 102. In an embodiment, the first layer 101 has a thickness of, e.g., 15 μm, the second layer 102 has a thickness of, e.g., 525 μm, and the intermediate layer 103 has a thickness of, e.g., 4 μm. The first layer 101 is made of, e.g., single-crystal silicon and is machined so as to provide the stationary portion 11 and the movable portion 12. The second layer 102 is made of, e.g., single-crystal silicon and is machined so as to provide the substrate S1. The intermediate layer 103 is made of, e.g., silicon oxide and is machined so as to provide the boundary layer 18.

Figure 5B:
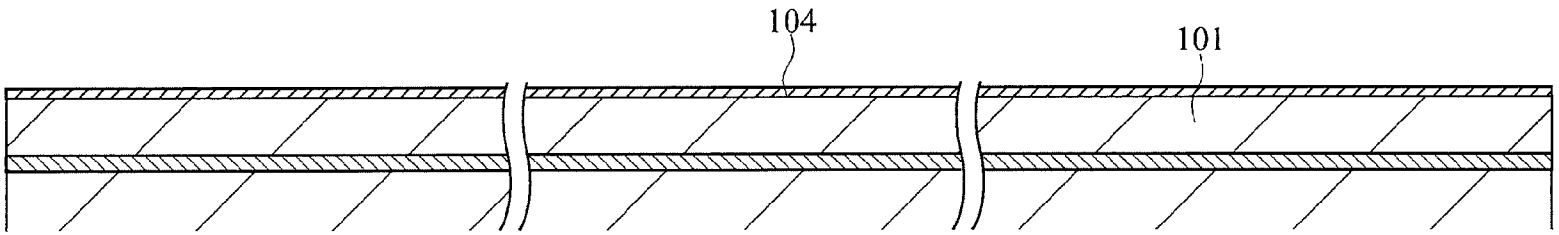

Next, as illustrated in FIG. 5B, a conductor film 104 is formed on the first layer 101. The conductor film 104 can be formed by sputtering, for example, such that a Mo film is formed on the first layer 101 and an Au film is successively formed on the Mo film. The Mo film has a thickness of, e.g., 50 nm, and the Au film has a thickness of, e.g., 500 nm.

Figure 5C:
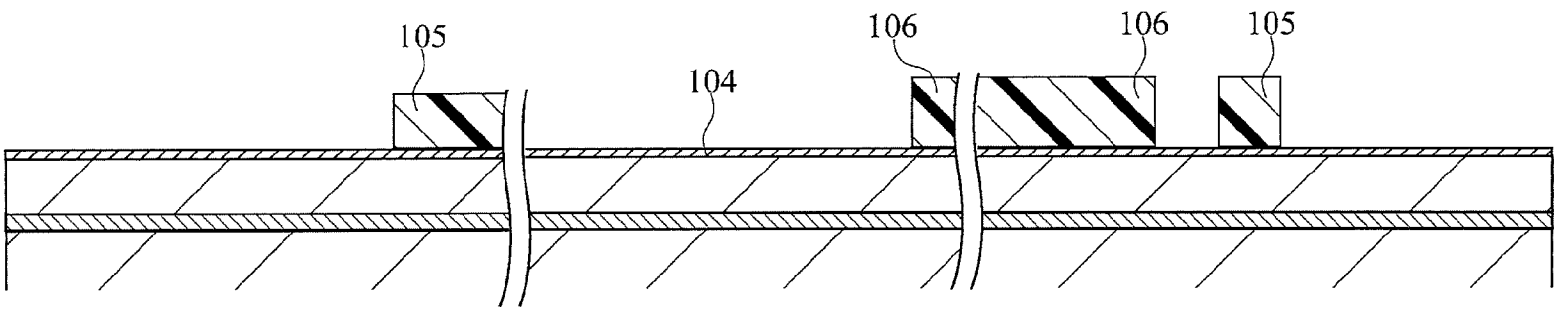

Next, as illustrated in FIG. 5C, resist patterns 105 and 106 are formed on the conductor film 104 by photolithography. The resist pattern 105 has a pattern shape corresponding to the signal line 13. The resist pattern 106 has a pattern shape corresponding to the signal line 15.

Figure 6A:
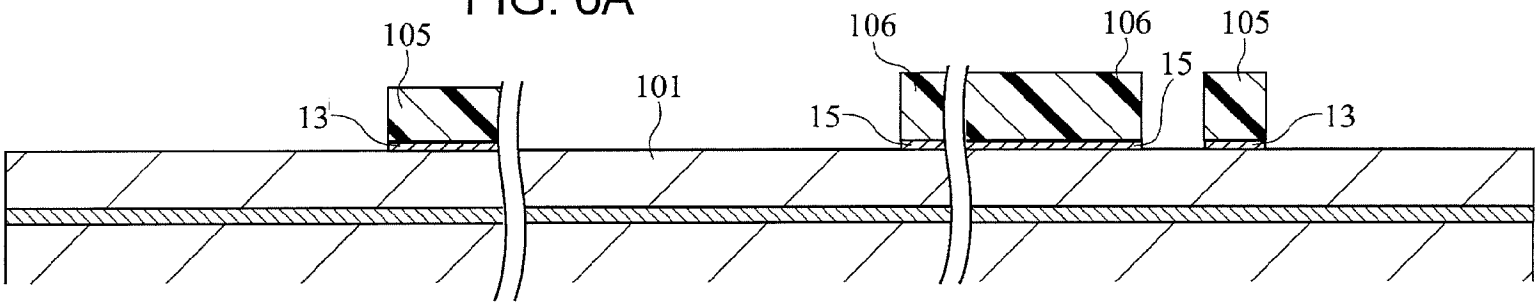
FIGS. 6A, 6B and 6C illustrate successive operations subsequent to FIG. 5C.

Next, as illustrated in FIG. 6A, the signal line 13 and the driving line 15 are formed on the first layer 101 by etching the conductor film 104 with the resist patterns 105 and 106 used as masks. Ion milling (e.g., physical etching with, e.g., Ar ions) can be employed as an etching method in this operation. The ion milling can also be employed as an etching method for a metallic material described later.

Figure 6B:
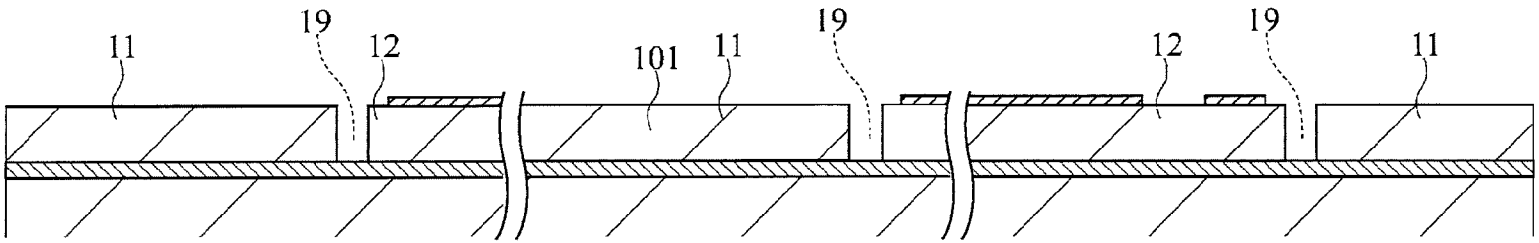

After removing the resist patterns 105 and 106, as illustrated in FIG. 6B, a slit 19 is formed by etching the first layer 101. More specifically, a predetermined resist pattern is formed on the first layer 101 by photolithography, and anisotropic etching is then performed on the first layer 101 with the resist pattern used as a mask. DRIE (deep reactive ion etching) can be employed as the anisotropic etching. With the DRIE, satisfactory anisotropic etching can be performed in the Bosch process where etching using $SF_6$ gas and sidewall protection using $C_4F_8$ gas are alternately repeated. That Bosch process in the DRIE can also be employed in the DRIE described later. With the above-described operation, the stationary portion 11 and the movable portion 12 are formed.

Figure 6C:
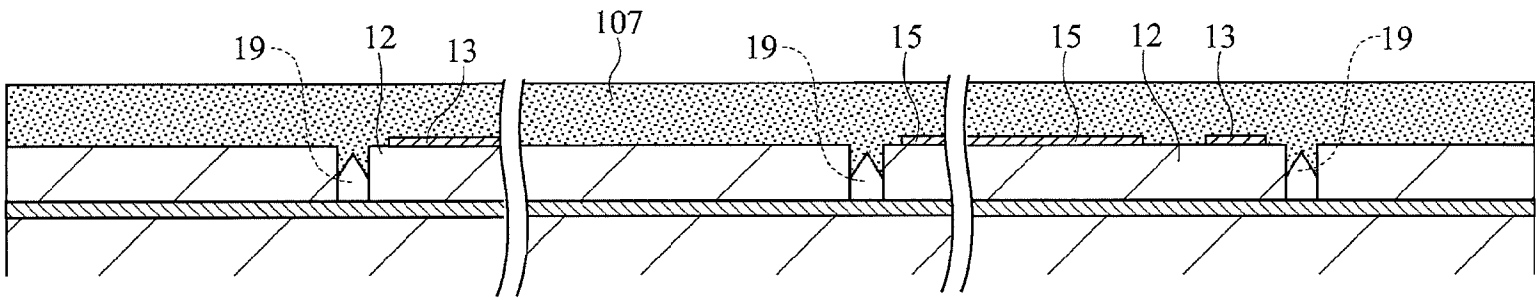

Next, as illustrated in FIG. 6C, a sacrifice layer 107 is formed over the surface of the material substrate 100 on the side including the first layer 101 so as to close the slit 19 while covering the movable portion 12, the signal line 13, and the driving line 15. The sacrifice layer 107 can be made of, e.g., silicon oxide. Plasma CVD or sputtering, for example, can be employed as a method of forming the sacrifice layer 107. The sacrifice layer 107 formed in this operation has a thickness of, e.g., 5 μm. Polyimide may also be used as the material of the sacrifice layer.

Figure 7A:
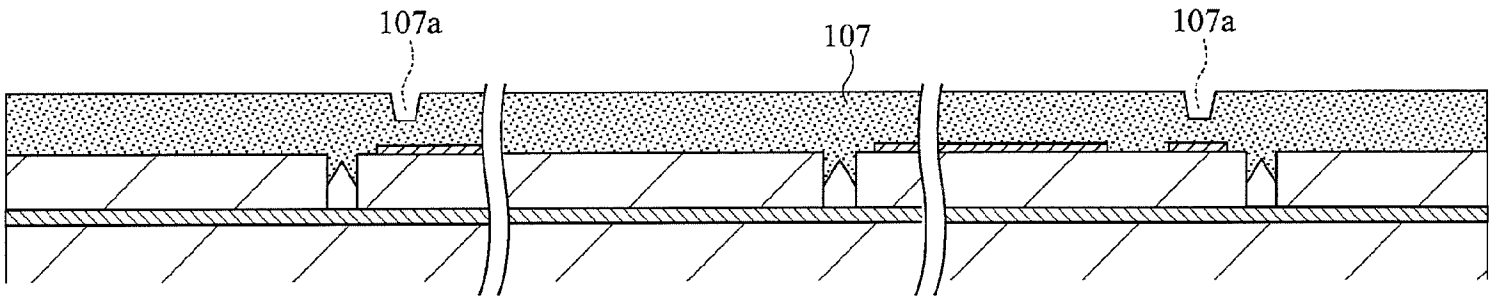
FIGS. 7A, 7B and 7C illustrate successive operations subsequent to FIG. 6C.

Next, as illustrated in FIG. 7A, recesses 107*a* are formed in the sacrifice layer 107. More specifically, a predetermined resist pattern is formed on the sacrifice layer 107 by photolithography, and the sacrifice layer 107 is then etched to a predetermined depth with the resist pattern used as a mask. The etching can be performed as wet etching. For example, buffered hydrogen fluoride (BHF) can be employed as an etchant for the wet etching. BHF can also be employed in later-described wet etching for the sacrifice layer 107. The recesses 107*a* are each used to form a projection serving as the contact portion 14*a* of the signal line 14.

Figure 7B:
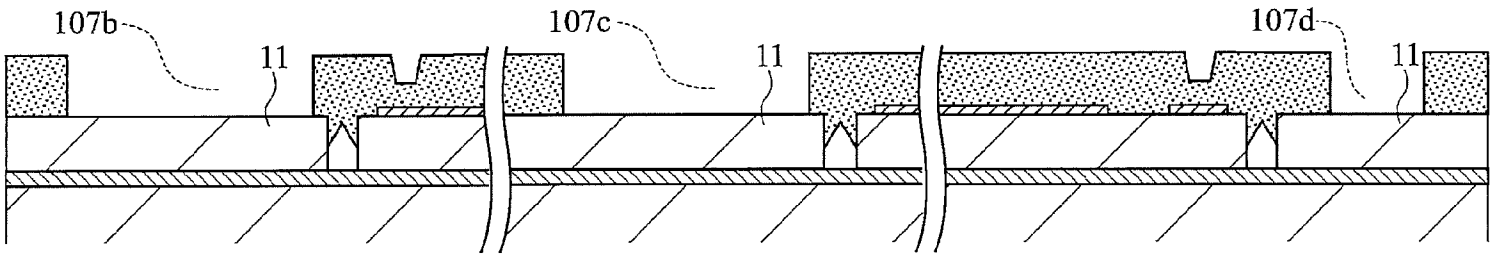

Next, as illustrated in FIG. 7B, the sacrifice layer 107 is patterned so as to form openings 107*b*, 107*c* and 107*d*. More specifically, a predetermined resist pattern is formed on the sacrifice layer 107 by photolithography, and the sacrifice layer 107 is then etched by, e.g., wet etching with the resist pattern used as a mask. The opening 107*b* is employed to expose a region of the stationary portion 11 where the signal line 14 is joined. The opening 107*c* is employed to expose a region of the stationary portion 11 where the driving line 16 is joined. The opening 107*d* is employed to expose a region of the stationary portion 11 where the ground line 17 is disposed.

Figure 7C:
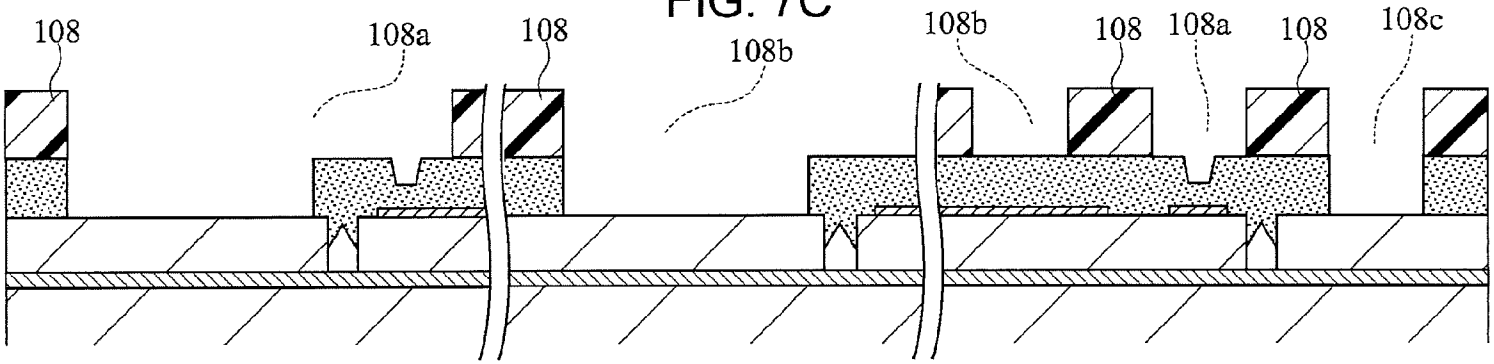

Next, after forming an undercoat film (not shown) for application of power on the surface of the material substrate 100 where the sacrifice layer 107 is disposed, a resist pattern 108 is formed as illustrated in FIG. 7C. The undercoat film can be formed by sputtering, for example, such that a Mo film is formed in a thickness of 50 nm and an Au film is successively formed in a thickness of 300 nm on the Mo film. The resist pattern 108 has an opening 108*a* corresponding to the signal line 14, an opening 108*b* corresponding to the driving line 16, and an opening 108*c* corresponding to the ground line 17.

Figure 8A:
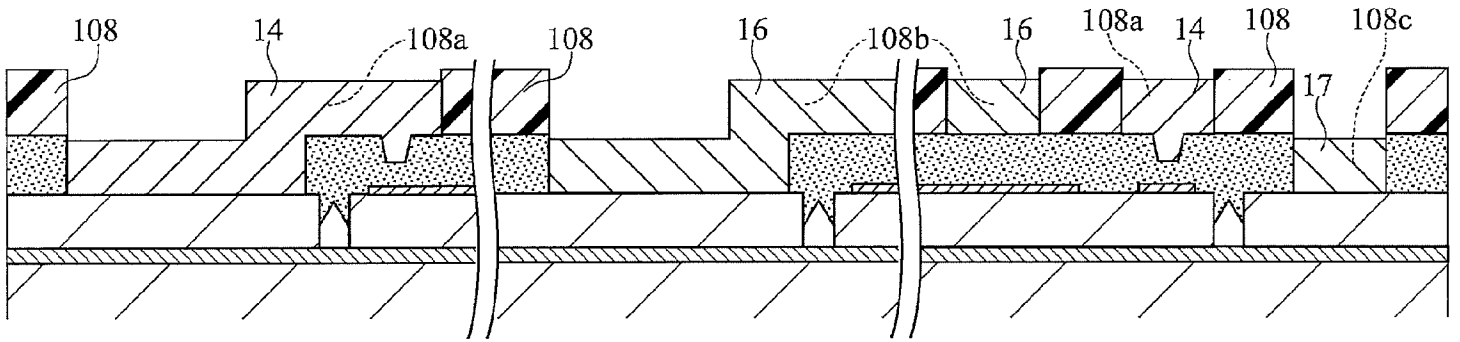
FIGS. 8A, 8B and 8C illustrate successive operations subsequent to FIG. 7C.

Next, as illustrated in FIG. 8A, the signal line 14, the driving line 16, and the ground line 17 are formed. More specifically, for example, Au is grown by electroplating on the undercoat film, which is exposed in regions corresponding to the openings 108*a*, 108*b* and 108*c*. The plating material is grown to a thickness of, e.g., 20 μm.

Figure 8B:
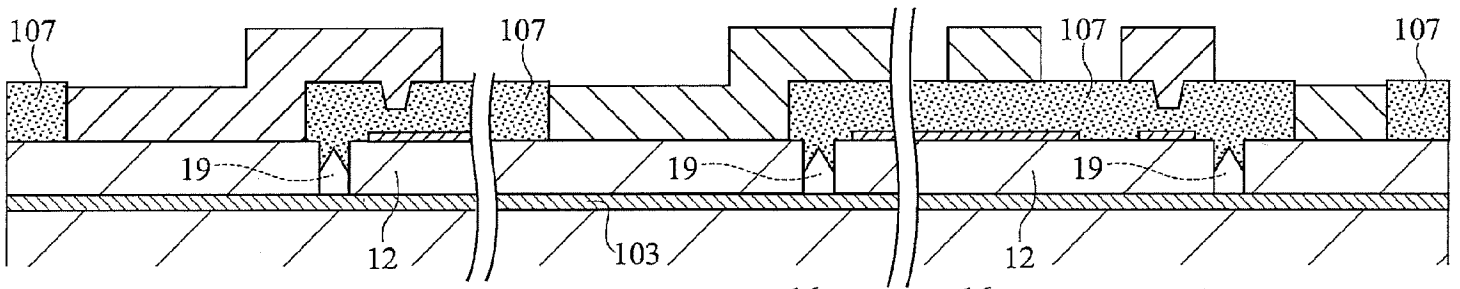

Next, as illustrated in FIG. 8B, the resist pattern 108 is etched away. Thereafter, the exposed portions of the undercoat film, which has been used for the electroplating, are removed. Ion milling or reactive ion etching (RIE) can be employed as a method for removing the undercoat film.

Figure 8C:
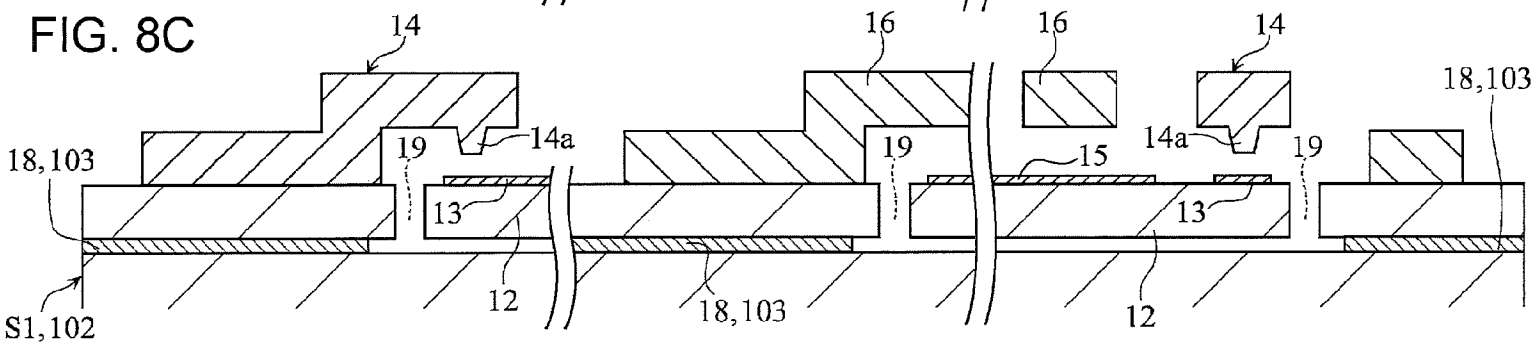

Next, as illustrated in FIG. 8C, the sacrifice layer 107 and the intermediate layer 103 are partly removed. More specifically, wet etching is performed on the sacrifice layer 107 and the intermediate layer 103. In that wet etching, the sacrifice layer 107 is first removed and the intermediate layer 103 is then partly removed from locations exposed to the slit 19. That wet etching is stopped after a gap has been appropriately formed between the whole of the movable portion 12 and the second layer 102. In such a way, the boundary layer 18 is formed in a state remaining in the intermediate layer 103. Further, the second layer 102 constitutes the substrate S1.

Next, the above-mentioned undercoat film (not shown) adhering to respective surfaces of the signal line 14 and the driving line 16 are removed as required. Wet etching can be employed as a method for removing the undercoat layer.

Thereafter, the entire device is dried, as required, by a supercritical drying method. The supercritical drying method can avoid the movable portion 12 from sticking to the substrate S1 and so on, i.e., a sticking phenomenon. As a result, the switching device X1 can be appropriately manufactured.

With the above-described manufacturing method, the signal line 14 having the region positioned to face the signal line 13 can be formed in a larger thickness by the plating. Therefore, the signal line 14 can be set to a thickness sufficient to realize the desired low resistance. The thick signal line 14 is preferable including in reducing the insertion loss of the switching device X1.

Figure 9:
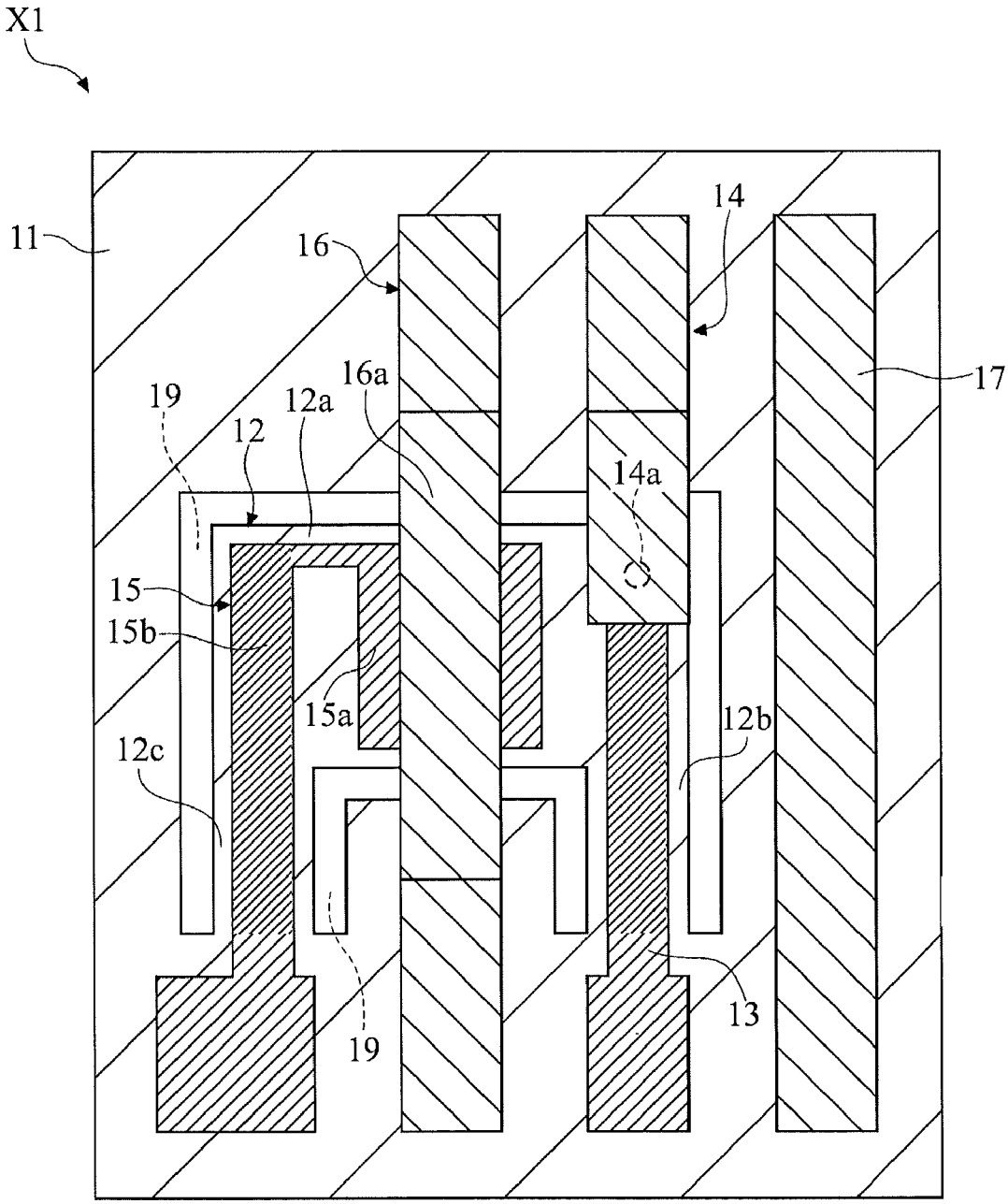
FIG. 9 is a plan view of a first modification of the switching device according to an embodiment.
Figure 10:
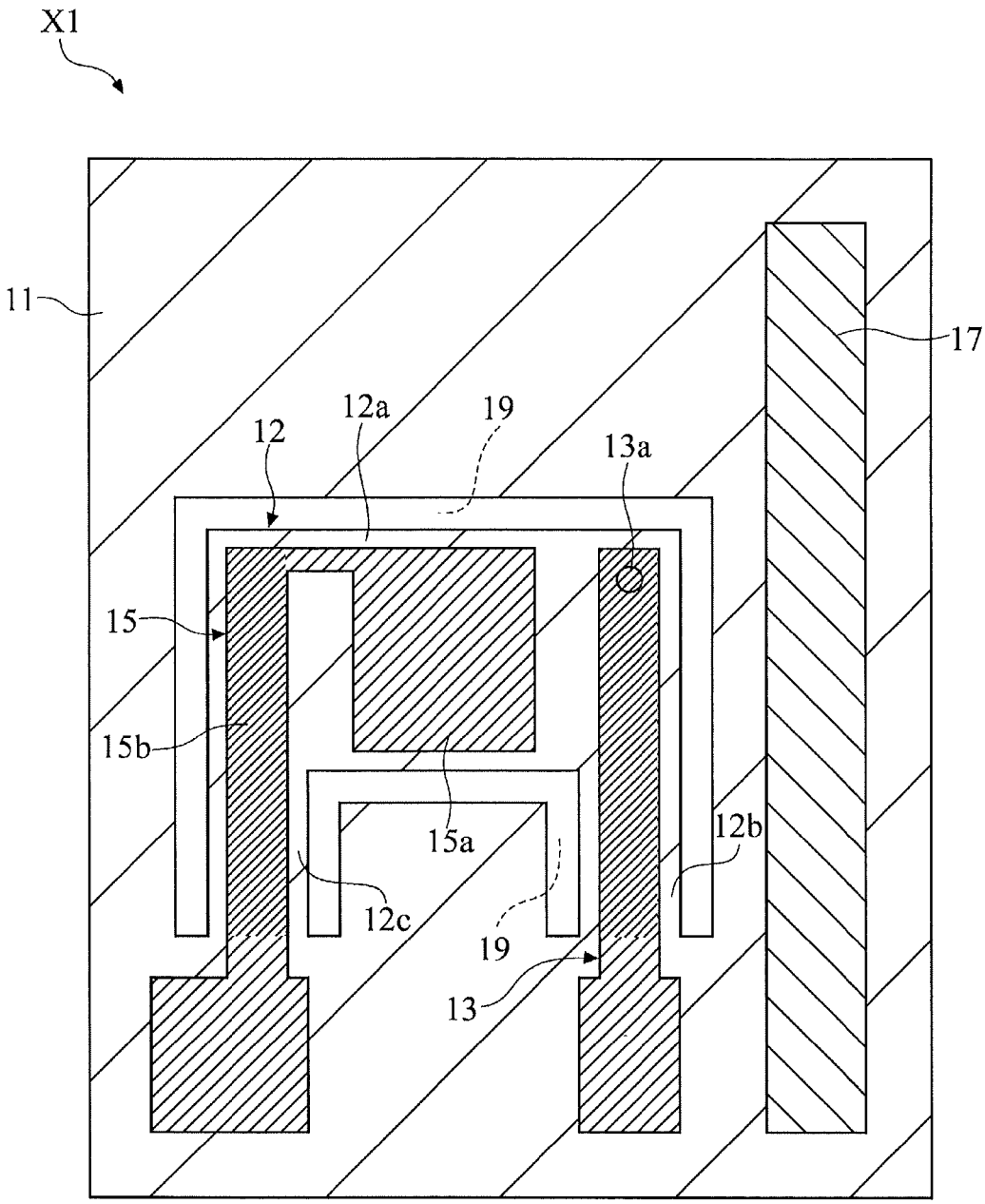
FIG. 10 is a plan view, partly omitted, of the switching device illustrated in FIG. 9.

FIGS. 9 and 10 illustrate a first modification of the switching device X1. FIG. 9 is a plan view of the first modification. FIG. 10 is a plan view, partly omitted, of the first modification (in FIG. 10, the signal line 14 and the driving line 16 are omitted).

The switching device X1 may include the driving line 15 having a pattern shape illustrated in FIGS. 9 and 10. The driving line 15, illustrated in FIGS. 9 and 10, has a portion 15*b* on the movable portion 12. For clearer understanding from the drawing, the portion 15*b* is denoted by thinner hatching than the other portion of the driving line 15. The pattern shape of the portion 15*b* is congruent to the pattern shape (denoted by similar thinner hatching to that representing the portion 15*b*) of the signal line 13 on the movable portion 12. Such a symmetrical arrangement is preferable including in suppressing the generation of improper deformation (such as torsional deformation) in the movable portion 12 that is elastically deformed when driven.

Figure 11:
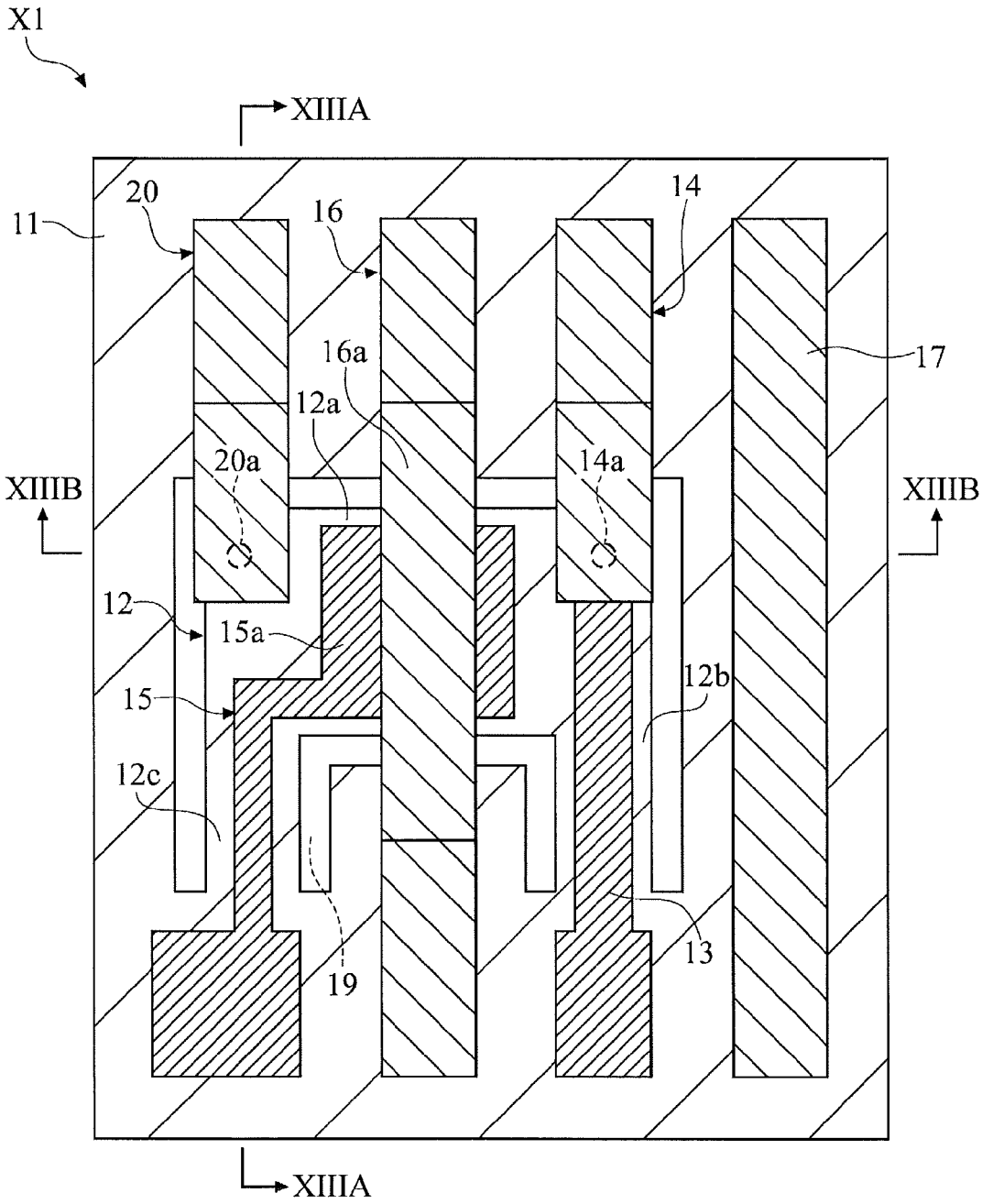
FIG. 11 is a plan view of a second modification of the switching device according to an embodiment.
Figure 12:
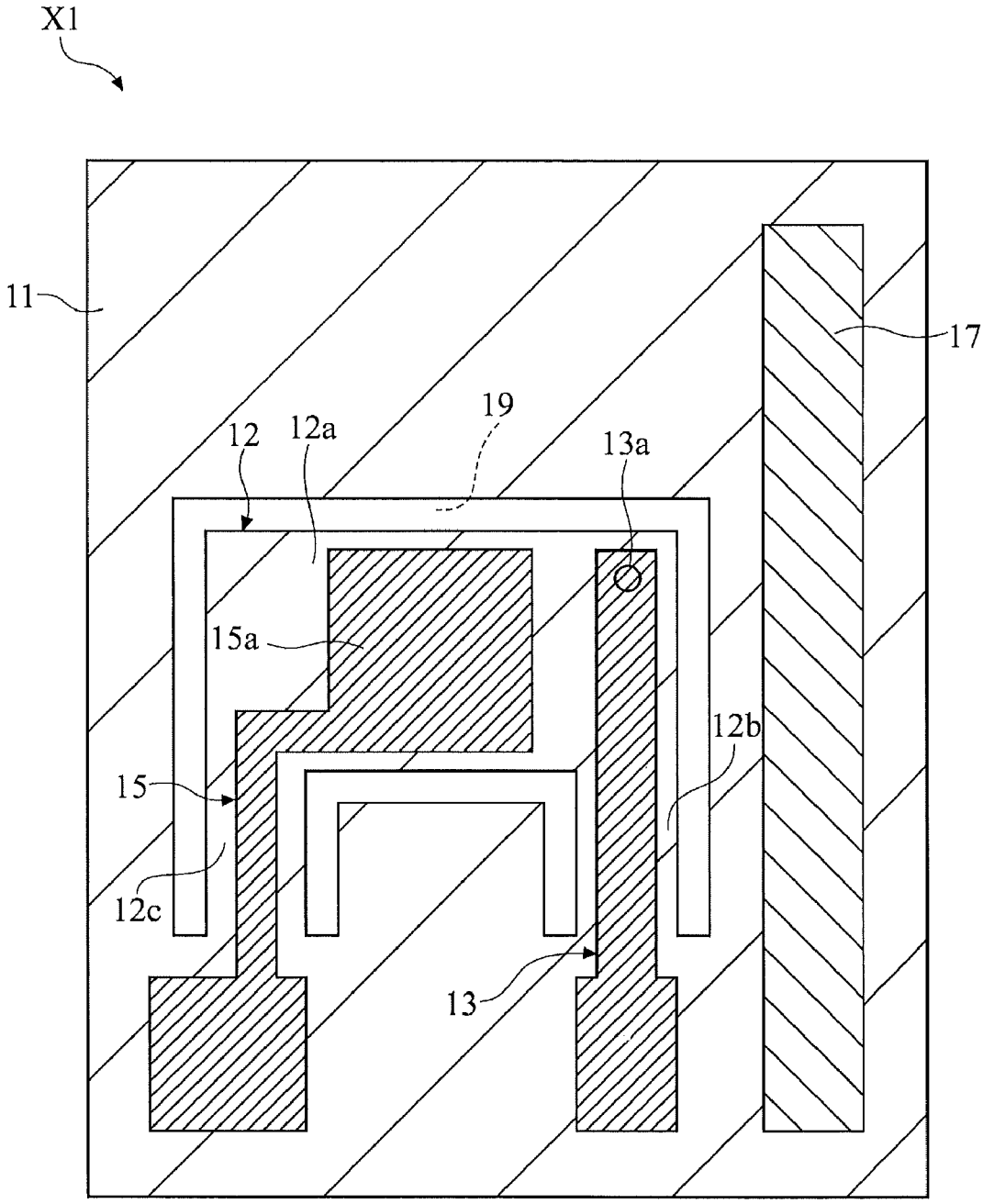
FIG. 12 is a plan view, partly omitted, of the switching device illustrated in FIG. 11.
Figure 13A:
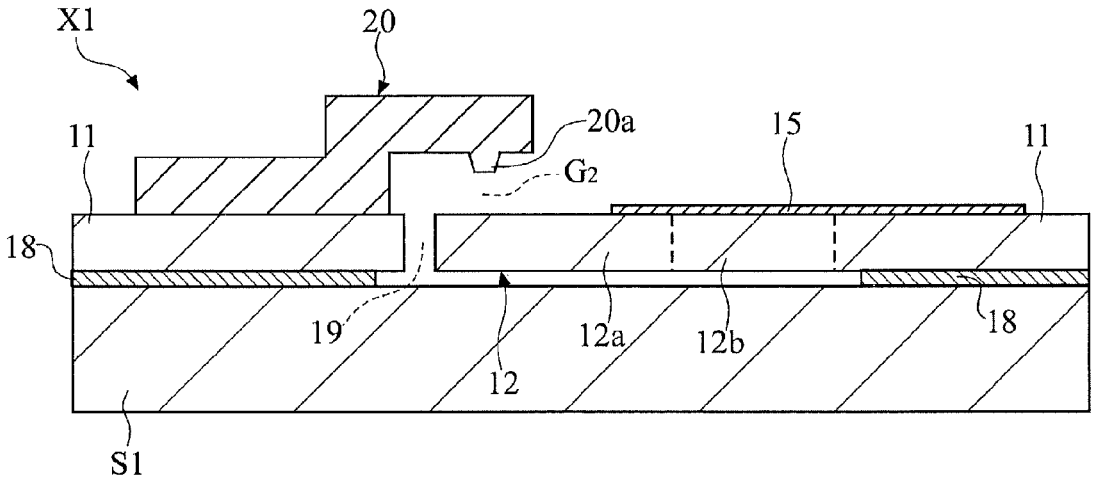
FIG. 13A is a sectional view taken along a line XIIIA-XIIIA in FIG. 11.
Figure 13B:
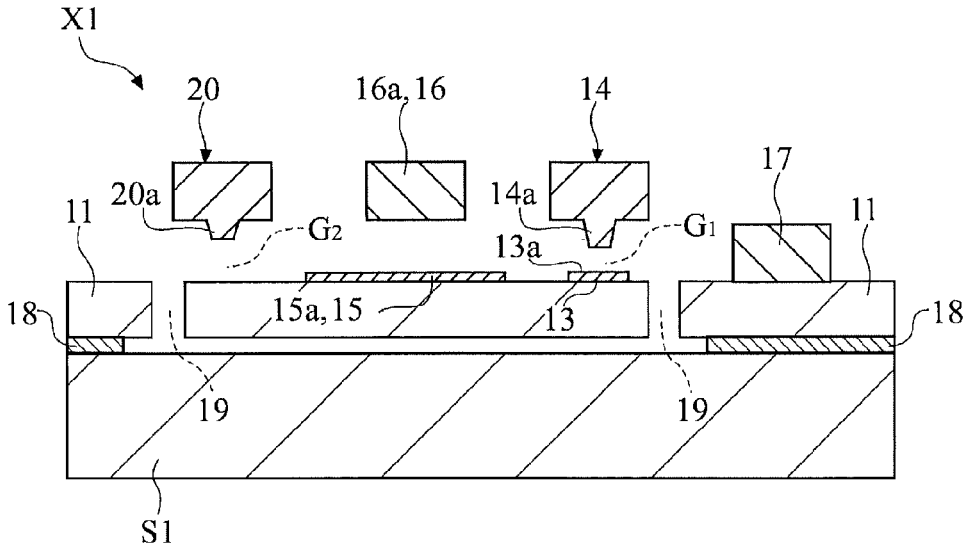
FIG. 13B is a sectional view taken along a line XIIIB-XIIIB in FIG. 11.

FIGS. 11 to 13B illustrate a second modification of the switching device X1. FIG. 11 is a plan view of the second modification. FIG. 12 is a plan view, partly omitted, of the second modification (in FIG. 12, the signal line 14 and the driving line 16 are omitted). FIGS. 13A and 13B are sectional views taken along lines XIIIA-XIIIA and XIIIB-XIIIB in FIG. 11, respectively.

The switching device X1 may include a stopper portion 20 (omitted in FIG. 12), as illustrated in FIGS. 11, 13A and 13B. The stopper portion 20 is formed in a shape protruding upwards from the stationary portion 11 and has a region positioned to face the movable portion 12. The stopper portion 20 includes, in its region positioned to face the movable portion 12, a projected portion 20*a* extending toward the movable portion 12. When the switching device X1 is not driven (i.e., when the movable portion 12 is in the natural state), as illustrated in FIG. 13B, a gap $G_2$ between the movable portion 12 and the projected portion 20*a* is larger than a gap $G_1$ between the contact portion 13*a* of the signal line 13 on the movable portion 12 and the contact portion 14*a*, i.e., the projected portion, of the signal line 14. When the switching device X1 is switched on (i.e., when the movable portion 12 is elastically deformed toward the driving electrode portion 16*a* of the driving line 16), the stopper portion 20 is capable of contacting the movable portion 12 after the contact portions 13*a* and 14*a* have been brought into the closed state, and hence it can prevent the movable portion 12 from further deforming closer to the driving electrode portion 16*a*. Accordingly, the provision of the stopper portion 20 is preferable including in preventing the driving electrode portions 15*a* and 16*a* from contacting with each other and from short-circuiting the switching device is driven. The above-described stopper portion 20 can be formed on the stationary portion 11 in a similar manner to that for forming the signal line 14 on the stationary portion 11.

Figure 14:
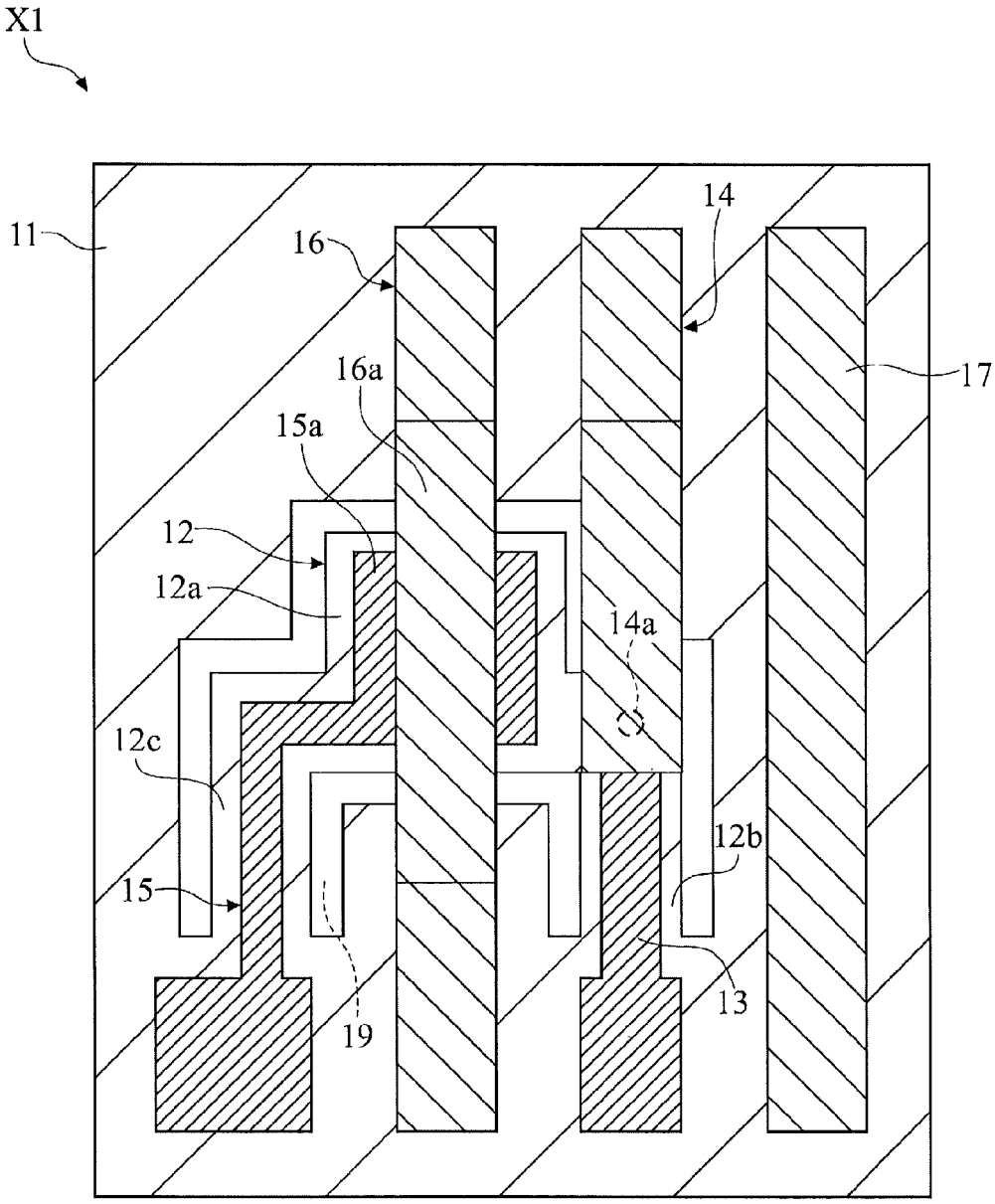
FIG. 14 is a plan view of a third modification of the switching device according to an embodiment.
Figure 15:
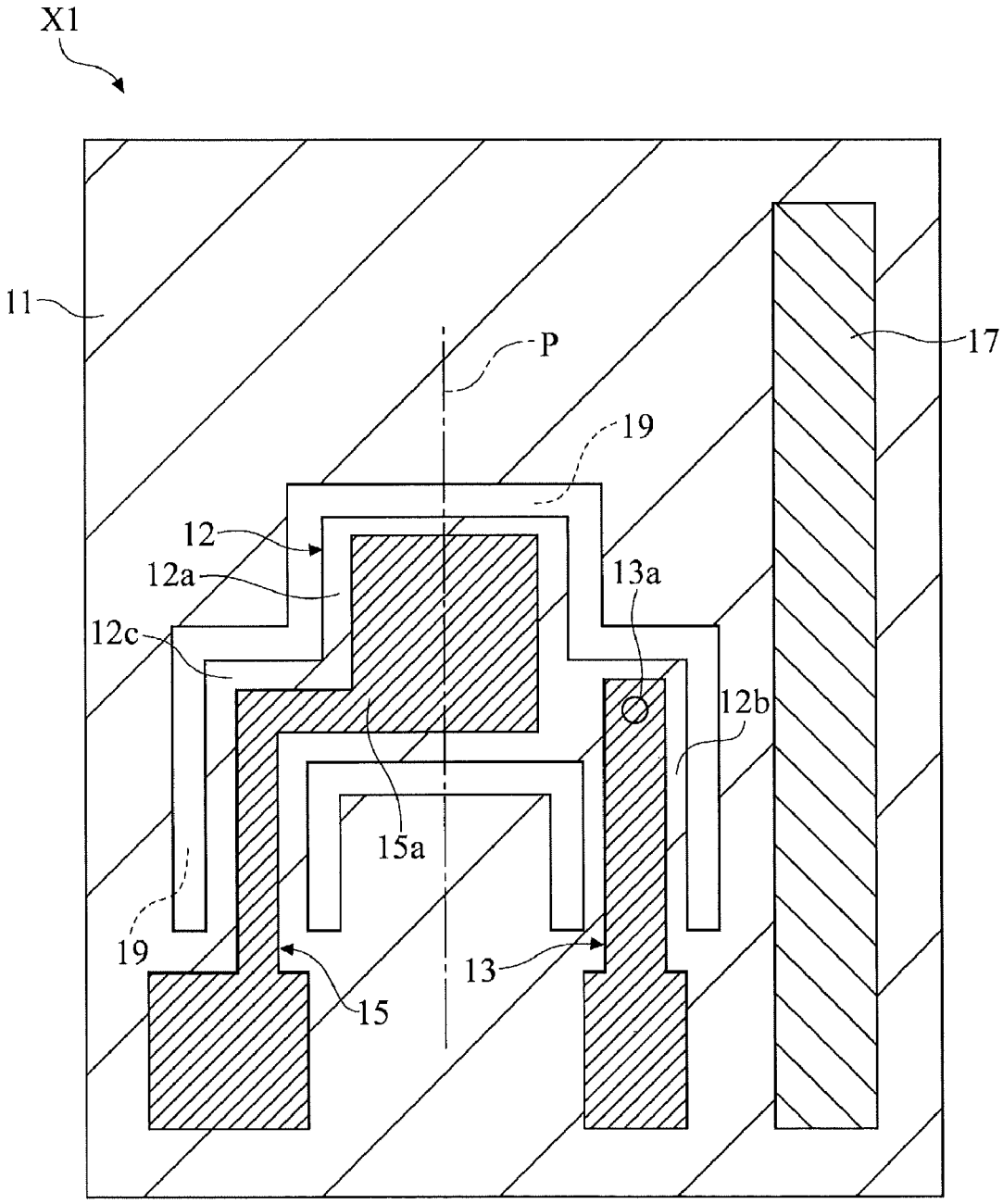
FIG. 15 is a plan view, partly omitted, of the switching device illustrated in FIG. 14.

FIGS. 14 and 15 illustrate a third modification of the switching device X1. FIG. 14 is a plan view of the third modification. FIG. 15 is a plan view, partly omitted, of the third modification (in FIG. 15, the signal line 14 and the driving line 16 are omitted).

The switching device X1 may include the movable portion 12, the signal lines 13 and 14, and the driving line 15, which are shaped as illustrated in FIGS. 14 and 15. The signal line 13, illustrated in FIGS. 14 and 15, is formed in a pattern extending over the beam portion 12*b* of the movable portion 12 and the stationary portion 11, and it has the contact portion 13*a* on the beam portion 12*b*. The signal line 13, illustrated in FIGS. 14 and 15, is shorter than, e.g., the signal line 13 illustrated in FIGS. 1 and 2. The signal line 13 having a shorter length has lower resistance. Therefore, the arrangement that the signal line 13 having a fairly smaller thickness than the signal line 14 is relatively short, as illustrated in FIG. 15, is preferable including in suppressing the signal loss generated in the signal path (i.e., the signal lines 13 and 14). Further, the movable portion 12 in the third modification has a symmetrical shape with a phantom (imaginary) line P being an axis of symmetry, as illustrated in the plan views of FIGS. 14 and 15. Such a symmetrical arrangement is preferable in suppressing the generation of improper deformation (such as torsional deformation) in the movable portion 12 that is elastically deformed when driven.

Figure 16:
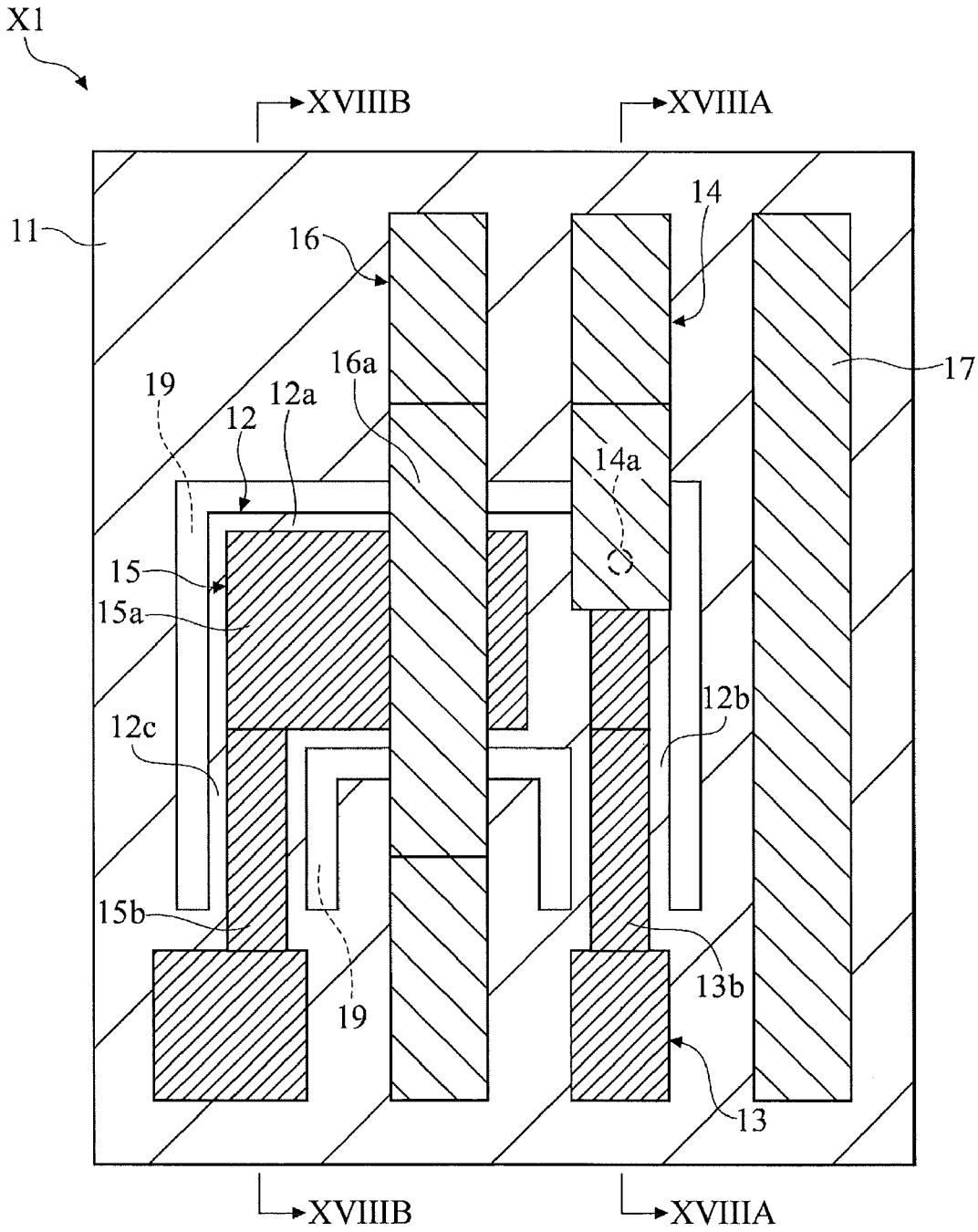
FIG. 16 is a plan view of a fourth modification of the switching device according to an embodiment.
Figure 17:
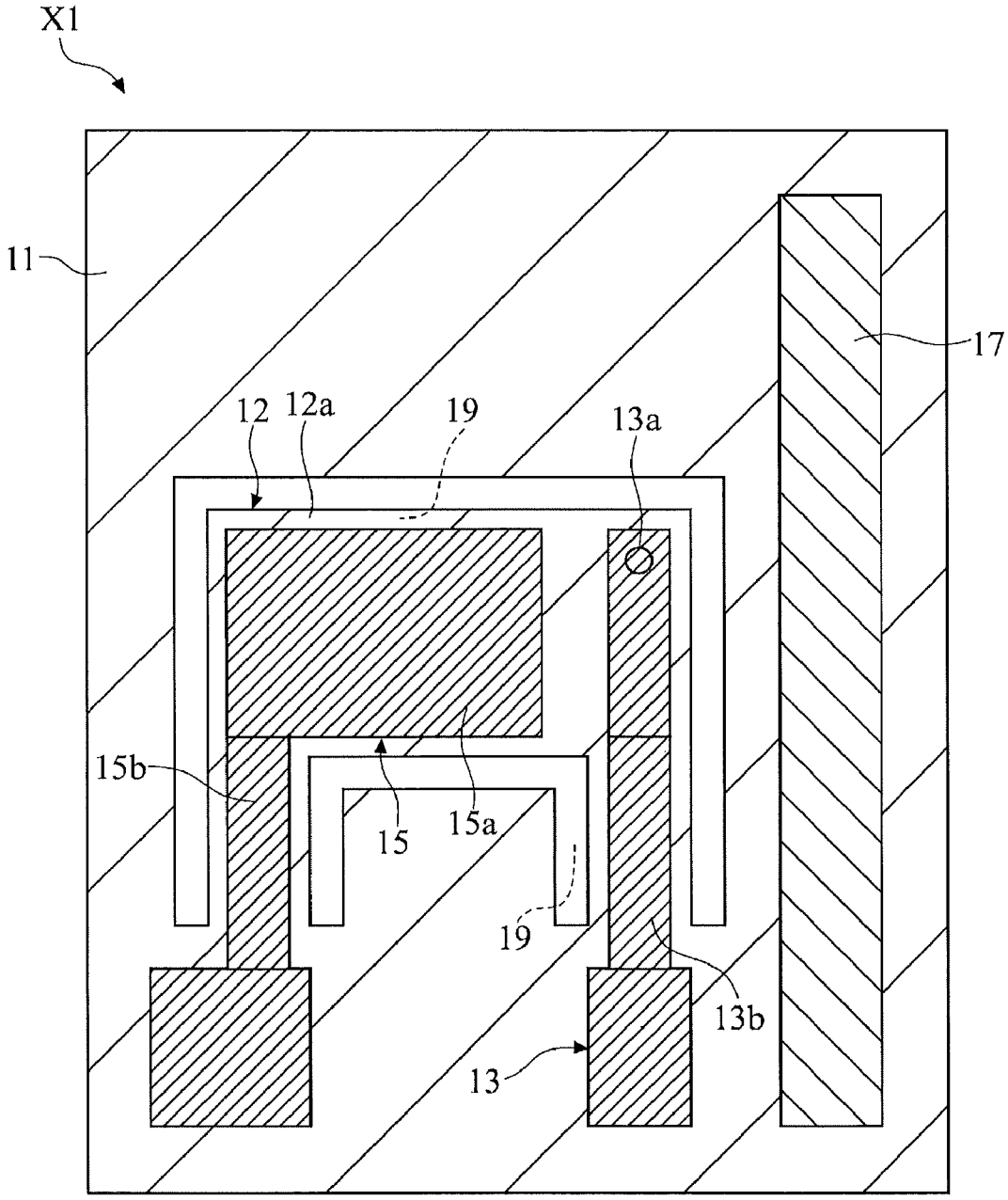
FIG. 17 is a plan view, partly omitted, of the switching device illustrated in FIG. 16.
Figure 18A:
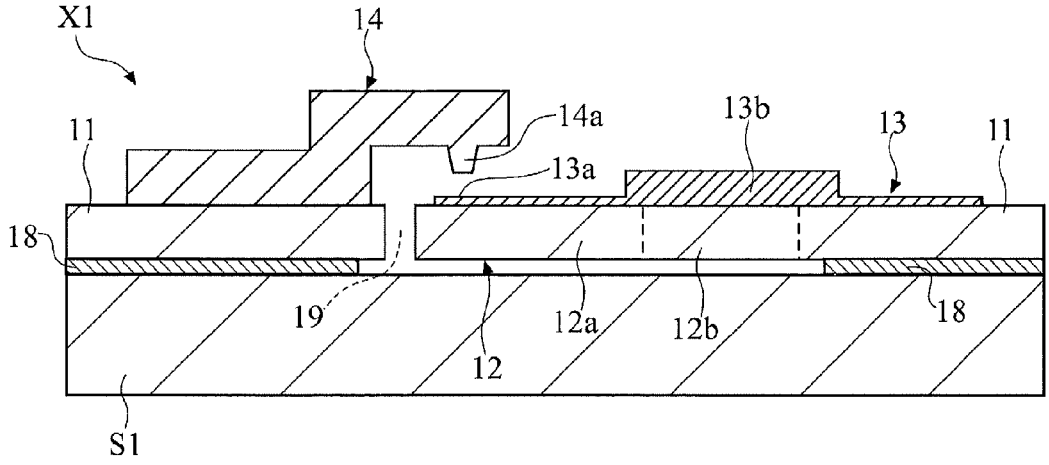
FIG. 18A is a sectional view taken along a line XVIIIA-XVIIIA in FIG. 16.
Figure 18B:
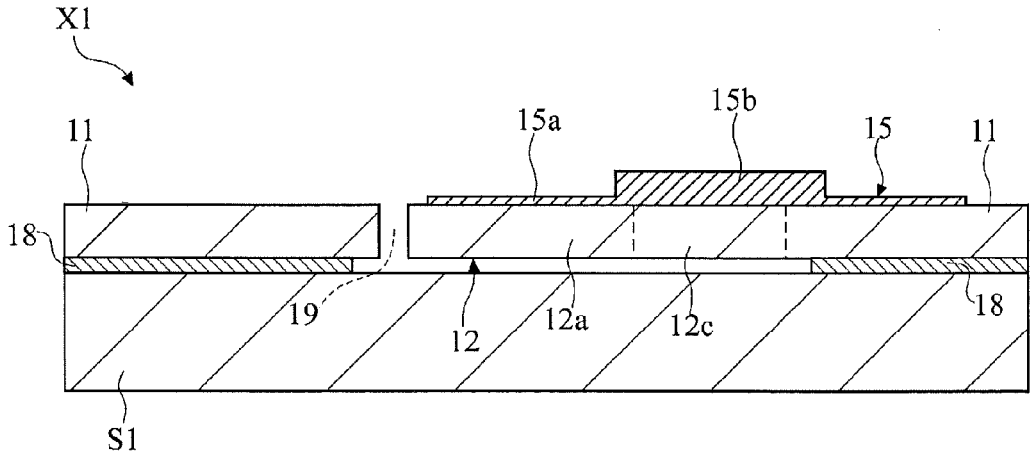
FIG. 18B is a sectional view taken along a line XVIIIB-XVIIIB in FIG. 16.

FIGS. 16 to 18B illustrate a fourth modification of the switching device X1. FIG. 16 is a plan view of the fourth modification. FIG. 17 is a plan view, partly omitted, of the fourth modification (in FIG. 17, the signal line 14 and the driving line 16 are omitted). FIGS. 18A and 18B are sectional views taken along lines XVIIIA-XVIIIA and in FIG. 16, respectively.

The switching device X1 may include the signal line 13 and the driving line 15 each having a partly thicker portion, as illustrated in FIGS. 18A and 18B. The signal line 13, illustrated in FIG. 18A, has a thicker portion 13*b* primarily on the beam portion 12*b* of the movable portion 12. The provision of the thicker portion 13*b* in the signal line 13 is preferable including in reducing the resistance of the signal line 13 and hence desirable in suppressing the signal loss occurred in the signal path (i.e., the signal lines 13 and 14). Further, similarly to the arrangement that the signal line 13 has the thicker portion 13*b* primarily on the beam portion 12*b* of the movable portion 12, the driving line 15 illustrated in FIG. 18B has a thicker portion 15*b* primarily on the beam portion 12*c* of the movable portion 12. Such a symmetrical arrangement is preferable including in suppressing the generation of improper deformation (such as torsional deformation) in the movable portion 12 that is elastically deformed when driven.

Figure 19:
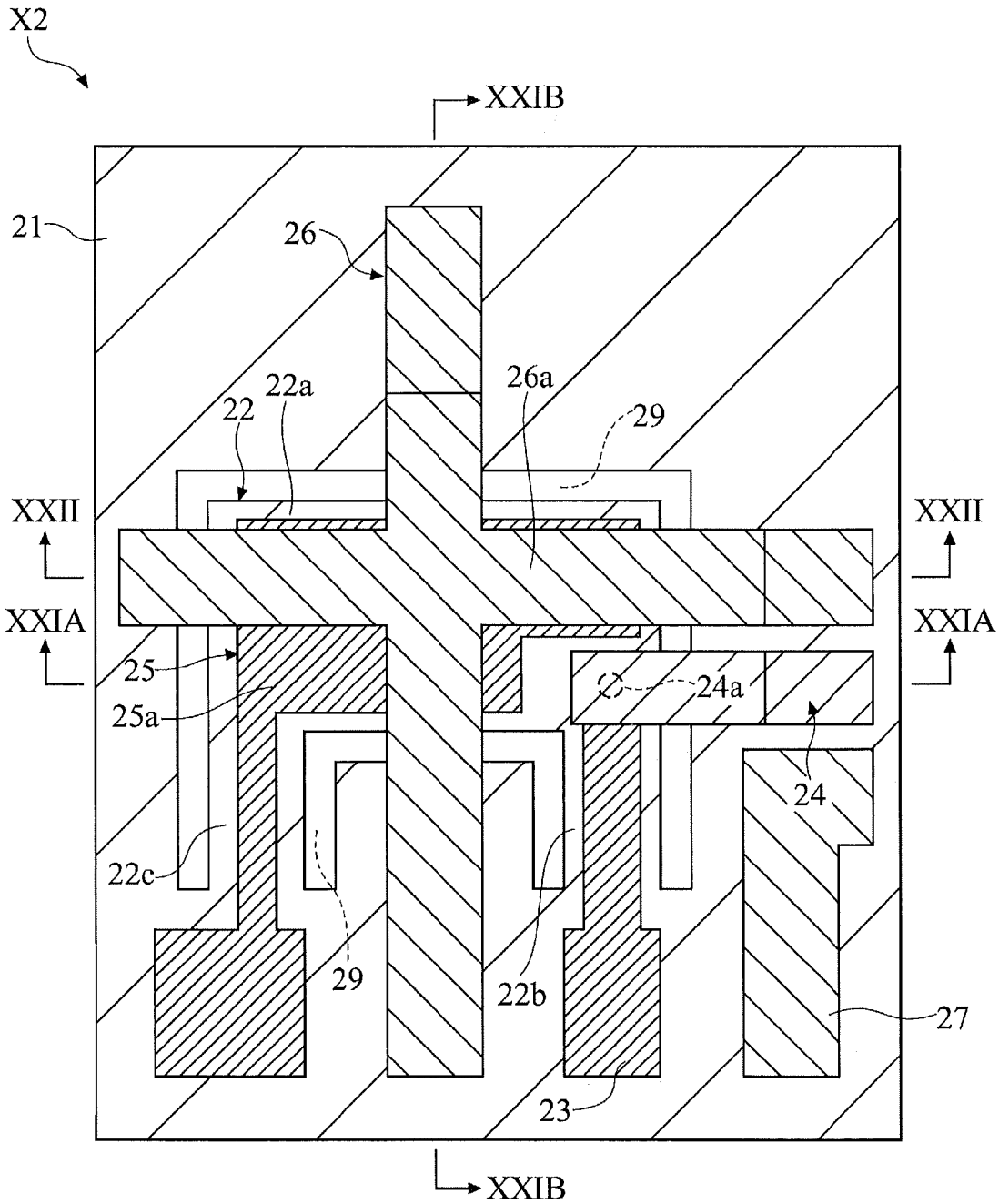
FIG. 19 is a plan view of a switching device according to an embodiment of the present invention.
Figure 20:
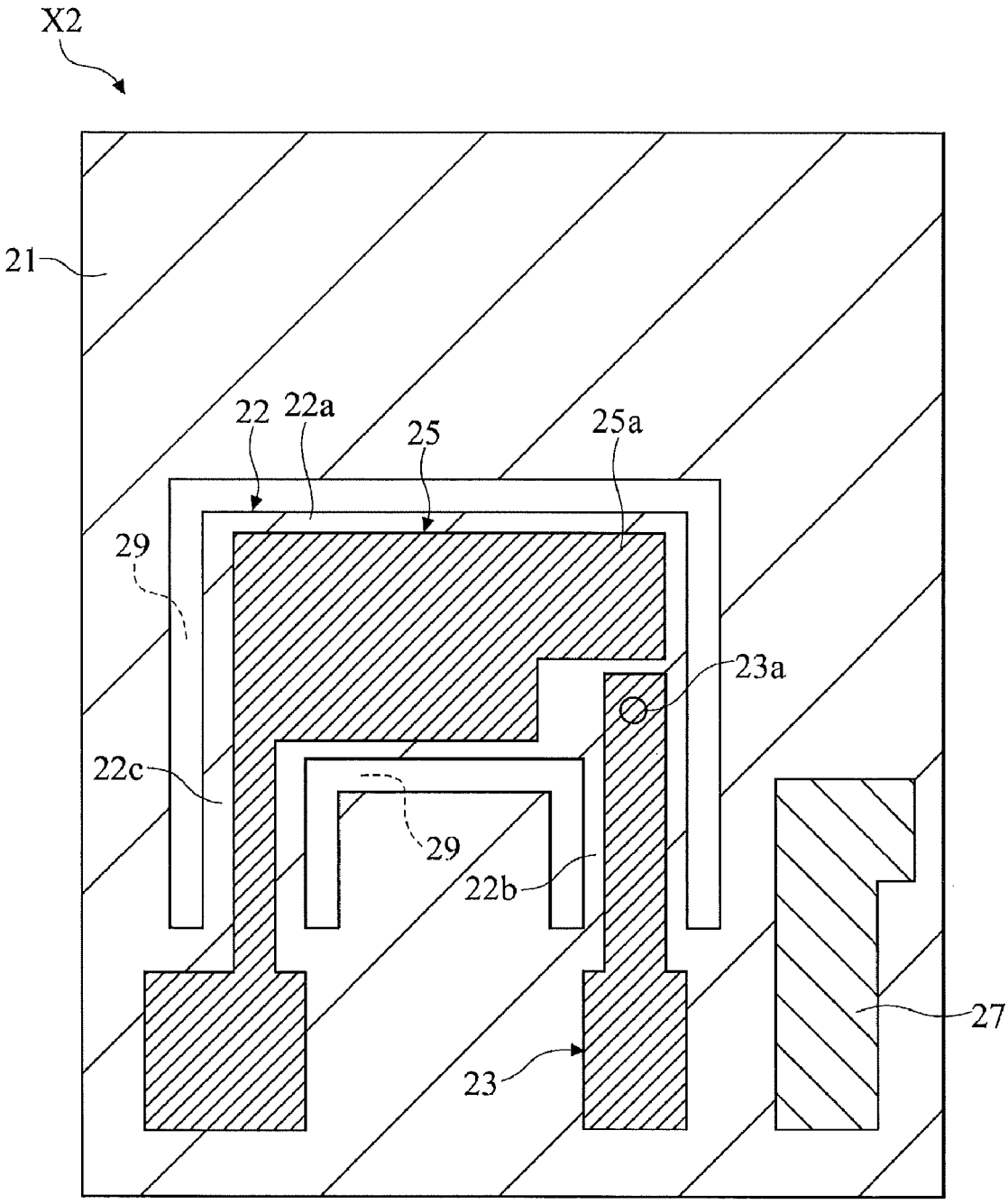
FIG. 20 is a plan view, partly omitted, of the switching device illustrated in FIG. 19.
Figure 21A:
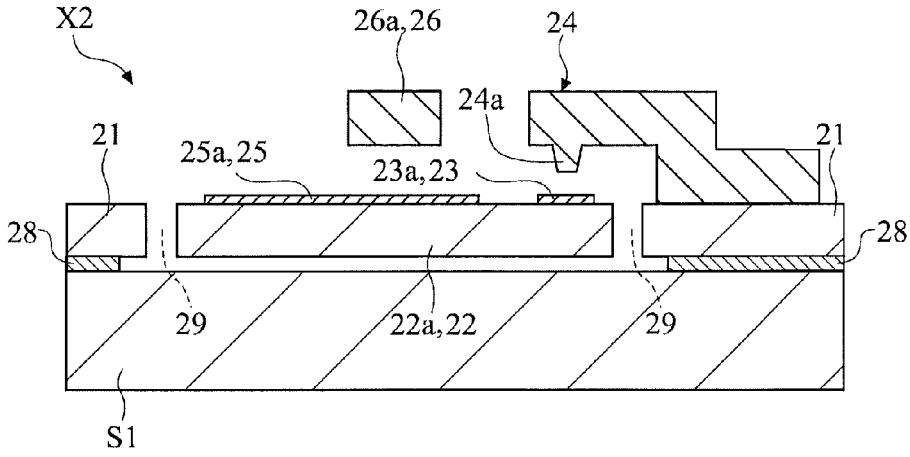
FIG. 21A is a sectional view taken along a line XXIA-XXIA in FIG. 19.
Figure 21B:
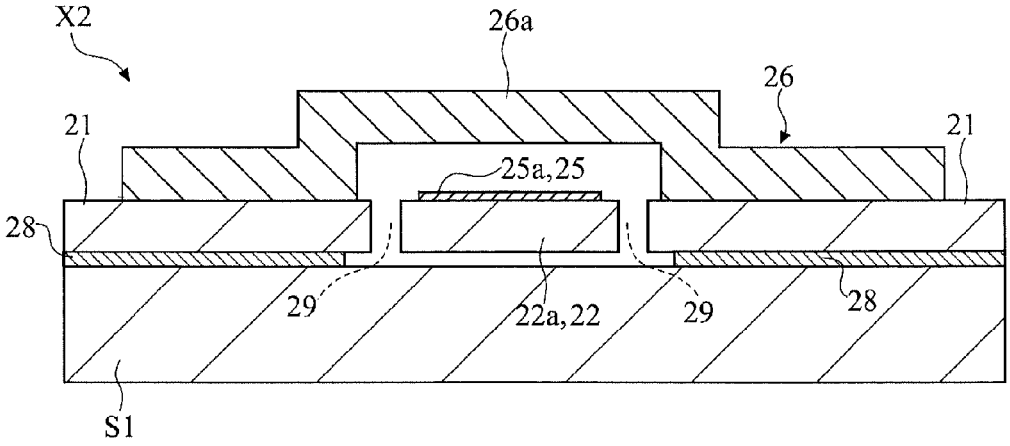
FIG. 21B is a sectional view taken along a line XXIB-XXIB in FIG. 19.
Figure 22:
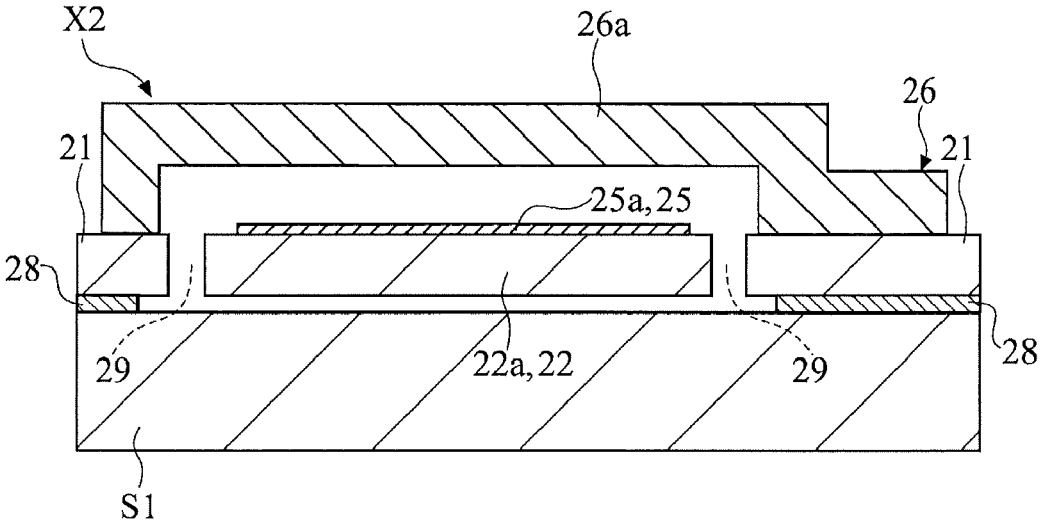
FIG. 22 is a sectional view taken along a line XXII-XXII in FIG. 19.

FIGS. 19, 20, 21A, 21B and 22 illustrate a switching device X2 according to an embodiment of the present invention. FIG. 19 is a plan view of the switching device X2. FIG. 20 is a plan view, partly omitted, of the switching device X2. FIGS. 21A, 21B and 22 are sectional views taken along lines XXIA-XXIA, XXIB-XXIB and XXII-XXII in FIG. 19, respectively.

The switching device X2 includes a substrate S1, a stationary portion 21, a movable portion 22, a signal line 23, a signal line 24 (omitted in FIG. 20), a driving line 25, a driving line 26 (omitted in FIG. 20), and a ground line 27. As illustrated in FIGS. 21A and 21B, the stationary portion 21 is joined to the substrate S1 through a boundary layer 28. As illustrated in FIGS. 19 and 20, the movable portion 22 has a movable land portion 22*a* and beam portions 22*b* and 22*c*, and it is surrounded by the stationary portion 21 with a slit 29 interposed therebetween. In an second embodiment, the beam portions 22*b* and 22*c* couple the stationary portion 21 and the movable land portion 22*a* with each other, and they extend side by side parallel to each other between the stationary portion 21 and the movable land portion 22*a*. As most clearly illustrated in FIG. 20, the signal line 23 is disposed to extend over the movable land portion 22*a*, the beam portion 22*b*, and the stationary portion 21. Also, the signal line 23 has, on the movable land portion 12*a*, a contact portion 23*a* capable of contacting the signal line 14. Further, the signal line 23 is connected to a predetermined circuit, which is a switching target, through predetermined wiring (not shown). As illustrated in FIG. 21A, the signal line 24 is formed in a shape protruding upwards from the stationary portion 21 and has a region positioned to face the signal line 23. The signal line 24 includes, in its region positioned to face the signal line 13, a projected portion or a contact portion 24*a* extending toward the signal line 23. Further, the signal line 24 is connected to a predetermined circuit, which is a switching target, through predetermined wiring (not shown). A signal path constituted by the signal lines 23 and 24 is bent on the movable land portion 22*a* of the movable portion 22 as appearing in the plan view of FIG. 19 (the contact portions 23*a* and 24*a* being positioned on the movable land portion 22*a*). As most clearly illustrated in FIG. 20, the driving line 25 is disposed to extend over the movable land portion 22*a*, the beam portion 22*c*, and the stationary portion 21. Also, the driving line 25 has a driving electrode portion 25*a* on the movable land portion 22*a*. As illustrated in FIGS. 21B and 22, the driving line 26 is formed in a shape protruding upwards from the stationary portion 21 and straddling over the driving electrode portion 25*a* of the driving line 25. The driving line 26 has a driving electrode portion 26*a* positioned to face the driving electrode portion 25*a*. Further, the driving line 26 has a shape extending along the signal lines 23 and 24 as illustrated in FIG. 19, and is connected to the ground through predetermined wiring (not shown) (hence the driving line 26 serves also as a ground line). The ground line 27 has a shape extending along the signal lines 23 and 24 as illustrated in FIG. 19, and is connected to the ground through predetermined wiring (not shown). Other constructions of the stationary portion 21, the movable portion 22, the signal lines 23 and 24, the driving lines 25 and 26, and the ground line 27 are similar to those described above regarding the stationary portion 11, the movable portion 12, the signal lines 13 and 14, the driving lines 15 and 16, and the ground line 17 in the above-described embodiment. The switching device X2 thus constructed can be manufactured by a method similar to that for manufacturing the switching device X1 according to the above-described embodiment.

In the switching device X2 having the above-described structure, when a driving voltage is applied to the driving line 25, an electrostatic attraction force is generated between the driving electrode portion 25*a* of the driving line 25 and the driving electrode portion 26*a* of the driving line 26 (connected to the ground), and the movable portion 22 is operated or elastically deformed until the contact portion 23*a* of the signal line 23 comes into contact with the contact portion 24*a* of the signal line 24. The closed state of the switching device X2 is thus established. In the closed state, the signal lines 23 and 24 are connected to each other so that a current is allowed to pass between the signal lines 23 and 24. With such a switching-on operation, the on-state of, e.g., a high-frequency signal can be achieved.

On the other hand, when, in the switching device X2 in the closed state, the application of the voltage to the driving line 25 is stopped to extinguish the electrostatic attraction force acting between the driving electrode portions 25*a* and 26*a*, the movable portion 22 returns to its natural state and the signal line 23, specifically the contact portion 23*a*, moves away from the signal line 24, specifically from the contact portion 24*a*. The open state of the switching device X2 is thus established. In the open state, the signal lines 23 and 24 are electrically separated from each other, whereby a current is prevented from passing between the signal lines 23 and 24. With such a switching-off operation, the off-state of, e.g., a high-frequency signal can be achieved.

In the switching device X2, the signal line 23 is disposed to extend over the movable land portion 22*a*, the beam portion 22*b*, and the stationary portion 21, and has the contact portion 23*a* on the movable portion 22, specifically on the movable land portion 22*a*. The signal line 24 has the contact portion 24*a* positioned to face the contact portion 23*a* and is fixed to the stationary portion 21. Passage and non-passage of, e.g., a high-frequency signal between the signal lines 23 and 24 are selected respectively by closing and opening between the contact portions 23*a* and 24*a*. Stated another way, the switching device X2 includes a single opening/closing point (single contact). The switching device X2 thus constructed is less susceptible to the sticking failure that has been described above in connection with the known switching device Z2. Accordingly, the switching device X2 is suitable for realizing a long contact opening/closing life.

In the switching device X2, the driving line 25 is disposed to extend over the movable land portion 22*a*, the beam portion 22*c*, and the stationary portion 21, and has the driving electrode portion 25*a* on the movable land portion 22*a*. The driving line 26 has the driving electrode portion 26*a* positioned to face the driving electrode portion 25*a* and is fixed to the stationary portion 21. With the driving voltage applied between the driving electrode portions 25*a* and 26*a*, an electrostatic attraction force is generated between the driving electrode portions 25*a* and 26*a* so that the movable land portion 22*a* to which the driving electrode portion 25*a* is joined is operated or elastically deformed toward the driving electrode portion 26*a*. The driving line 25 is disposed separately from the signal line 23 (namely, the driving line 25 is routed from the movable land portion 22*a* to the stationary portion 21 while passing the beam portion 22*c* differing from the beam portion 22*b* on which the signal line 23 passes). Also, the driving line 26 is disposed separately from the signal line 24. Stated another way, in the switching device X2, the signal lines 23 and 24 are electrically separated from the driving lines 25 and 26. The switching device X2 thus constructed is less susceptible to the signal leakage from the signal line to the driving line, which has been described above in connection with the known switching device Z1. Accordingly, the switching device X2 is suitable for not only reducing an insertion loss, but also obtaining a superior high-frequency characteristic.

In the switching device X2, as illustrated in the plan view of FIG. 19, a signal path constituted by the signal lines 23 and 24 is disposed between the driving line 26 (ground line) and the ground line 27, and the driving line 26 and the ground line 27 have shapes extending along the signal path. In other words, the signal path (i.e., the signal lines 23 and 24) and two ground lines (i.e., the driving line 26 and the ground line 27) constitute coplanar passages. Using the coplanar passages is preferable including in suppressing the signal leakage from the signal lines 23 and 24.

In the switching device X2, the signal lines 23 and 24 are disposed such that the signal path (constituted by the signal lines 23 and 24) is bent on the movable land portion 22*a* of the movable portion 22, as appearing in the plan view of FIG. 19. Therefore, the switching device X2 can be more easily designed such that the signal line 23 has a shorter length on the movable land portion than the signal line 13 in the above-described embodiment, and that an area in which the driving electrode portions 25*a* and 26*a* are positioned to face each other is larger than an area in which the driving electrode portions 15*a* and 16*a* in the above-described embodiment are positioned to face each other. The signal line 23 having a smaller thickness is preferably formed to be shorter from the viewpoint of suppressing the signal loss occurred in the signal path (signal lines 23 and 24). Also, the area in which the driving electrode portions 25*a* and 26*a* for generating the electrostatic attraction force (driving force) are positioned to face each other is preferably set to be larger from the viewpoint of reducing the driving voltage. Thus, the switching device X2 has the structure suitable for not only suppressing the signal loss in the signal path, but also reducing the driving voltage.

In the switching device X2, similarly to the arrangement described above in the first modification of the switching device X1 regarding the signal line 13 and the driving line 15 on the movable portion 12, the signal line 23 and the driving line 25 on the movable portion 22 may be arranged in a symmetrical pattern shape. Similarly to the second modification of the switching device X1, the switching device X2 may include the stopper portion 20 (including the projected portion 20*a*) to prevent the driving electrode portions 25*a* and 26*a* from contacting with each other and short-circuiting when driven. Similarly to the third modification of the switching device X1 in which the signal lines 13 and 14 have the contact portions 13*a* and 14*a* on the beam portion 12*b*, the switching device X2 may be modified such that the contact portions 23*a* and 24*a* of the signal lines 23 and 24 are positioned on the beam portion 22*b*. Further, similarly to the fourth modification of the switching device X1 in which the signal line 13 and the driving line 15 partly have the thicker portions 13*a* and 15*a*, respectively, the switching device X2 may be modified such that the signal line 23 and the driving line 25 may partly have thicker portions.

Figure 23:
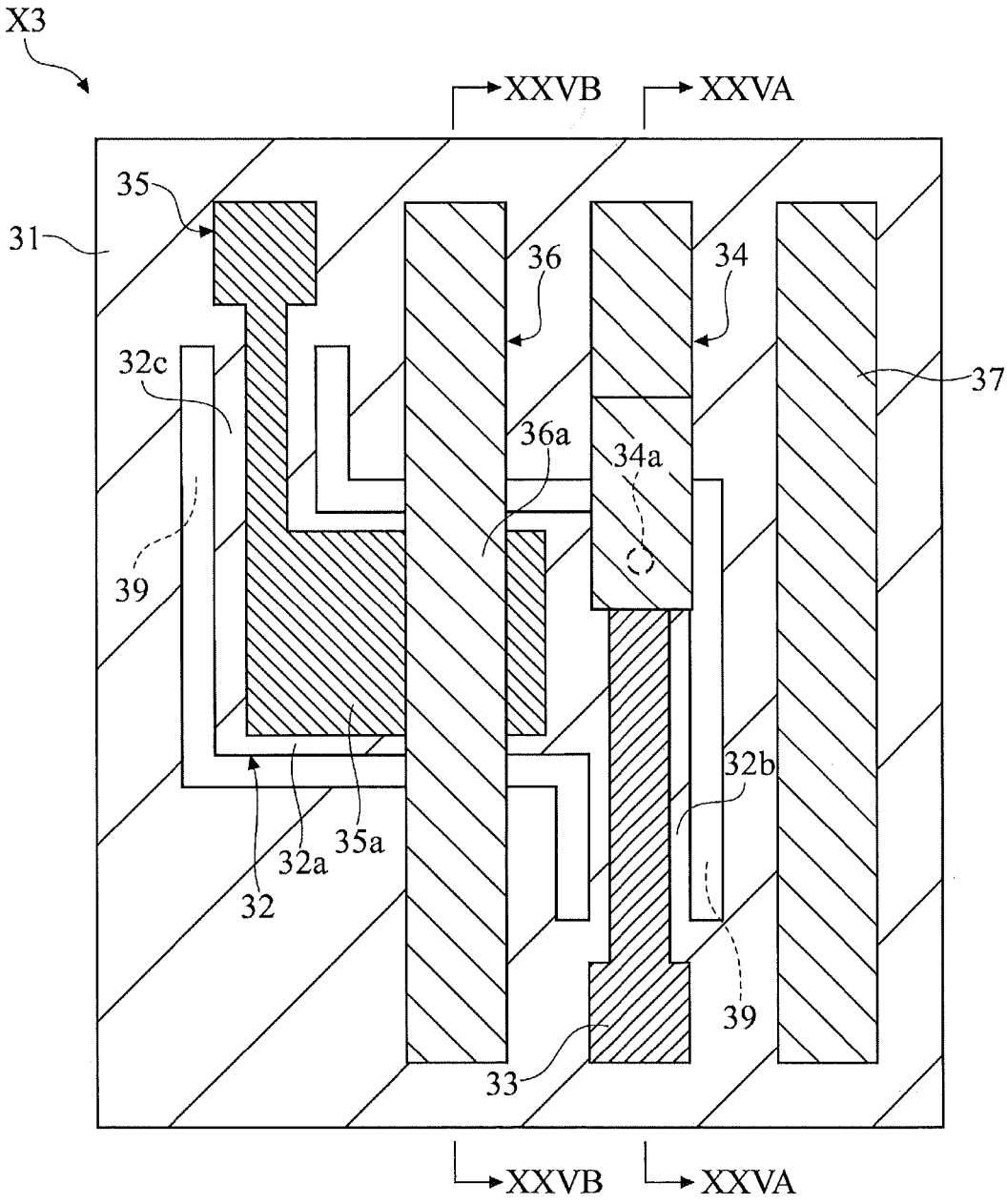
FIG. 23 is a plan view of a switching device according to an embodiment of the present invention.
Figure 24:
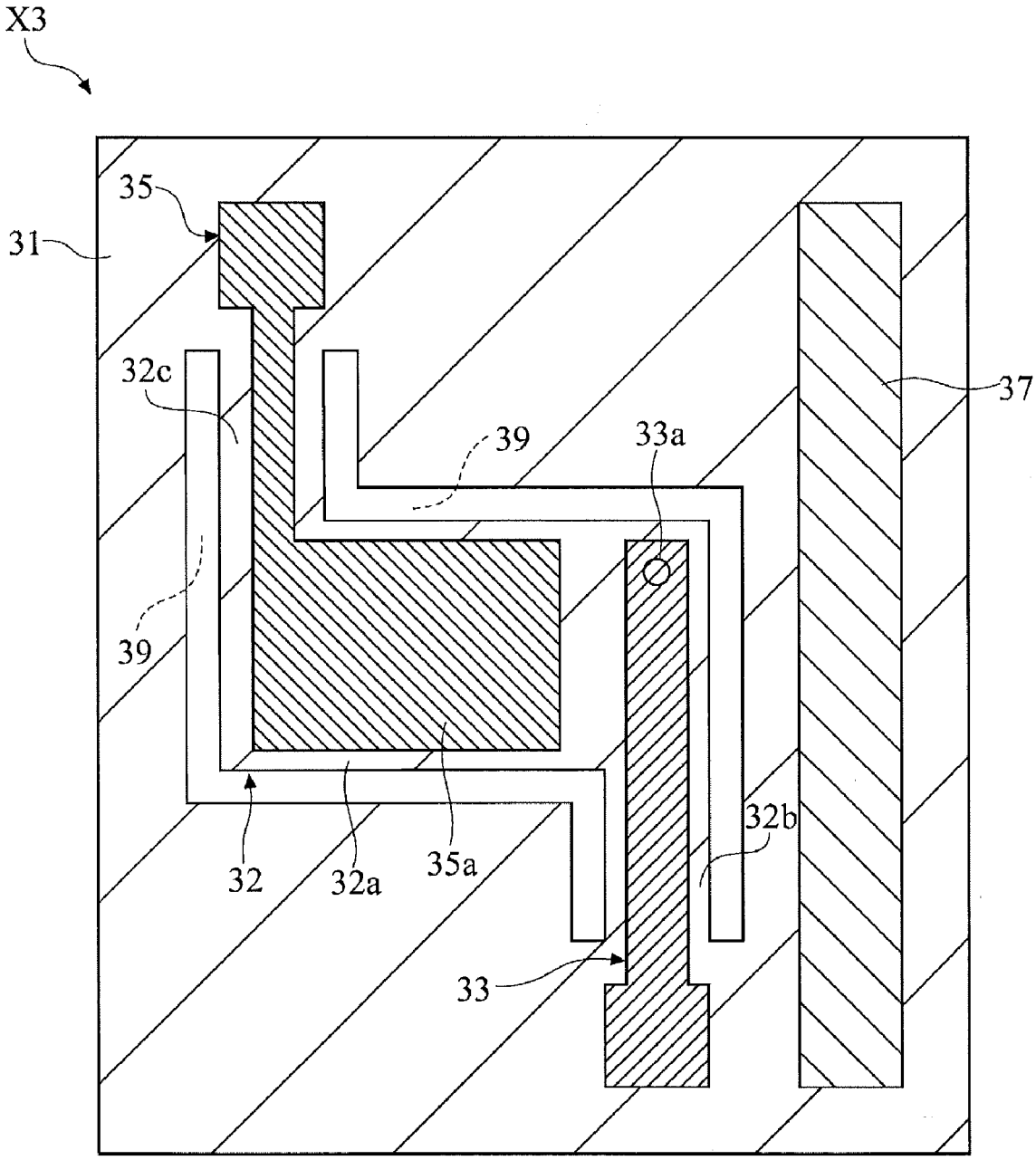
FIG. 24 is a plan view, partly omitted, of the switching device illustrated in FIG. 23.
Figure 25A:
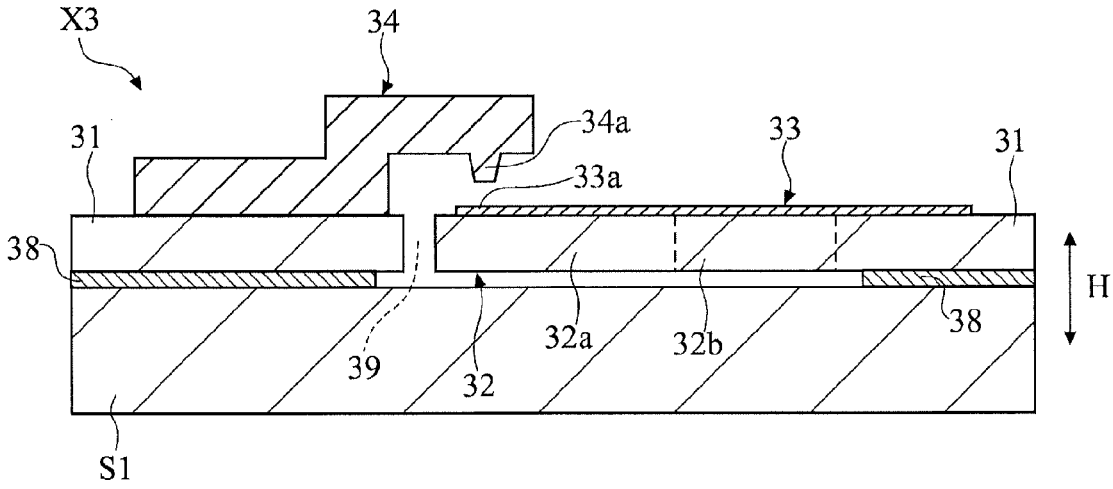
FIG. 25A is a sectional view taken along a line XXVA-XXVA in FIG. 23.
Figure 25B:
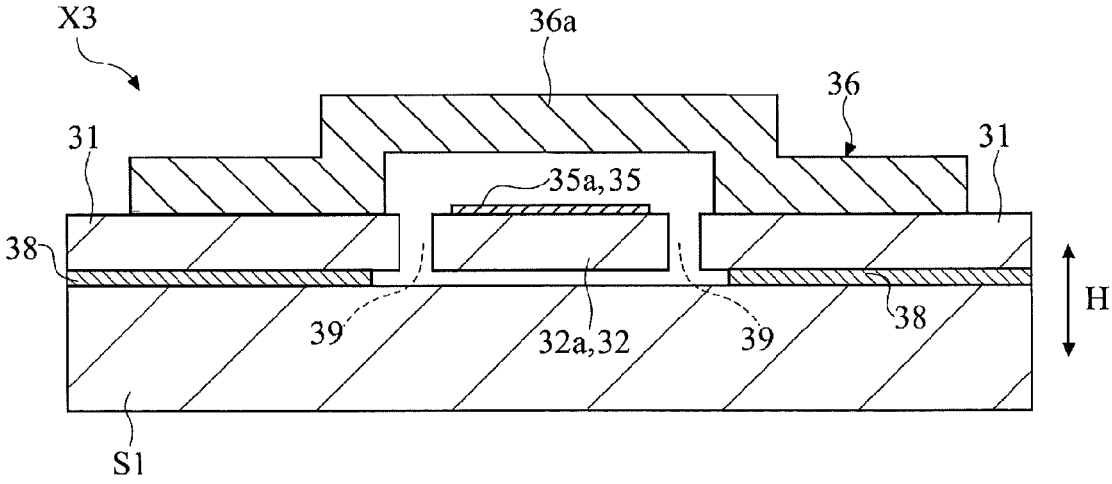
FIG. 25B is a sectional view taken along a line XXVB-XXVB in FIG. 23.

FIGS. 23, 24, 25A and 25B illustrate a switching device X3 according to an embodiment of the present invention. FIG. 23 is a plan view of the switching device X3. FIG. 24 is a plan view, partly omitted, of the switching device X3. FIGS. 25A and 25B are sectional views taken along lines XXVA-XXVA and XXVB-XXVB in FIG. 23, respectively.

The switching device X3 includes a substrate S1, a stationary portion 31, a movable portion 32, a signal line 33, a signal line 34 (omitted in FIG. 24), a driving line 35, a driving line 36 (omitted in FIG. 24), and a ground line 37. As illustrated in FIGS. 25A and 25B, the stationary portion 31 is joined to the substrate S1 through a boundary layer 38. As illustrated in FIGS. 23 and 24, the movable portion 32 has a movable land portion 32*a* and beam portions 32*b* and 32*c*, and it is surrounded by the stationary portion 31 with a slit 39 interposed therebetween. The beam portions 32*b* and 32*c* are oppositely extended in one direction and are spaced from each other in the extending direction with the movable land portion 32*a* disposed therebetween. Further, each of the beam portions 32*b* and 32*c* couples the movable land portion 32*a* and the stationary portion 31 with each other. In other words, the movable portion 32 is supported by the stationary portion 31 in a both-end supported structure. As most clearly illustrated in FIG. 24, the signal line 33 is disposed to extend over the movable land portion 32*a*, the beam portion 32*b*, and the stationary portion 31. Also, the signal line 33 has, on the movable land portion 32*a*, a contact portion 33*a* capable of contacting the signal line 34. Further, the signal line 33 is connected to a predetermined circuit, which is a switching target, through predetermined wiring (not shown). As illustrated in FIG. 25A, the signal line 34 is formed in a shape protruding upwards from the stationary portion 31 and has a region positioned to face the signal line 33. The signal line 34 includes, in its region positioned to face the signal line 33, a projected portion or a contact portion 34*a* extending toward the signal line 33. Further, the signal line 34 is connected to a predetermined circuit, which is a switching target, through predetermined wiring (not shown). As most clearly illustrated in FIG. 24, the driving line 35 is disposed to extend over the movable land portion 32*a*, the beam portion 32*c*, and the stationary portion 31. Also, the driving line 35 has a driving electrode portion 35*a* on the movable land portion 32*a*. As illustrated in FIG. 25B, the driving line 36 is formed in a shape protruding upwards from the stationary portion 31 and straddling over the driving electrode portion 35*a* of the driving line 35. The driving line 36 has a driving electrode portion 36*a* positioned to face the driving electrode portion 35*a*. Further, the driving line 36 has a shape extending along the signal lines 33 and 34 as illustrated in FIG. 23, and is connected to the ground through predetermined wiring (not shown) (hence the driving line 36 serves also as a ground line). The ground line 37 has a shape extending along the signal lines 33 and 34 as illustrated in FIG. 23, and is connected to the ground through predetermined wiring (not shown). Other constructions of the stationary portion 31, the movable portion 32, the signal lines 33 and 34, the driving lines 35 and 36, and the ground line 37 are similar to those described above regarding the stationary portion 11, the movable portion 12, the signal lines 13 and 14, the driving lines 15 and 16, and the ground line 17 in the above-described embodiment. The switching device X3 thus constructed can be manufactured by a method similar to that for manufacturing the switching device X1 according to the above-described embodiment.

In the switching device X3 having the above-described structure, when a driving voltage is applied to the driving line 35, an electrostatic attraction force is generated between the driving electrode portion 35*a* of the driving line 35 and the driving electrode portion 36*a* of the driving line 36 (connected to the ground), and the movable portion 32 is operated or elastically deformed until the contact portion 33*a* of the signal line 33 comes into contact with the contact portion 34*a* of the signal line 34. The closed state of the switching device X3 is thus established. In the closed state, the signal lines 33 and 34 are connected to each other so that a current is allowed to pass between the signal lines 33 and 34. With such a switching-on operation, the on-state of, e.g., a high-frequency signal can be achieved.

On the other hand, when, in the switching device X3 in the closed state, the application of the voltage to the driving line 35 is stopped to extinguish the electrostatic attraction force acting between the driving electrode portions 35*a* and 36*a*, the movable portion 32 returns to its natural state and the signal line 33, specifically the contact portion 33*a*, moves away from the signal line 34, specifically from the contact portion 34*a*. The open state of the switching device X3 is thus established. In the open state, the signal lines 33 and 34 are electrically separated from each other, whereby a current is prevented from passing between the signal lines 33 and 34. With such a switching-off operation, the off-state of, e.g., a high-frequency signal can be achieved.

In the switching device X3, the signal line 33 is disposed to extend over the movable land portion 32*a*, the beam portion 32*b*, and the stationary portion 31, and has the contact portion 33*a* on the movable portion 32, specifically on the movable land portion 32*a*. The signal line 34 has the contact portion 34*a* positioned to face the contact portion 33*a* and is fixed to the stationary portion 31. Passage and non-passage of, e.g., a high-frequency signal between the signal lines 33 and 34 are selected respectively by closing and opening between the contact portions 33*a* and 34*a*. Stated another way, the switching device X3 includes a single opening/closing point (single contact). The switching device X3 thus constructed is less susceptible to the sticking failure that has been described above in connection with the known switching device Z2. Accordingly, the switching device X3 is suitable for realizing a long contact opening/closing life.

In the switching device X3, the driving line 35 is disposed to extend over the movable land portion 32*a*, the beam portion 32*c*, and the stationary portion 31, and has the driving electrode portion 35*a* on the movable land portion 32*a*. The driving line 36 has the driving electrode portion 36*a* positioned to face the driving electrode portion 35*a* and is fixed to the stationary portion 31. With the driving voltage applied between the driving electrode portions 35*a* and 36*a*, an electrostatic attraction force is generated between the driving electrode portions 35*a* and 36*a* so that the movable land portion 32*a* to which the driving electrode portion 35*a* is joined is operated or elastically deformed toward the driving electrode portion 36*a*. The driving line 35 is disposed separately from the signal line 33 (namely, the driving line 35 is routed from the movable land portion 32*a* to the stationary portion 31 while passing the beam portion 32*c* differing from the beam portion 32*b* on which the signal line 33 passes). Also, the driving line 36 is disposed separately from the signal line 34. Stated another way, in the switching device X3, the signal lines 33 and 34 are electrically separated from the driving lines 35 and 36. The switching device X3 thus constructed is less susceptible to the signal leakage from the signal line to the driving line, which has been described above in connection with the known switching device Z1. Accordingly, the switching device X3 is suitable for not only reducing an insertion loss, but also obtaining a superior high-frequency characteristic.

In the switching device X3, as illustrated in the plan view of FIG. 23, a signal path constituted by the signal lines 33 and 34 is disposed between the driving line 36 (ground line) and the ground line 37, and the driving line 36 and the ground line 37 have shapes extending along the signal path. In other words, the signal path (i.e., the signal lines 33 and 34) and two ground lines (i.e., the driving line 36 and the ground line 37) constitute coplanar passages. Using the coplanar passages is preferable including in suppressing the signal leakage from the signal lines 33 and 34.

In the switching device X3, the distance of spacing between the contact portions 33*a* and 34*a* and the distance of spacing between the driving electrode portions 35*a* and 36*a* in the not-driven state are easier to accurately control. The reason is that, in the not-driven state, the movable portion 32 supported to the stationary portion 31 in the both-end supported structure is less apt to improperly displace in a direction H of thickness, denoted in FIGS. 25A and 25B. The signal line 33 in the switching device X3 can be formed in a similar manner to that for forming the signal line 13 in the above-described embodiment. In the signal line 33 thus formed, there may occur internal stress acting in the direction of contraction. The driving line 35 can be formed in a similar manner to that for forming the driving line 15 in the above-described embodiment. In the driving line 35 thus formed, there may occur internal stress acting in the direction of contraction. The internal stresses occurred in the signal line 33 and the driving line 35 act on the movable portion 32 as forces causing the movable portion 32 to deform such that the movable land portion 32*a* comes closer toward the signal line 34 and the driving line 36. However, the movable portion 32 supported to the stationary portion 31 in the both-end supported structure is more resistant against those deformation forces. As a result, in the not-driven state, the movable portion 32 is less apt to improperly displace in the direction H of thickness, denoted in FIGS. 25A and 25B.

Similarly to the second modification of the switching device X1, the switching device X3 may include the stopper portion 20 (including the projected portion 20*a*) to prevent the driving electrode portions 35*a* and 36*a* from contacting with each other and short-circuiting when driven. Similarly to the third modification of the switching device X1 in which the signal lines 13 and 14 have the contact portions 13*a* and 14*a* on the beam portion 12*b*, the switching device X3 may be modified such that the contact portions 33*a* and 34*a* of the signal lines 33 and 34 are positioned on the beam portion 32*b*. Further, similarly to the fourth modification of the switching device X1 in which the signal line 13 and the driving line 15 partly have the thicker portions 13*a* and 15*a*, respectively, the switching device X3 may be modified such that the signal line 33 and the driving line 35 may partly have thicker portions.

Figure 26:
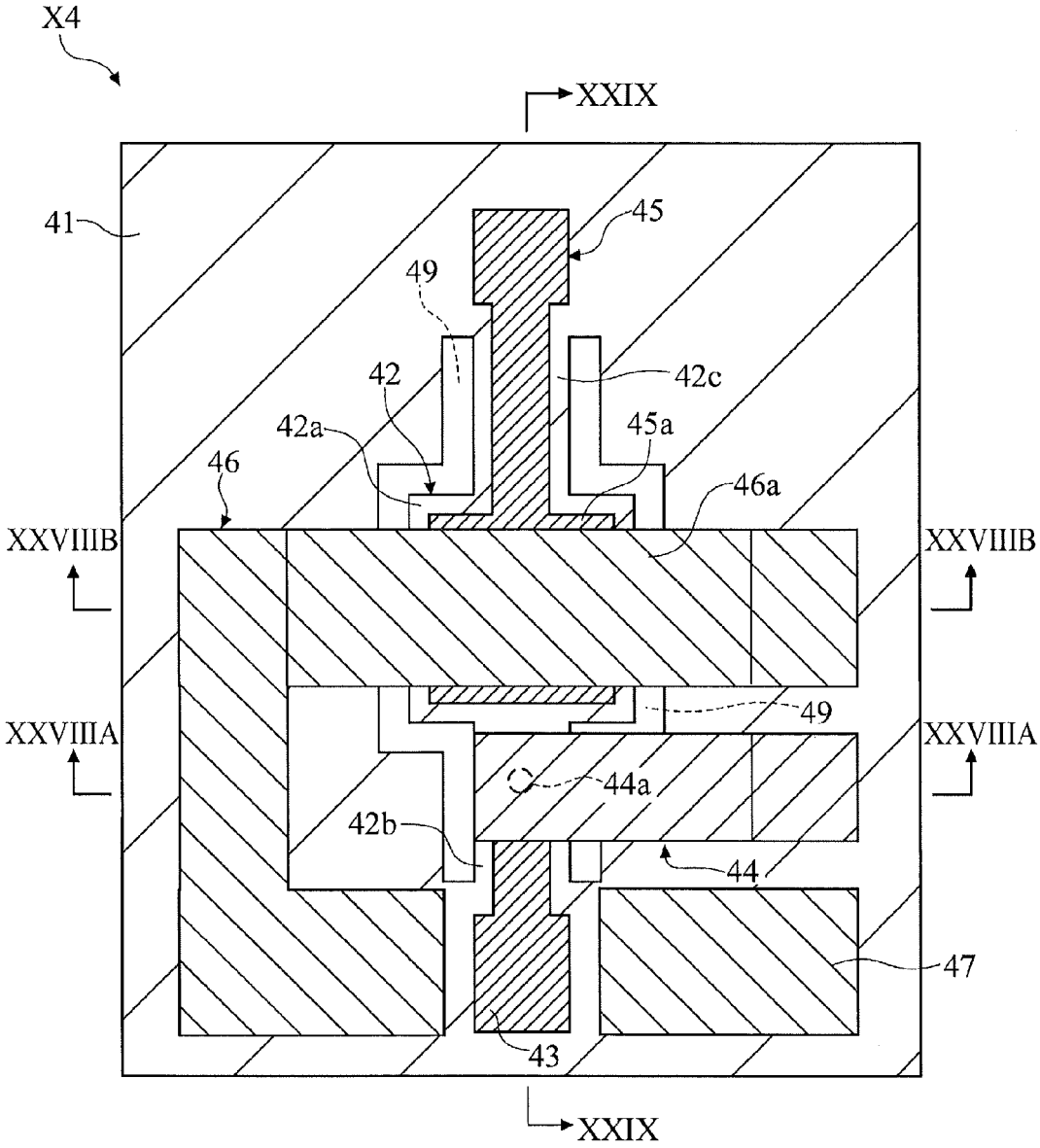
FIG. 26 is a plan view of a switching device according to an embodiment of the present invention.
Figure 27:
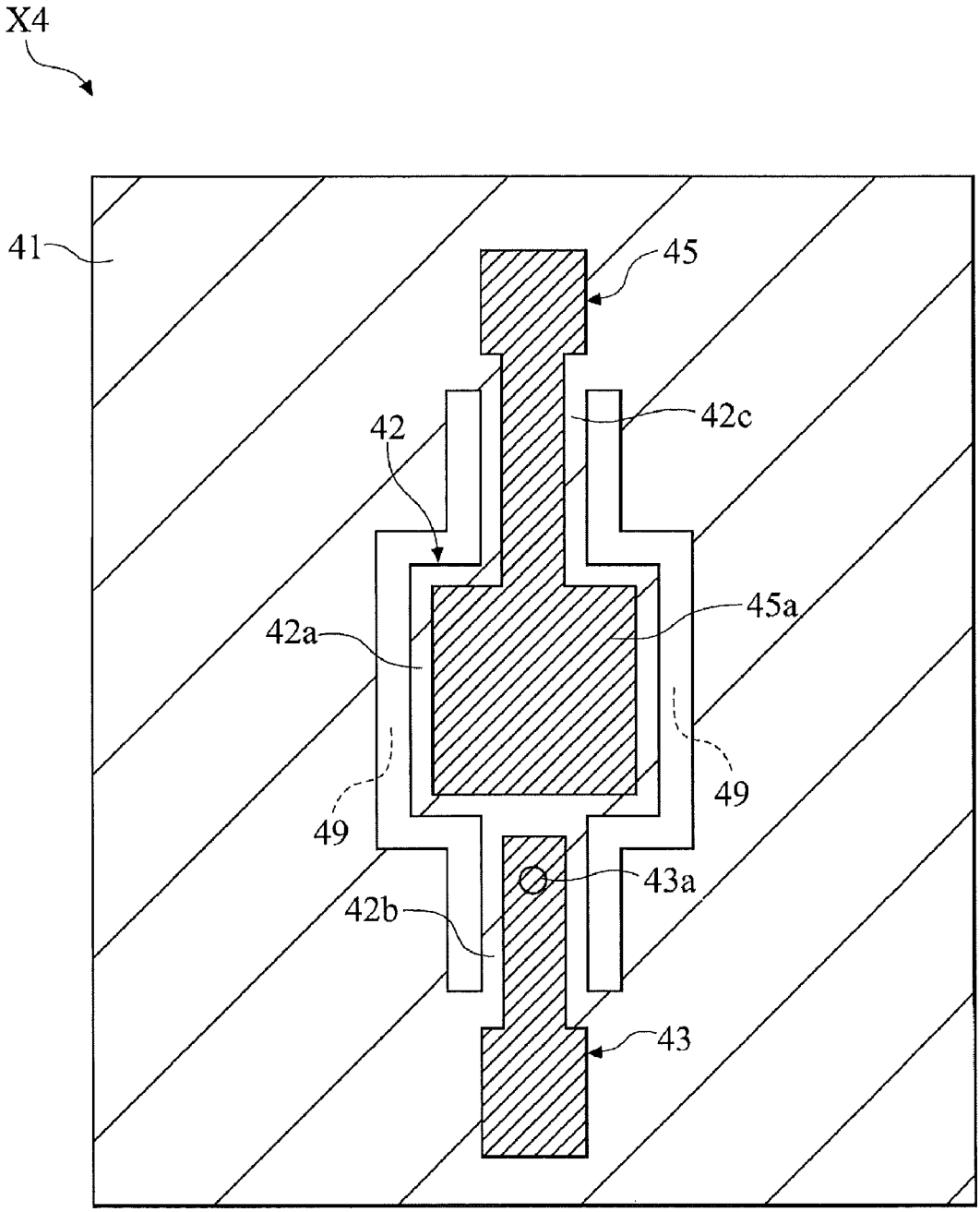
FIG. 27 is a plan view, partly omitted, of the switching device illustrated in FIG. 26.
Figure 28A:
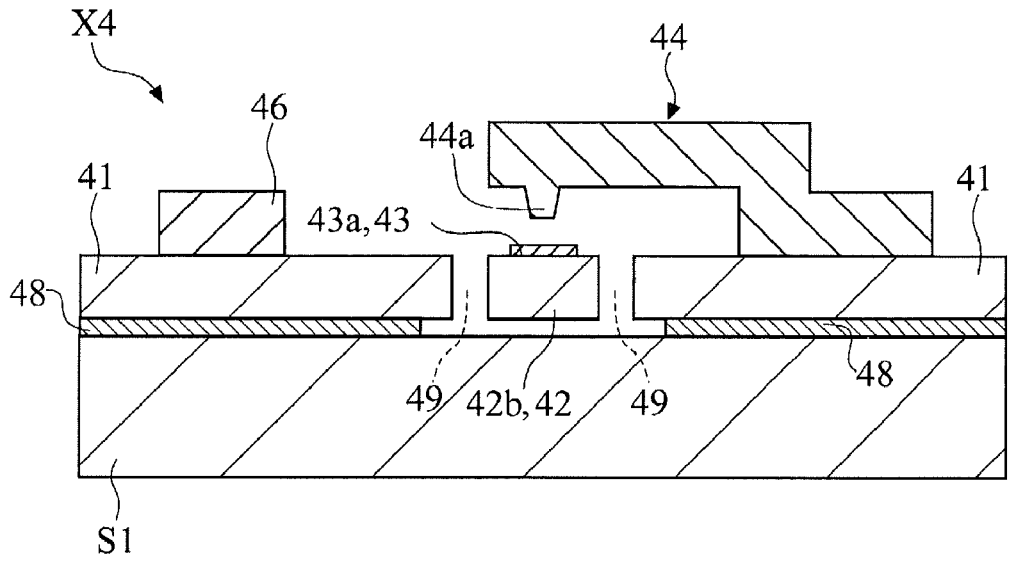
FIG. 28A is a sectional view taken along a line XXVIIIA-XXVIIIA in FIG. 26.
Figure 28B:
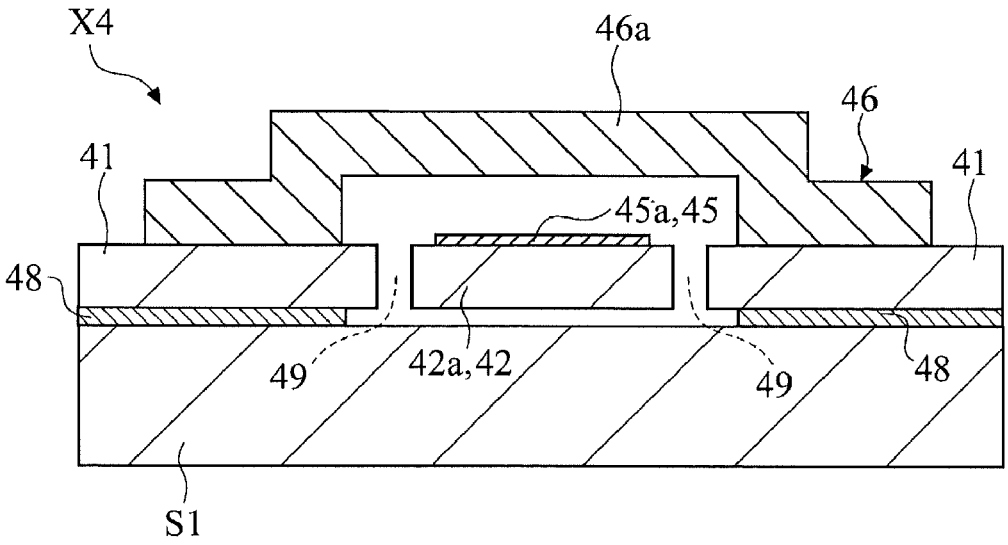
FIG. 28B is a sectional view taken along a line XXVIIIB-XXVIIIB in FIG. 26.
Figure 29:
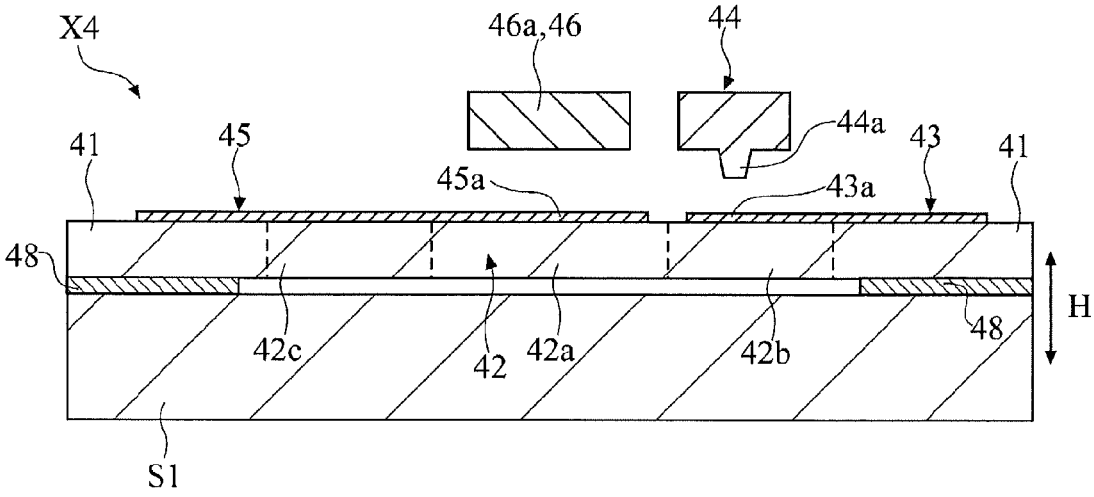
FIG. 29 is a sectional view taken along a line XXIX-XXIX in FIG. 26.

FIGS. 26, 27, 28A, 28B and 29 illustrate a switching device X4 according to an embodiment of the present invention. FIG. 26 is a plan view of the switching device X4. FIG. 27 is a plan view, partly omitted, of the switching device X4. FIGS. 28A, 28B and 29 are sectional views taken along lines XXVIIIA-XXVIIIA, XXVIIIB-XXVIIIB and XXIX-XXIX in FIG. 26, respectively.

The switching device X4 includes a substrate S1, a stationary portion 41, a movable portion 42, a signal line 43, a signal line 44 (omitted in FIG. 27), a driving line 45, a driving line 46 (omitted in FIG. 27), and a ground line 47. As illustrated in FIGS. 28A and 28B, the stationary portion 41 is joined to the substrate S1 through a boundary layer 48. As illustrated in FIGS. 26 and 27, the movable portion 42 has a movable land portion 42*a* and beam portions 42*b* and 42*c*, and it is surrounded by the stationary portion 41 with a slit 49 interposed therebetween. The beam portions 42*b* and 42*c* are oppositely extended in one direction and are spaced from each other in the extending direction with the movable land portion 42*a* disposed therebetween. Further, each of the beam portions 42*b* and 42*c* couples the movable land portion 42*a* and the stationary portion 41 with each other. In other words, the movable portion 42 is supported by the stationary portion 41 in a both-end supported structure. As most clearly illustrated in FIG. 27, the signal line 43 is disposed to extend over the beam portion 42*b* of the movable portion 42 and the stationary portion 41. Also, the signal line 43 has, on the beam portion 42*b*, a contact portion 43*a* capable of contacting the signal line 44. Further, the signal line 43 is connected to a predetermined circuit, which is a switching target, through predetermined wiring (not shown). As illustrated in FIG. 28A, the signal line 44 is formed in a shape protruding upwards from the stationary portion 41 and has a region positioned to face the signal line 43. The signal line 44 includes, in its region positioned to face the signal line 43, a projected portion or a contact portion 44*a* extending toward the signal line 43. Further, the signal line 44 is connected to a predetermined circuit, which is a switching target, through predetermined wiring (not shown). As most clearly illustrated in FIG. 27, the driving line 45 is disposed to extend over the movable land portion 42*a*, the beam portion 42*c*, and the stationary portion 41. Also, the driving line 45 has a driving electrode portion 45*a* on the movable land portion 42*a*. As illustrated in FIG. 28B, the driving line 46 is formed in a shape protruding upwards from the stationary portion 41 and straddling over the driving electrode portion 45*a* of the driving line 45. The driving line 46 has a driving electrode portion 46*a* positioned to face the driving electrode portion 45*a*. Further, the driving line 46 has a shape extending along the signal lines 43 and 44 as illustrated in FIG. 26, and is connected to the ground through predetermined wiring (not shown) (hence the driving line 46 serves also as a ground line). The ground line 47 has a shape having sides adjacent to and extending along the signal lines 43 and 44 as illustrated in FIG. 26, and is connected to the ground through predetermined wiring (not shown). Other constructions of the stationary portion 41, the movable portion 42, the signal lines 43 and 44, the driving lines 45 and 46, and the ground line 47 are similar to those described above regarding the stationary portion 11, the movable portion 12, the signal lines 13 and 14, the driving lines 15 and 16, and the ground line 17 in the above-described embodiment. The switching device X4 thus constructed can be manufactured by a method similar to that for manufacturing the switching device X1 according to the above-described embodiment.

In the switching device X4 having the above-described structure, when a driving voltage is applied to the driving line 45, an electrostatic attraction force is generated between the driving electrode portion 45*a* of the driving line 45 and the driving electrode portion 46*a* of the driving line 46 (connected to the ground), and the movable portion 42 is operated or elastically deformed until the contact portion 43*a* of the signal line 43 comes into contact with the contact portion 44*a* of the signal line 44. The closed state of the switching device X4 is thus established. In the closed state, the signal lines 43 and 44 are connected to each other so that a current is allowed to pass between the signal lines 43 and 44. With such a switching-on operation, the on-state of, e.g., a high-frequency signal can be achieved.

On the other hand, when, in the switching device X4 in the closed state, the application of the voltage to the driving line 45 is stopped to extinguish the electrostatic attraction force acting between the driving electrode portions 45*a* and 46*a*, the movable portion 42 returns to its natural state and the signal line 43, specifically the contact portion 43*a*, moves away from the signal line 44, specifically from the contact portion 44*a*. The open state of the switching device X4 is thus established. In the open state, the signal lines 43 and 44 are electrically separated from each other, whereby a current is prevented from passing between the signal lines 43 and 44. With such a switching-off operation, the off-state of, e.g., a high-frequency signal can be achieved.

In the switching device X4, the signal line 43 is disposed to extend over the beam portion 42*b* and the stationary portion 41, and has the contact portion 43*a* on the beam portion 42*b*. The signal line 44 has the contact portion 44*a* positioned to face the contact portion 43*a* and is fixed to the stationary portion 41. Passage and non-passage of, e.g., a high-frequency signal between the signal lines 43 and 44 are selected respectively by closing and opening between the contact portions 43*a* and 44*a*. Stated another way, the switching device X4 includes a single opening/closing point (single contact). The switching device X4 thus constructed is less susceptible to the sticking failure that has been described above in connection with the known switching device Z2. Accordingly, the switching device X4 is suitable for realizing a long contact opening/closing life.

In the switching device X4, the driving line 45 is disposed to extend over the movable land portion 42*a*, the beam portion 42*c*, and the stationary portion 41, and has the driving electrode portion 45*a* on the movable land portion 42*a*. The driving line 46 has the driving electrode portion 46*a* positioned to face the driving electrode portion 45*a* and is fixed to the stationary portion 41. With the driving voltage applied between the driving electrode portions 45*a* and 46*a*, an electrostatic attraction force is generated between the driving electrode portions 45*a* and 46*a* so that the movable land portion 42*a* to which the driving electrode portion 45*a* is joined is operated or elastically deformed toward the driving electrode portion 46*a*. The driving line 45 is disposed separately from the signal line 43 (namely, the driving line 45 is routed from the movable land portion 42*a* to the stationary portion 41 while passing the beam portion 42*c* differing from the beam portion 42*b* on which the signal line 43 is disposed). Also, the driving line 46 is disposed separately from the signal line 44. Stated another way, in the switching device X4, the signal lines 43 and 44 are electrically separated from the driving lines 45 and 46. The switching device X4 thus constructed is less susceptible to the signal leakage from the signal line to the driving line, which has been described above in connection with the known switching device Z1. Accordingly, the switching device X4 is suitable for not only reducing an insertion loss, but also obtaining a superior high-frequency characteristic.

In the switching device X4, as illustrated in the plan view of FIG. 26, a signal path constituted by the signal lines 43 and 44 is disposed between the driving line 46 (ground line) and the ground line 47, and the driving line 46 and the ground line 47 have shapes extending along the signal path. In other words, the signal path (i.e., the signal lines 43 and 44) and two ground lines (i.e., the driving line 46 and the ground line 47) constitute coplanar passages. Using the coplanar passages is preferable including in suppressing the signal leakage from the signal lines 43 and 44.

In the switching device X4, the distance of spacing between the contact portions 43*a* and 44*a* and the distance of spacing between the driving electrode portions 45*a* and 46*a* in the not-driven state are easier to accurately control. The reason is that, in the not-driven state, the movable portion 42 supported to the stationary portion 41 in the both-end supported structure is less apt to improperly displace in a direction H of thickness, denoted in FIG. 29. The signal line 43 in the switching device X4 can be formed in a similar manner to that for forming the signal line 13 in the above-described embodiment. In the signal line 43 thus formed, there may occur internal stress acting in the direction of contraction. The driving line 45 can be formed in a similar manner to that for forming the driving line 15 in the above-described embodiment. In the driving line 45 thus formed, there may occur internal stress acting in the direction of contraction. The internal stresses occurred in the signal line 43 and the driving line 45 act on the movable portion 42 as forces causing the movable portion 42 to deform such that the movable land portion 42*a* comes closer toward the signal line 44 and the driving line 46. However, the movable portion 42 supported to the stationary portion 41 in the both-end supported structure is more resistant against those deformation forces. As a result, in the not-driven state, the movable portion 42 is less apt to improperly displace in the direction H of thickness, denoted in FIG. 29.

In the switching device X4, the signal lines 43 and 44 are disposed such that the signal path (i.e., the signal lines 43 and 44) is bent on the movable land portion 42 and the beam portion 42*b*, as appearing in the plan view of FIG. 26. Therefore, the switching device X4 can be more easily designed such that the signal line 43 has a shorter length on the movable land portion than the signal line 13 in the above-described embodiment, and that an area in which the driving electrode portions 45*a* and 46*a* are positioned to face each other is larger than an area in which the driving electrode portions 15*a* and 16*a* in the above-described embodiment are positioned to face each other. The signal line 43 having a smaller thickness is preferably formed to be shorter from the viewpoint of suppressing the signal loss occurred in the signal path (signal lines 43 and 44). Also, the area in which the driving electrode portions 45*a* and 46*a* for generating the electrostatic attraction force (driving force) are positioned to face each other is preferably set to be larger from the viewpoint of reducing the driving voltage. Thus, the switching device X4 has the structure suitable for not only suppressing the signal loss in the signal path, but also reducing the driving voltage.

Similarly to the second modification of the switching device X1, the switching device X4 may include the stopper portion 20 (including the projected portion 20*a*) to prevent the driving electrode portions 45*a* and 46*a* from contacting with each other and short-circuiting when driven. Further, similarly to the fourth modification of the switching device X1 in which the signal line 13 and the driving line 15 partly have the thicker portions 13*a* and 15*a*, respectively, the switching device X4 may be modified such that the signal line 43 and the driving line 45 may partly have thicker portions.

Figure 30:
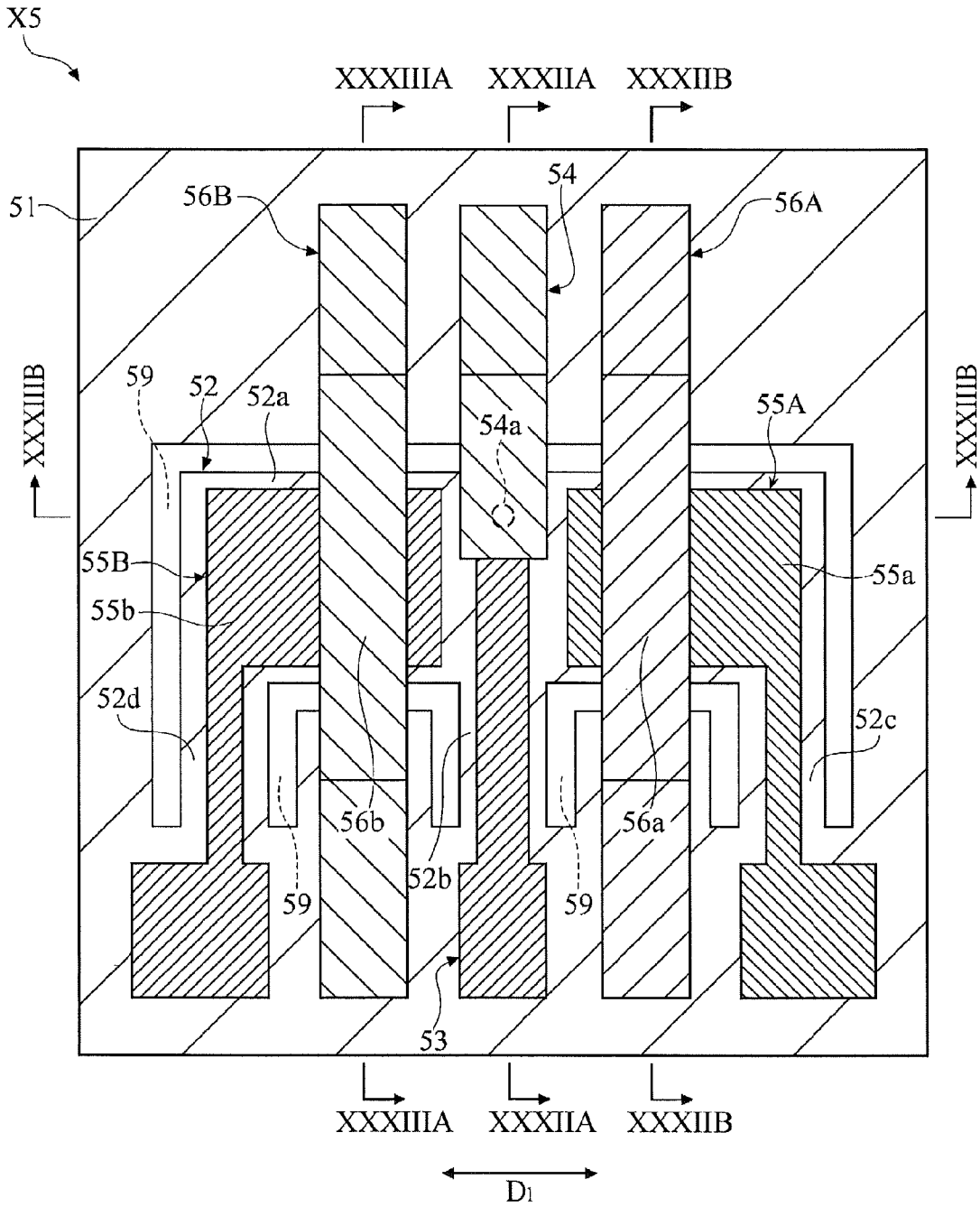
FIG. 30 is a plan view of a switching device according to an embodiment of the present invention.
Figure 31:
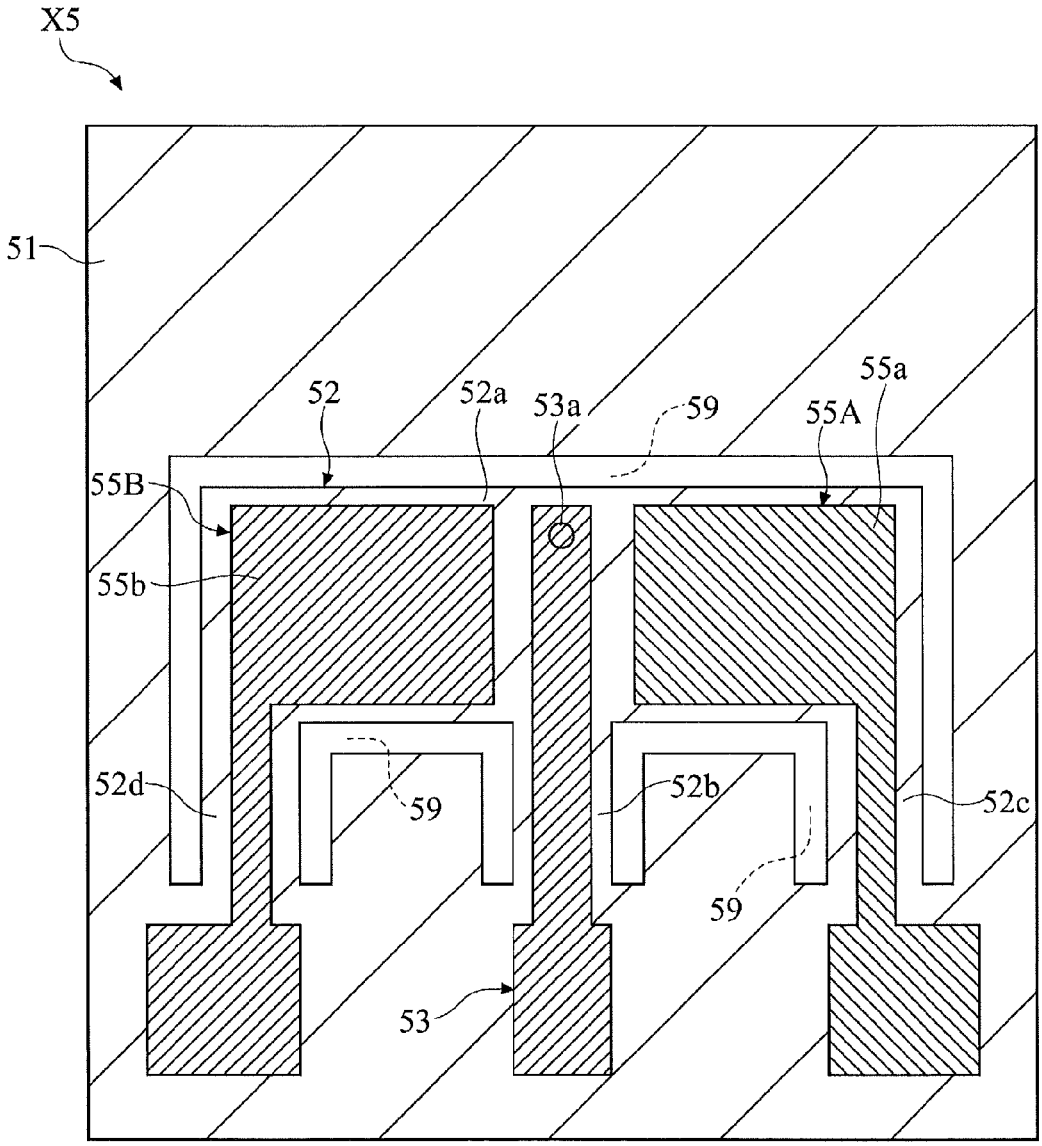
FIG. 31 is a plan view, partly omitted, of the switching device illustrated in FIG. 30.

FIGS. 30, 31, 32A, 32B, 33A and 33B illustrate a switching device X5 according to an embodiment of the present invention. FIG. 30 is a plan view of the switching device X5. FIG. 31 is a plan view, partly omitted, of the switching device X5. FIGS. 32A, 32B, 33A and 33B are sectional views taken along lines) XXXIIA-XXXIIA, XXXIIB-XXXIIB, XXXIIIA-XXXIIIA and XXXIIIB-XXXIIIB in FIG. 30, respectively.

Figure 32A:
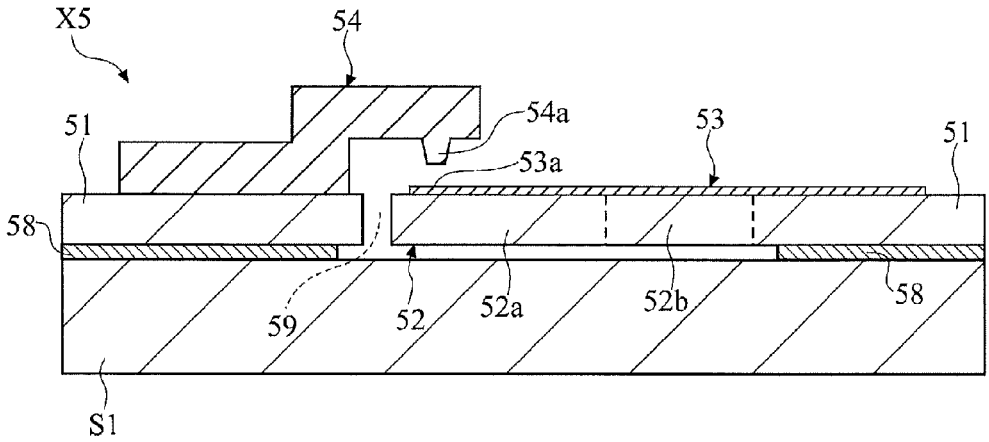
FIG. 32A is a sectional view taken along a line XXXIIA-XXXIIA in FIG. 30.
Figure 32B:
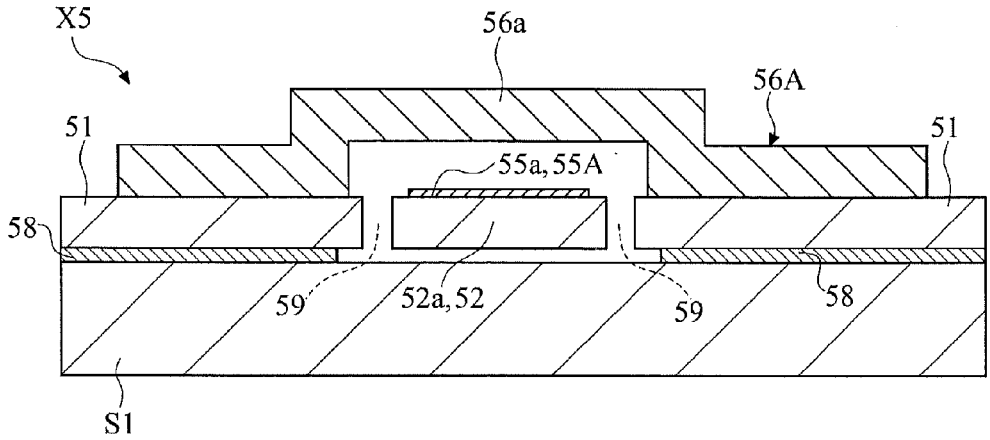
FIG. 32B is a sectional view taken along a line XXXIIB-XXXIIB in FIG. 30.
Figure 33A:
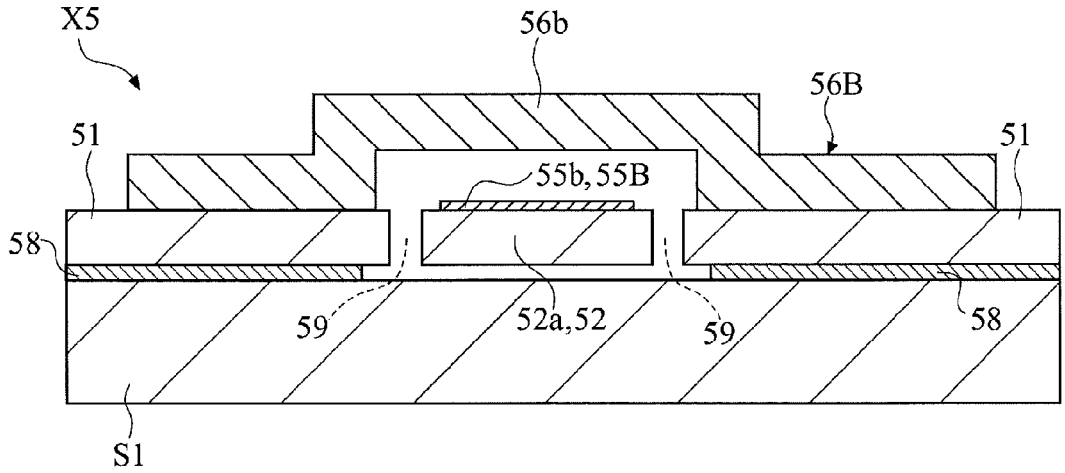
FIG. 33A is a sectional view taken along a line XXXIIIA-XXXIIIA in FIG. 30.

The switching device X5 includes a substrate S1, a stationary portion 51, a movable portion 52, a signal line 53, a signal line 54 (omitted in FIG. 31), driving lines 55A and 55B, and driving lines 56A and 56B (omitted in FIG. 31). As illustrated in FIGS. 32A to 33B, the stationary portion 51 is joined to the substrate S1 through a boundary layer 58. As illustrated in FIGS. 30 and 31, the movable portion 52 has a movable land portion 52*a* and beam portions 52*b*, 52*c* and 52*d*, and it is surrounded by the stationary portion 51 with a slit 59 interposed therebetween. In an embodiment, three beam portions 52*b* to 52*d* each couple the stationary portion 51 and the movable land portion 52*a* with each other, and they are arranged side by side to extend parallel to each other between the stationary portion 51 and the movable land portion 52*a*. In other words, the movable portion 52 is supported by the stationary portion 51 in a cantilevered structure. As most clearly illustrated in FIG. 31, the signal line 53 is disposed to extend over the movable land portion 52*a*, the beam portion 52*b*, and the stationary portion 51. Also, the signal line 53 has, on the movable land portion 52*a*, a contact portion 53*a* capable of contacting the signal line 54. Further, the signal line 53 is connected to a predetermined circuit, which is a switching target, through predetermined wiring (not shown). As illustrated in FIG. 32A, the signal line 54 is formed in a shape protruding upwards from the stationary portion 51 and has a region positioned to face the signal line 53. The signal line 54 includes, in its region positioned to face the signal line 53, a projected portion or a contact portion 54*a* extending toward the signal line 53. Further, the signal line 54 is connected to a predetermined circuit, which is a switching target, through predetermined wiring (not shown). As most clearly illustrated in FIG. 31, the driving line 55A is disposed to extend over the movable land portion 52*a*, the beam portion 52*c*, and the stationary portion 51. Also, the driving line 55A has a driving electrode portion 55*a* on the movable land portion 52*a*. The driving line 55B is disposed to extend over the movable land portion 52*a*, the beam portion 52*d*, and the stationary portion 51. Also, the driving line 55B has a driving electrode portion 55*b* on the movable land portion 52*a*. As illustrated in FIG. 32B, the driving line 56A is formed in a shape protruding upwards from the stationary portion 51 and straddling over the driving electrode portion 55*a* of the driving line 55A. The driving line 56A has a driving electrode portion 56*a* positioned to face the driving electrode portion 55*a*. Further, the driving line 56A has a shape extending along the signal lines 53 and 54 as illustrated in FIG. 30, and is connected to the ground through predetermined wiring (not shown) (hence the driving line 56A serves also as a ground line). As illustrated in FIG. 33A, the driving line 56B is formed in a shape protruding upwards from the stationary portion 51 and straddling over the driving electrode portion 55*b* of the driving line 55B. The driving line 56B has a driving electrode portion 56*b* positioned to face the driving electrode portion 55*b*. Further, the driving line 56B has a shape extending along the signal lines 53 and 54 as illustrated in FIG. 30, and is connected to the ground through predetermined wiring (not shown) (hence the driving line 56B serves also as a ground line). Other constructions of the stationary portion 51, the movable portion 52, the signal lines 53 and 54, and the driving lines 55A, 55B, 56A and 56B are similar to those described above regarding the stationary portion 11, the movable portion 12, the signal lines 13 and 14, and the driving lines 15 and 16 in the above-described embodiment. The switching device X5 thus constructed can be manufactured by a method similar to that for manufacturing the switching device X1 according to the above-described embodiment.

In the switching device X5 having the above-described structure, when a driving voltage is applied to the driving lines 55A and 55B, electrostatic attraction forces are generated between the driving electrode portion 55*a* of the driving line 55A and the driving electrode portion 56*a* of the driving line 56A (connected to the ground) and between the driving electrode portion 55*b* of the driving line 55B and the driving electrode portion 56*b* of the driving line 56B (connected to the ground), whereby the movable portion 52 is operated or elastically deformed until the contact portion 53*a* of the signal line 53 comes into contact with the contact portion 54*a* of the signal line 54. The closed state of the switching device X5 is thus established. In the closed state, the signal lines 53 and 54 are connected to each other so that a current is allowed to pass between the signal lines 53 and 54. With such a switching-on operation, the on-state of, e.g., a high-frequency signal can be achieved.

On the other hand, when, in the switching device X5 in the closed state, the application of the voltage to the driving lines 55A and 55B is stopped to extinguish the electrostatic attraction forces acting between the driving electrode portions 55*a* and 56*a* and between the driving electrode portions 55*b* and 56*b*, the movable portion 52 returns to its natural state and the signal line 53, specifically the contact portion 53*a*, moves away from the signal line 54, specifically from the contact portion 54*a*. The open state of the switching device X5 is thus established. In the open state, the signal lines 53 and 54 are electrically separated from each other, whereby a current is prevented from passing between the signal lines 53 and 54. With such a switching-off operation, the off-state of, e.g., a high-frequency signal can be achieved.

In the switching device X5, the signal line 53 is disposed to extend over the movable land portion 52*a*, the beam portion 52*b*, and the stationary portion 51, and has the contact portion 53*a* on the movable portion 52, specifically on the movable land portion 52*a*. The signal line 54 has the contact portion 54*a* positioned to face the contact portion 53*a* and is fixed to the stationary portion 51. Passage and non-passage of, e.g., a high-frequency signal between the signal lines 53 and 54 are selected respectively by closing and opening between the contact portions 53*a* and 54*a*. Stated another way, the switching device X5 includes a single opening/closing point (single contact). The switching device X5 thus constructed is less susceptible to the sticking failure that has been described above in connection with the known switching device Z2. Accordingly, the switching device X5 is suitable for realizing a long contact opening/closing life.

In the switching device X5, the driving line 55A is disposed to extend over the movable land portion 52*a*, the beam portion 52*c*, and the stationary portion 51, and has the driving electrode portion 55*a* on the movable land portion 52*a*. The driving line 55B is disposed to extend over the movable land portion 52*a*, the beam portion 52*d*, and the stationary portion 51, and has the driving electrode portion 55*b* on the movable land portion 52*a*. The driving line 56A has the driving electrode portion 56*a* positioned to face the driving electrode portion 55*a*, and the driving line 56B has the driving electrode portion 56*b* positioned to face the driving electrode portion 55*b*. With the driving voltage applied between the driving electrode portions 55*a* and 56*a* and between the driving electrode portions 55*b* and 56*b*, electrostatic attraction forces are generated between the driving electrode portions 55*a* and 56*a* and between the driving electrode portions 55*b* and 56*b* so that the movable land portion 52*a* to which the driving electrode portions 55*a* and 55*b* are joined is operated or elastically deformed toward the driving electrode portions 56*a* and 56*b*. The driving lines 55A and 55B are disposed separately from the signal line 53 (namely, the driving lines 55A and 55B are routed from the movable land portion 52*a* to the stationary portion 51 while passing respectively the beam portions 52*c* and 52*d* differing from the beam portion 52*b* over which the signal line 53 passes). Also, the driving lines 56A and 56B are disposed separately from the signal line 54. Stated another way, in the switching device X5, the signal lines 53 and 54 are electrically separated from the driving lines 55A, 55B, 56A and 56B. The switching device X5 thus constructed is less susceptible to the signal leakage from the signal line to the driving line, which has been described above in connection with the known switching device Z1. Accordingly, the switching device X5 is suitable for not only reducing an insertion loss, but also obtaining a superior high-frequency characteristic.

Figure 33B:
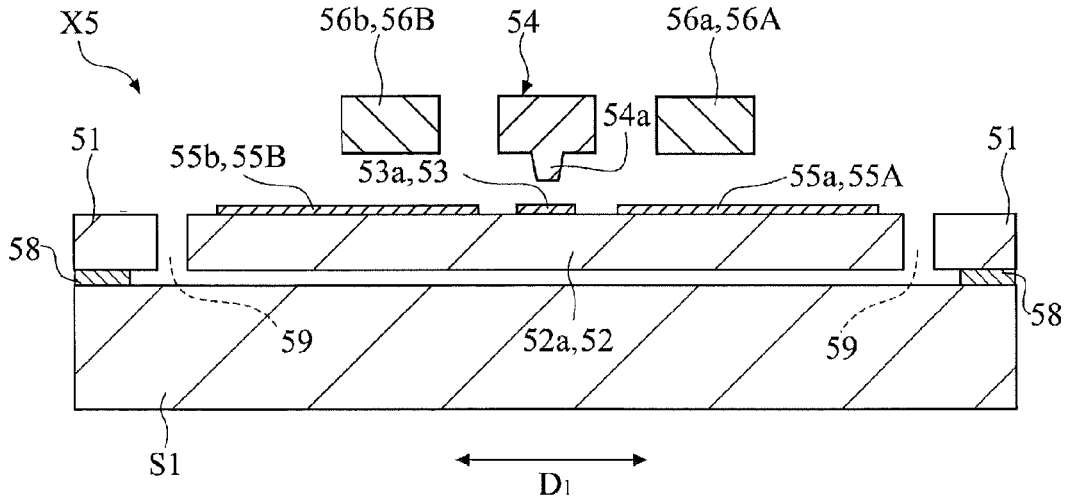
FIG. 33B is a sectional view taken along a line XXXIIIB-XXXIIIB in FIG. 30.

In the switching device X5, the electrostatic attraction force (driving force) can be generated between the driving electrode portions 55*a* and 56*a*, and the electrostatic attraction force (driving force) can be generated between the driving electrode portions 55*b* and 56*b* as well. Locations where those driving forces are generated are spaced from each other in a direction denoted by an arrow $D_1$ in FIGS. 30 and 33B. Further, in the switching device X5, the contact portions 53*a* and 54*a* (opening/closing point) are positioned, as illustrated in FIG. 33B, between the two locations where the driving forces are generated, in a direction in which those two driving-force generated locations are spaced from each (i.e., in the direction denoted by the arrow $D_1$). In the driven state of the switching device X5, therefore, after the contact portions 53*a* and 54*a* have been brought into contact with each other, uniform loads can be more easily applied to the contact point formed by the contact portions 53*a* and 54*a* from both sides of the contact point. As a result, stable contact can be more easily realized at the contact point.

In the switching device X5, as illustrated in the plan view of FIG. 30, a signal path constituted by the signal lines 53 and 54 is disposed between the driving lines 56A and 56B (both being ground lines), and the driving lines 56A and 56B have shapes extending along the signal path. In other words, the signal path (i.e., the signal lines 53 and 54) and two ground lines (i.e., the driving line 56A and 56B) constitute coplanar passages. Using the coplanar passages is preferable including in suppressing the signal leakage from the signal lines 53 and 54.

In the switching device X5, similarly to the arrangement described above in the first modification of the switching device X1 regarding the signal line 13 and the driving lines 15 on the movable portion 12, the driving lines 55A and 55B on the movable portion 52 are preferably arranged in a symmetrical pattern shape. Similarly to the second modification of the switching device X1, the switching device X5 may include the stopper portion 20 (including the projected portion 20*a*) to prevent the driving electrode portions 55*a* and 56*a* and the driving electrode portions 55*b* and 56*b* from contacting with each other and short-circuiting when driven. Similarly to the third modification of the switching device X1 in which the signal lines 13 and 14 have the contact portions 13*a* and 14*a* on the beam portion 12*b*, the switching device X5 may be modified such that the contact portions 53*a* and 54*a* of the signal lines 53 and 54 are positioned on the beam portion 52*b*. Further, similarly to the fourth modification of the switching device X1 in which the signal line 13 and the driving line 15 partly have the thicker portions 13*a* and 15*a*, respectively, the switching device X5 may be modified such that the signal line 53 and the driving lines 55A and 55B may partly have thicker portions.

Figure 34:
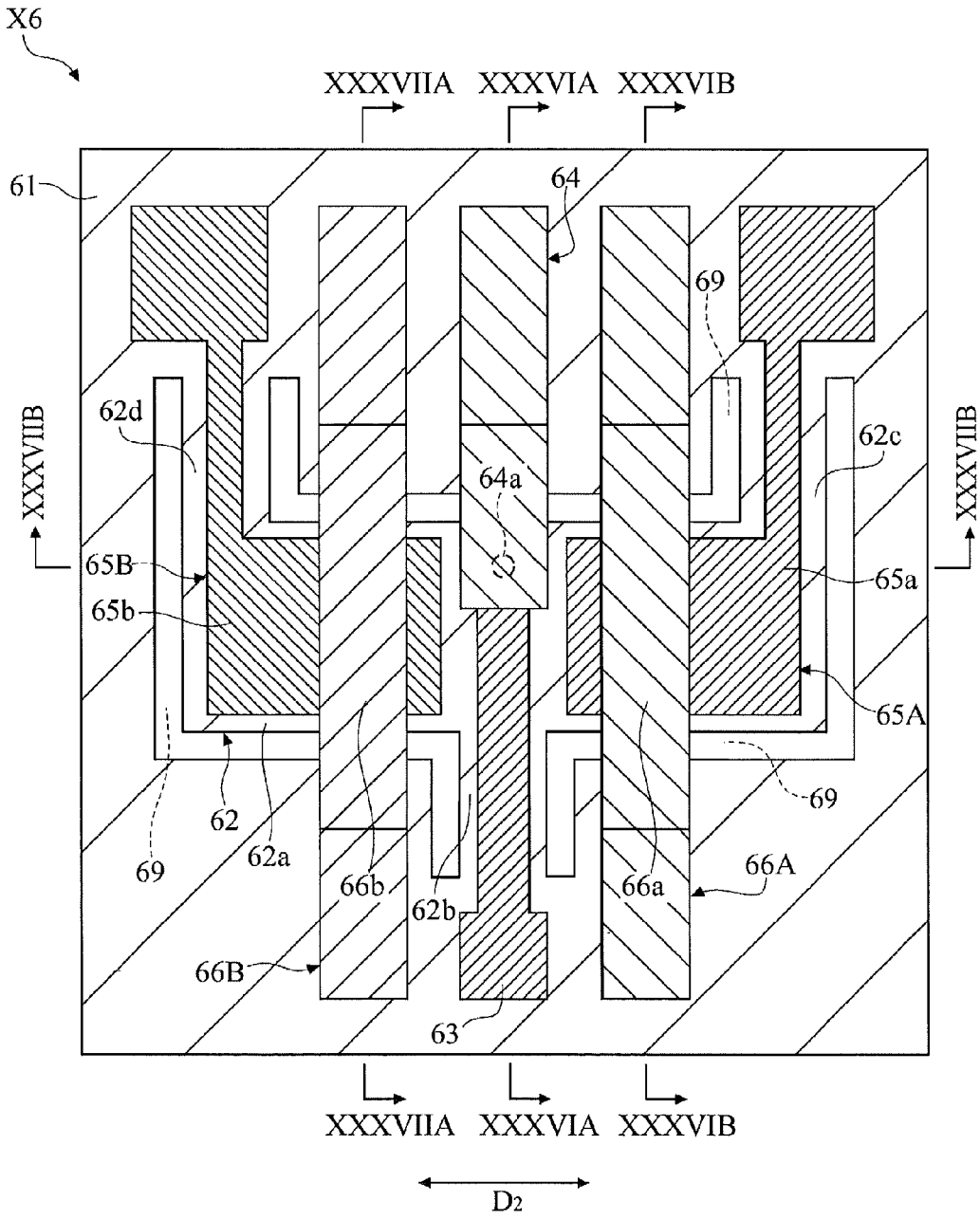
FIG. 34 is a plan view of a switching device according to an embodiment of the present invention.
Figure 35:
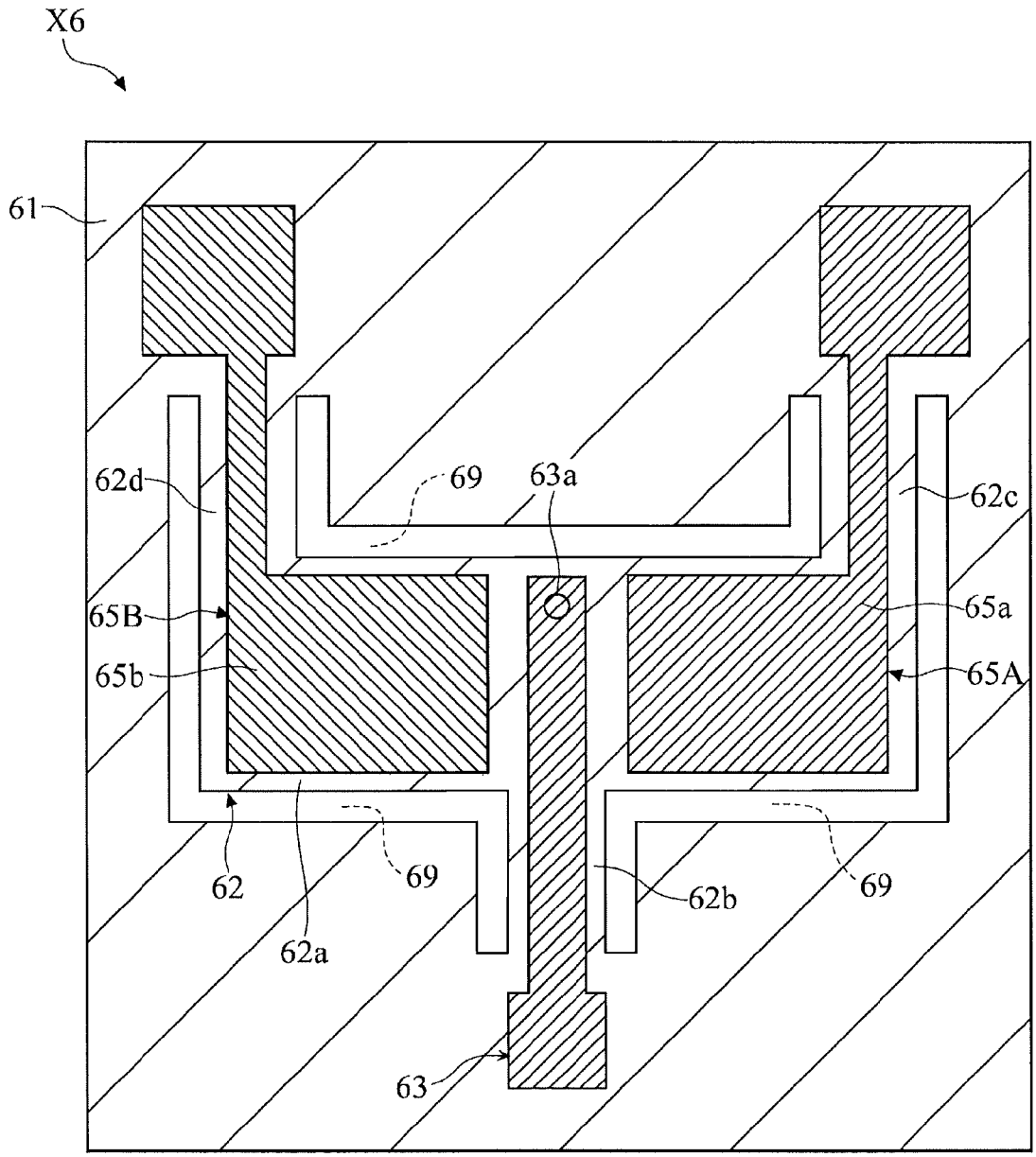
FIG. 35 is a plan view, partly omitted, of the switching device illustrated in FIG. 34.

FIGS. 34, 35, 36A, 36B, 37A and 37B illustrate a switching device X6 according to an embodiment of the present invention. FIG. 34 is a plan view of the switching device X6. FIG. 35 is a plan view, partly omitted, of the switching device X6. FIGS. 36A, 36B, 37A and 37B are sectional views taken along lines) XXXVIA-XXXVIA, XXXVIB-XXXVIB, XXXVIIA-XXXVIIA and XXXVIIB-XXXVIIB in FIG. 34, respectively.

The switching device X6 includes a substrate S1, a stationary portion 61, a movable portion 62, a signal line 63, a signal line 64 (omitted in FIG. 35), driving lines 65A and 65B, and driving lines 66A and 66B (omitted in FIG. 35). As illustrated in FIGS. 36A to 37B, the stationary portion 61 is joined to the substrate S1 through a boundary layer 68. As illustrated in FIGS. 34 and 35, the movable portion 62 has a movable land portion 62*a* and beam portions 62*b*, 62*c* and 62*d*, and it is surrounded by the stationary portion 61 with a slit 69 interposed therebetween. In an embodiment, the beam portions 62*c* and 62*d* each couple the stationary portion 61 and the movable land portion 62*a* with each other, and they are arranged side by side to extend parallel to each other between the stationary portion 61 and the movable land portion 62*a*. Further, the beam portion 62*b* couples the stationary portion 61 and the movable land portion 62*a* with each other on the side opposite to the beam portions 62*c* and 62*d*. In other words, the movable portion 62 is supported by the stationary portion 61 in a both-end supported structure.

Figure 36A:
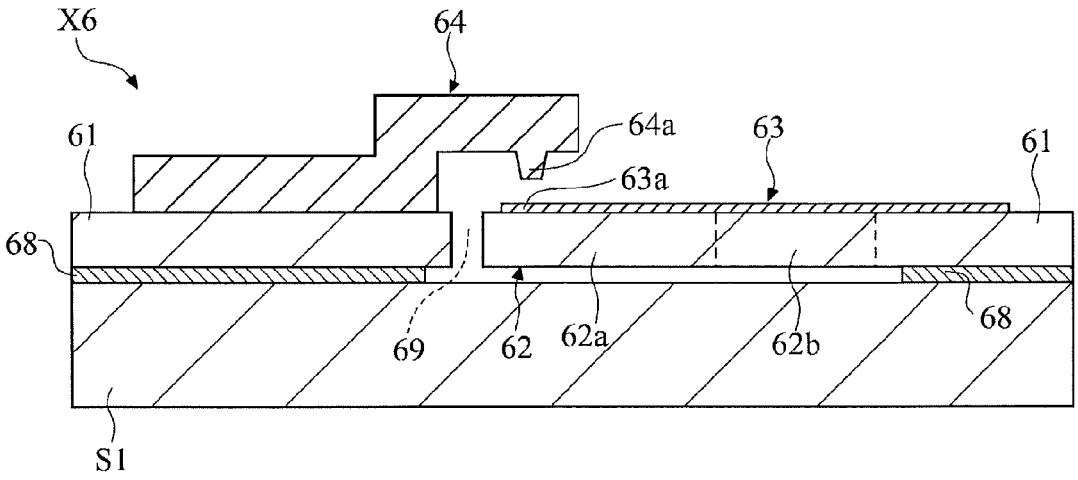
FIG. 36A is a sectional view taken along a line XXXVIA-XXXVIA in FIG. 34.

As most clearly illustrated in FIG. 35, the signal line 63 is disposed to extend over the movable land portion 62*a*, the beam portion 62*b*, and the stationary portion 61. Also, the signal line 63 has, on the movable land portion 62*a*, a contact portion 63*a* capable of contacting the signal line 64. Further, the signal line 63 is connected to a predetermined circuit, which is a switching target, through predetermined wiring (not shown). As illustrated in FIG. 36A, the signal line 64 is formed in a shape protruding upwards from the stationary portion 61 and has a region positioned to face the signal line 63. The signal line 64 includes, in its region positioned to face the signal line 63, a projected portion or a contact portion 64*a* extending toward the signal line 63. Further, the signal line 64 is connected to a predetermined circuit, which is a switching target, through predetermined wiring (not shown). As most clearly illustrated in FIG. 35, the driving line 65A is disposed to extend over the movable land portion 62*a*, the beam portion 62*c*, and the stationary portion 61. Also, the driving line 65A has a driving electrode portion 65*a* on the movable land portion 62*a*. The driving line 65B is disposed to extend over the movable land portion 62*a*, the beam portion 62*d*, and the stationary portion 61. Also, the driving line 65B has a driving electrode portion 65*b* on the movable land portion 62*a*.

Figure 36B:
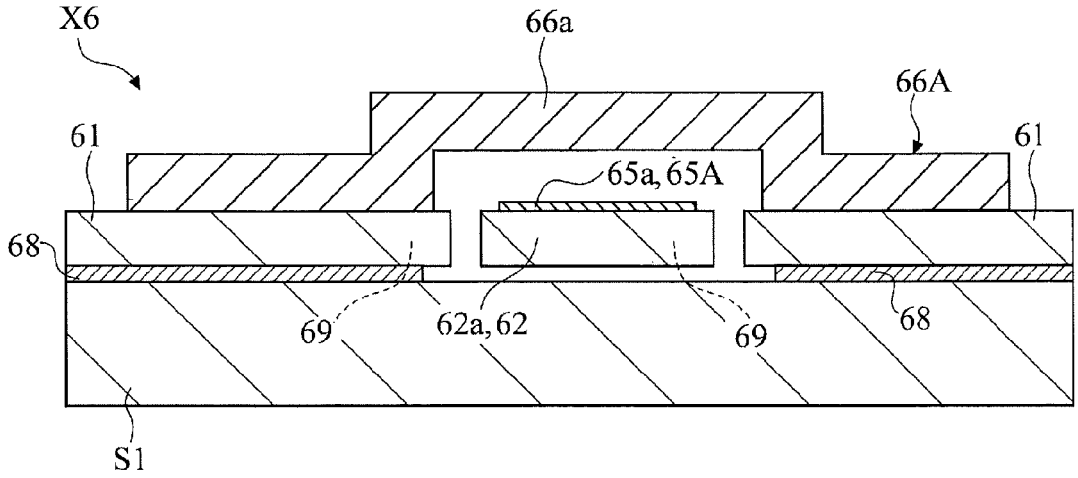
FIG. 36B is a sectional view taken along a line XXXVIB-XXXVIB in FIG. 34.
Figure 37A:
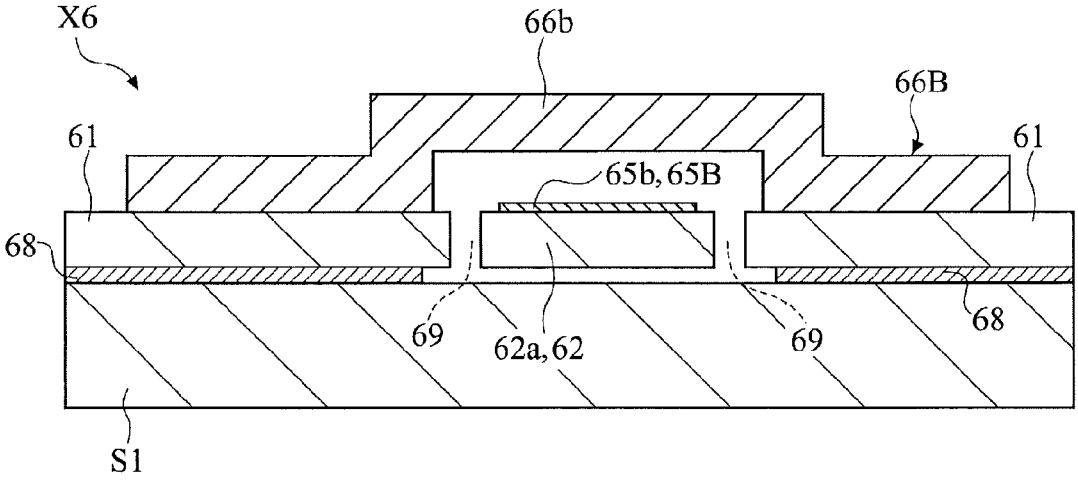
FIG. 37A is a sectional view taken along a line XXXVIIA-XXXVIIA in FIG. 34.

As illustrated in FIG. 36B, the driving line 66A is formed in a shape protruding upwards from the stationary portion 61 and straddling over the driving electrode portion 65*a* of the driving line 65A. The driving line 66A has a driving electrode portion 66*a* positioned to face the driving electrode portion 65*a*. Further, the driving line 66A has a shape extending along the signal lines 63 and 64 as illustrated in FIG. 34, and is connected to the ground through predetermined wiring (not shown) (hence the driving line 66A serves also as a ground line). As illustrated in FIG. 37A, the driving line 66B is formed in a shape protruding upwards from the stationary portion 61 and straddling over the driving electrode portion 65*b* of the driving line 65B. The driving line 56B has a driving electrode portion 56*a* positioned to face the driving electrode portion 55*b*. Further, the driving line 66B has a shape extending along the signal lines 63 and 64 as illustrated in FIG. 34, and is connected to the ground through predetermined wiring (not shown) (hence the driving line 66B serves also as a ground line). Other constructions of the stationary portion 61, the movable portion 62, the signal lines 63 and 64, and the driving lines 65A, 65B, 66A and 66B are similar to those described above regarding the stationary portion 11, the movable portion 12, the signal lines 13 and 14, and the driving lines 15 and 16 in the above-described embodiment. The switching device X6 thus constructed can be manufactured by a method similar to that for manufacturing the switching device X1 according to the above-described embodiment.

In the switching device X6 having the above-described structure, when a driving voltage is applied to the driving lines 65A and 65B, electrostatic attraction forces are generated between the driving electrode portion 65*a* of the driving line 65A and the driving electrode portion 66*a* of the driving line 66A (connected to the ground) and between the driving electrode portion 65*b* of the driving line 65B and the driving electrode portion 66*b* of the driving line 66B (connected to the ground), whereby the movable portion 62 is operated or elastically deformed until the contact portion 63*a* of the signal line 63 comes into contact with the contact portion 64*a* of the signal line 64. The closed state of the switching device X6 is thus established. In the closed state, the signal lines 63 and 64 are connected to each other so that a current is allowed to pass between the signal lines 63 and 64. With such a switching-on operation, the on-state of, e.g., a high-frequency signal can be achieved.

On the other hand, when, in the switching device X6 in the closed state, the application of the voltage to the driving lines 65A and 65B is stopped to extinguish the electrostatic attraction forces acting between the driving electrode portions 65*a* and 66*a* and between the driving electrode portions 65*b* and 66*b*, the movable portion 62 returns to its natural state and the signal line 63, specifically the contact portion 63*a*, moves away from the signal line 64, specifically from the contact portion 64*a*. The open state of the switching device X6 is thus established. In the open state, the signal lines 63 and 64 are electrically separated from each other, whereby a current is prevented from passing between the signal lines 63 and 64. With such a switching-off operation, the off-state of, e.g., a high-frequency signal can be achieved.

In the switching device X6, the signal line 63 is disposed to extend over the movable land portion 62*a*, the beam portion 62*b*, and the stationary portion 61, and has the contact portion 63*a* on the movable portion 62, specifically on the movable land portion 62*a*. The signal line 64 has the contact portion 64*a* positioned to face the contact portion 63*a* and is fixed to the stationary portion 61. Passage and non-passage of, e.g., a high-frequency signal between the signal lines 63 and 64 are selected respectively by closing and opening between the contact portions 63*a* and 64*a*. Stated another way, the switching device X6 includes a single opening/closing point (single contact). The switching device X6 thus constructed is less susceptible to the sticking failure that has been described above in connection with the known switching device Z2. Accordingly, the switching device X6 is suitable for realizing a long contact opening/closing life.

In the switching device X6, the driving line 65A is disposed to extend over the movable land portion 62*a*, the beam portion 62*c*, and the stationary portion 61, and has the driving electrode portion 65*a* on the movable land portion 62*a*. The driving line 65B is disposed to extend over the movable land portion 62*a*, the beam portion 62*d*, and the stationary portion 61, and has the driving electrode portion 65*b* on the movable land portion 62*a*. The driving line 66A has the driving electrode portion 66*a* positioned to face the driving electrode portion 65*a*, and the driving line 66B has the driving electrode portion 66*b* positioned to face the driving electrode portion 65*b*. With the driving voltage applied between the driving electrode portions 65*a* and 66*a* and between the driving electrode portions 65*b* and 66*b*, electrostatic attraction forces are generated between the driving electrode portions 65*a* and 66*a* and between the driving electrode portions 65*b* and 66*b* so that the movable land portion 62*a* to which the driving electrode portions 65*a* and 65*b* are joined is operated or elastically deformed toward the driving electrode portions 66*a* and 66*b*.

The driving lines 65A and 65B are disposed separately from the signal line 63 (namely, the driving lines 65A and 65B are routed from the movable land portion 62*a* to the stationary portion 61 while passing respectively the beam portions 62*c* and 62*d* differing from the beam portion 62*b* on which the signal line 63 passes). Also, the driving lines 66A and 66B are disposed separately from the signal line 64. Stated another way, in the switching device X6, the signal lines 63 and 64 are electrically separated from the driving lines 65A, 65B, 66A and 66B. The switching device X6 thus constructed is less susceptible to the signal leakage from the signal line to the driving line, which has been described above in connection with the known switching device Z1. Accordingly, the switching device X6 is suitable for not only reducing an insertion loss, but also obtaining a superior high-frequency characteristic.

Figure 37B:
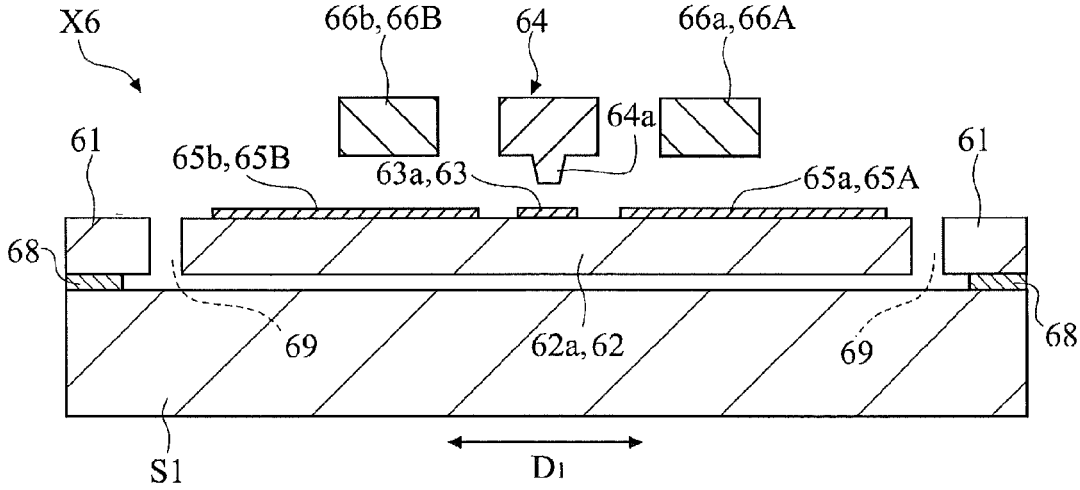
FIG. 37B is a sectional view taken along a line XXXVIIB-XXXVIIB in FIG. 34.

In the switching device X6, the electrostatic attraction force (driving force) can be generated between the driving electrode portions 65*a* and 66*a*, and the electrostatic attraction force (driving force) can be generated between the driving electrode portions 65*b* and 66*b* as well. Locations where those driving forces are generated are spaced from each other in a direction denoted by an arrow $D_2$ in FIGS. 34 and 37B. Further, in the switching device X6, the contact portions 63*a* and 64*a* (opening/closing point) are positioned, as illustrated in FIG. 37B, between the two locations where the driving forces are generated, in a direction in which those two driving-force generated locations are spaced from each (i.e., in the direction denoted by the arrow $D_2$). In the driven state of the switching device X6, therefore, after the contact portions 63*a* and 64*a* have been brought into contact with each other, uniform loads can be more easily applied to the contact point formed by the contact portions 63*a* and 64*a* from both sides of the contact point. As a result, stable contact can be more easily realized at the contact point.

In the switching device X6, as illustrated in the plan view of FIG. 34, a signal path constituted by the signal lines 63 and 64 is disposed between the driving lines 66A and 66B (both being ground lines), and the driving lines 66A and 66B have shapes extending along the signal path. In other words, the signal path (i.e., the signal lines 63 and 64) and two ground lines (i.e., the driving line 66A and 66B) constitute coplanar passages. Using the coplanar passages is preferable including in suppressing the signal leakage from the signal lines 63 and 64.

In the switching device X6, similarly to the arrangement described above in the first modification of the switching device X1 regarding the signal line 13 and the driving lines 15 on the movable portion 12, the driving lines 65A and 65B on the movable portion 62 are preferably arranged in a symmetrical pattern shape. Similarly to the second modification of the switching device X1, the switching device X6 may include the stopper portion 20 (including the projected portion 20*a*) to prevent the driving electrode portions 65*a* and 66*a* and the driving electrode portions 65*b* and 66*b* from contacting with each other and short-circuiting when driven. Similarly to the third modification of the switching device X1 in which the signal lines 13 and 14 have the contact portions 13*a* and 14*a* on the beam portion 12*b*, the switching device X6 may be modified such that the contact portions 63*a* and 64*a* of the signal lines 63 and 64 are positioned on the beam portion 62*b*. Further, similarly to the fourth modification of the switching device X1 in which the signal line 13 and the driving line 15 partly have the thicker portions 13*a* and 15*a*, respectively, the switching device X6 may be modified such that the signal line 63 and the driving lines 65A and 65B may partly have thicker portions.

Figure 38:
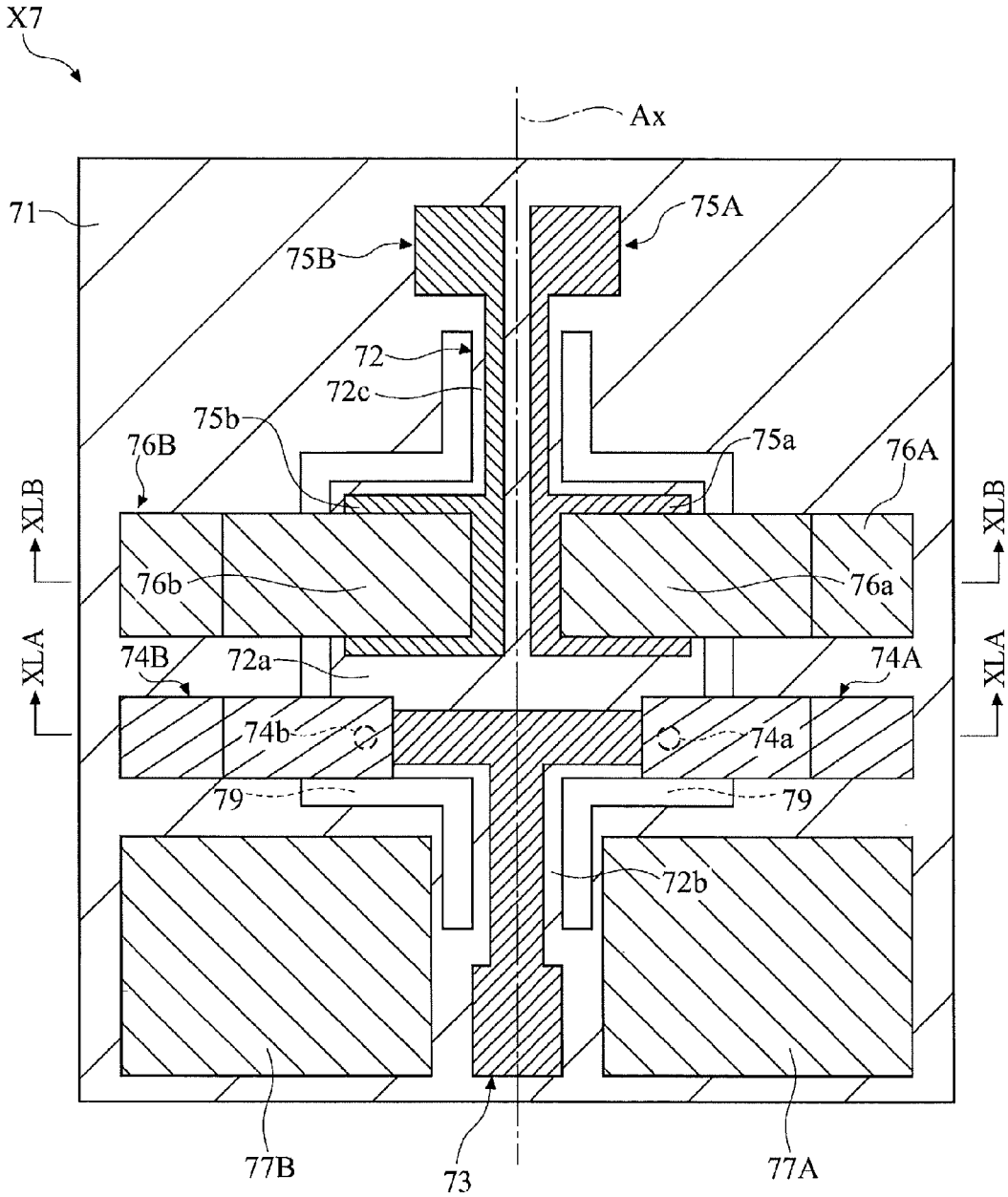
FIG. 38 is a plan view of a switching device according to an embodiment of the present invention.
Figure 39:
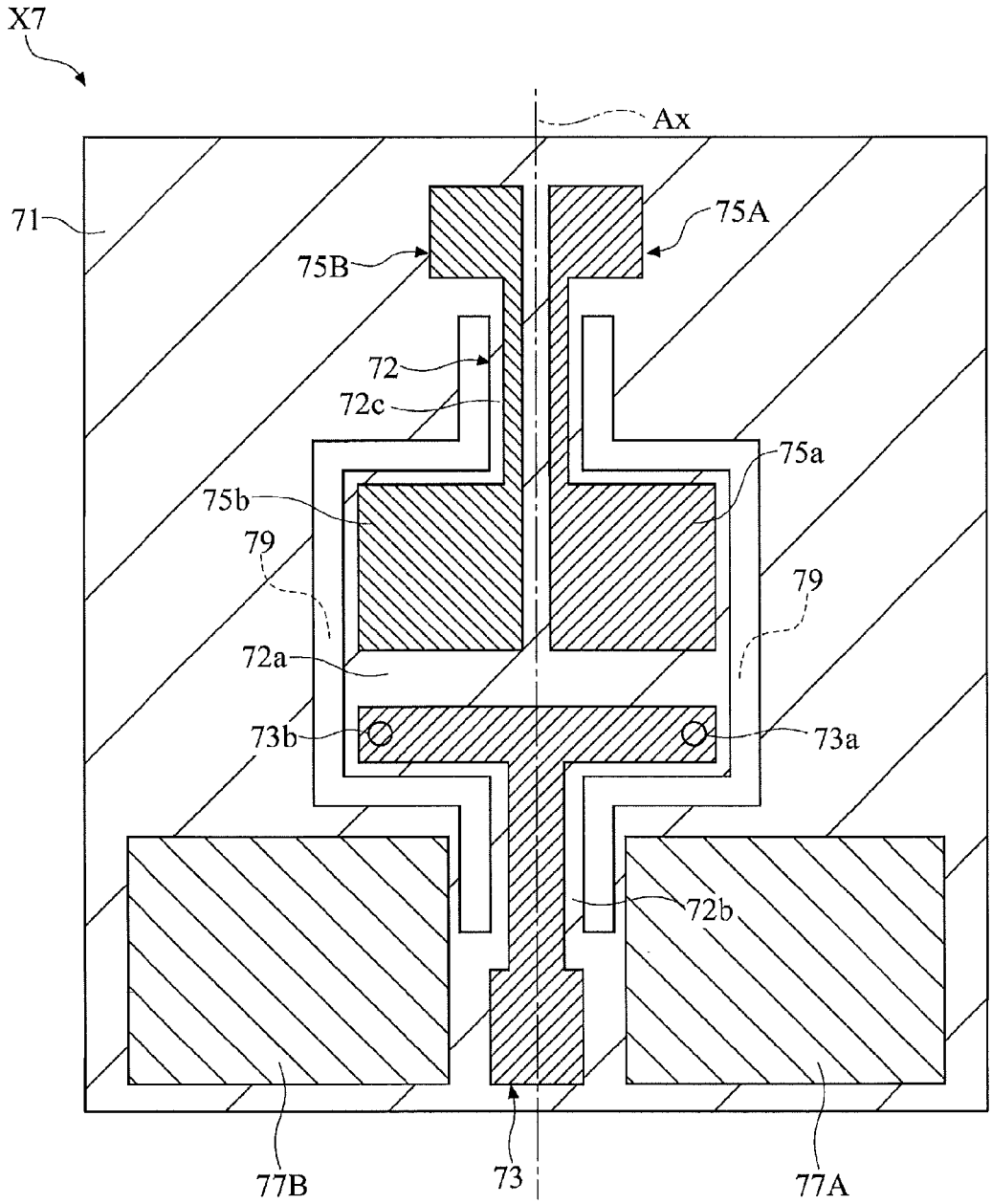
FIG. 39 is a plan view, partly omitted, of the switching device illustrated in FIG. 38.
Figure 40A:
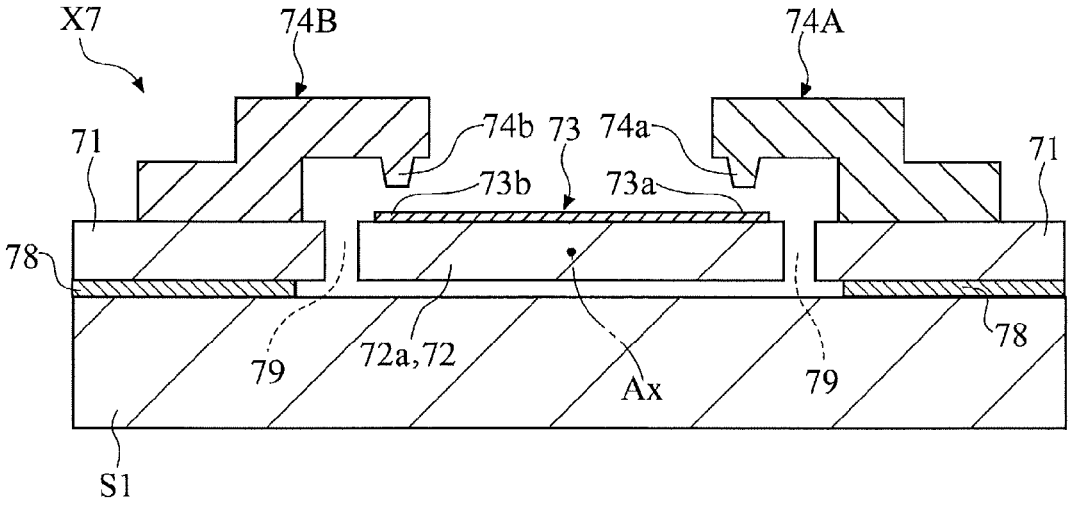
FIG. 40A is a sectional view taken along a line XLA-XLA in FIG. 38.
Figure 40B:
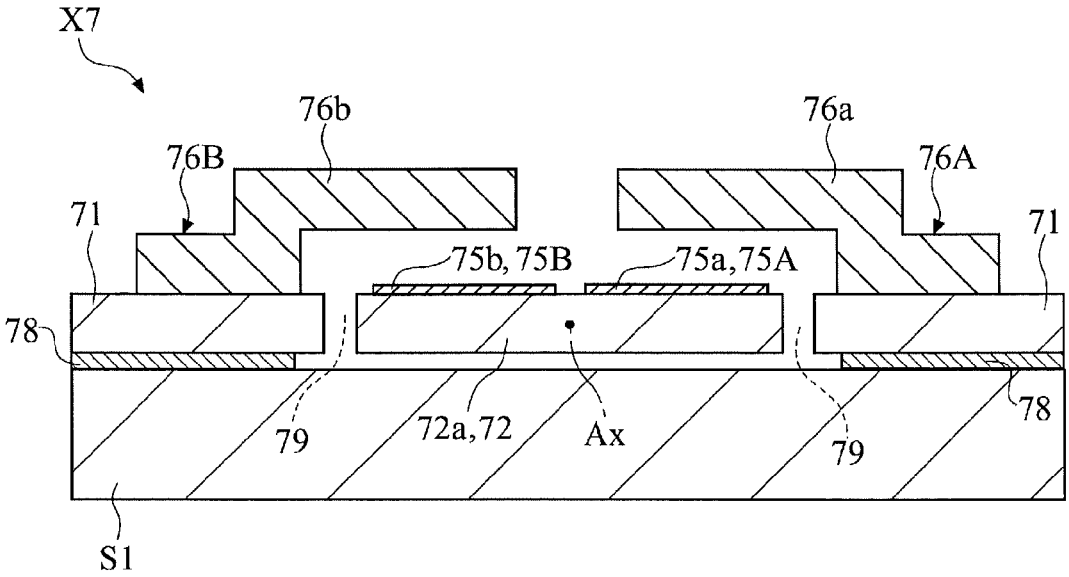
FIG. 40B is a sectional view taken along a line XLB-XLB in FIG. 38.

FIGS. 38-39, 40A and to 40B illustrate a switching device X7 according to an embodiment of the present invention. FIG. 38 is a plan view of the switching device X7. FIG. 39 is a plan view, partly omitted, of the switching device X7. FIGS. 40A and 40B are sectional views taken along lines XLA-XLA and XLB-XLB in FIG. 38, respectively.

The switching device X7 includes a substrate S1, a stationary portion 71, a movable portion 72, a signal line 73, signal lines 74A and 74B (omitted in FIG. 39), driving lines 75A and 75B, driving lines 76A and 76B (omitted in FIG. 35), and ground lines 77A and 77B. The switching device X7 is constituted as an SPDT switch (having one input and two outputs). As illustrated in FIGS. 40A and 40B, the stationary portion 71 is joined to the substrate S1 through a boundary layer 78. As illustrated in FIGS. 38 and 39, the movable portion 72 has a movable land portion 72*a* and beam portions 72*b* and 72*c*, and it is surrounded by the stationary portion 71 with a slit 79 interposed therebetween. The beam portions 72*b* and 72*c* are oppositely extended in one direction and are spaced from each other in the extending direction with the movable land portion 72*a* disposed therebetween. Further, each of the beam portions 72*b* and 72*c* couples the movable land portion 72*a* and the stationary portion 71 with each other. In other words, the movable portion 72 is supported by the stationary portion 71 in a both-end supported structure. Further, the beam portions 72*b* and 72*c* define an axis Ax about which the movable land portion 72*a* is rotationally displaced with respect to the stationary portion 71. As most clearly illustrated in FIG. 39, the signal line 73 is disposed to extend over the movable land portion 72*a*, the beam portion 72*b*, and the stationary portion 71. Also, the signal line 73 has, on the movable land portion 72*a*, a contact portion 73*a* capable of contacting the signal line 74A and a contact portion 73*b* capable of contacting the signal line 74B. As illustrated in the plan view of FIG. 39, for example, the contact portions 73*a* and 73*b* are spaced from each other on the movable land portion 72*a* with the axis Ax disposed therebetween. Further, the signal line 73 is connected to a predetermined circuit, which is a switching target, through predetermined wiring (not shown). As illustrated in FIG. 40A, the signal line 74A is formed in a shape protruding upwards from the stationary portion 71 and has a region positioned to face the signal line 73. The signal line 74A includes, in its region positioned to face the signal line 73, a projected portion or a contact portion 74*a* extending toward the signal line 73. Further, the signal line 74A is connected to a predetermined first circuit, which is a switching target, through predetermined wiring (not shown). The signal line 74B is also formed in a shape protruding upwards from the stationary portion 71 and has a region positioned to face the signal line 73. The signal line 74B includes, in its region positioned to face the signal line 73, a projected portion or a contact portion 74*b* extending toward the signal line 73. Further, the signal line 74B is connected to a predetermined second circuit, which is a switching target, through predetermined wiring (not shown). As most clearly illustrated in FIG. 39, the driving line 75A is disposed to extend over the movable land portion 72*a*, the beam portion 72*c*, and the stationary portion 71. Also, the driving line 75A has a driving electrode portion 75*a* on the movable land portion 72*a*. The driving line 75B is disposed to extend over the movable land portion 72*a*, the beam portion 72*c*, and the stationary portion 71. Also, the driving line 75B has a driving electrode portion 75*b* on the movable land portion 72*a*. As illustrated in the plan view of FIG. 39, for example, the driving electrode portions 75*a* and 75*b* are spaced from each other on the movable land portion 72*a* with the axis Ax disposed therebetween. As illustrated in FIG. 40B, the driving line 76A is formed in a shape protruding upwards from the stationary portion 71 and has a driving electrode portion 76*a* positioned to face the driving electrode portion 75*a*. Further, the driving line 76A has a shape extending along the signal lines 73 and 74A as illustrated in FIG. 38, and is connected to the ground through predetermined wiring (not shown) (hence the driving line 76A serves also as a ground line). As illustrated in FIG. 40B, the driving line 76A is formed in a shape protruding upwards from the stationary portion 71 and has a driving electrode portion 76*a* positioned to face the driving electrode portion 75*a*. Further, the driving line 76A has a shape extending along the signal lines 73 and 74A as illustrated in FIG. 38, and is connected to the ground through predetermined wiring (not shown) (hence the driving line 76A serves also as a ground line). Also, as illustrated in FIG. 40B, the driving line 76B is formed in a shape protruding upwards from the stationary portion 71 and has a driving electrode portion 76*b* positioned to face the driving electrode portion 75*b*. Further, the driving line 76B has a shape extending along the signal lines 73 and 74B as illustrated in FIG. 38, and is connected to the ground through predetermined wiring (not shown) (hence the driving line 76B serves also as a ground line). The ground line 77A has a shape having sides adjacent to and extending along the signal lines 73 and 74A as illustrated in FIG. 38, and is connected to the ground through predetermined wiring (not shown). The ground line 77B has a shape having sides adjacent to and extending along the signal lines 73 and 74B, and is connected to the ground through predetermined wiring (not shown). Other constructions of the stationary portion 71, the movable portion 72, the signal lines 73, 74A and 74B, the driving lines 75A, 75B, 76A and 76B, and the ground line 77A and 77B are similar to those described above regarding the stationary portion 11, the movable portion 12, the signal lines 13 and 14, the driving lines 15 and 16, and the ground line 17 in the above-described embodiment. The switching device X7 thus constructed can be manufactured by a method similar to that for manufacturing the switching device X1 according to the above-described embodiment.

Figure 41A:
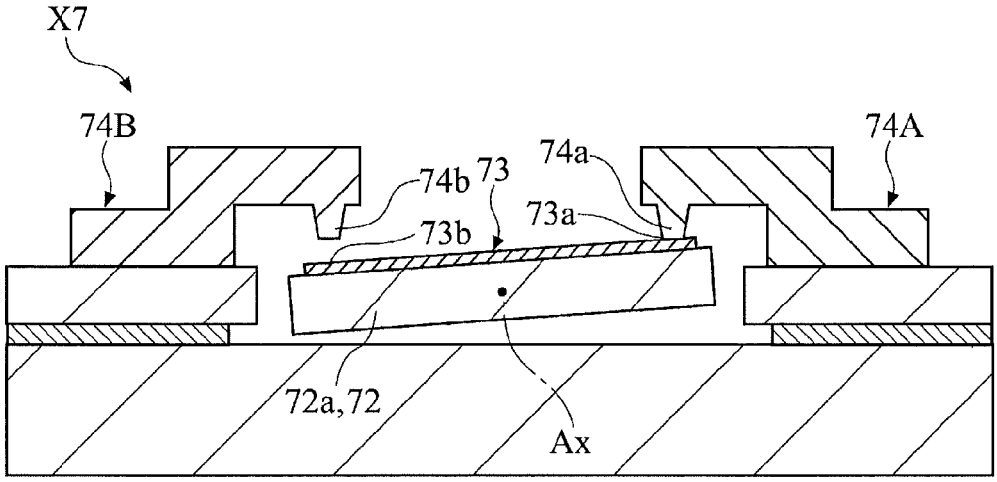
FIGS. 41A and 41B illustrate two different closed states in the switching device of FIG. 38.

In the switching device X7 having the above-described structure, when a driving voltage is applied to the driving line 75A, an electrostatic attraction force is generated between the driving electrode portion 75*a* of the driving line 75A and the driving electrode portion 76*a* of the driving line 76A (connected to the ground), and the movable portion 72 is operated or elastically deformed, as illustrated in FIG. 41A, until the contact portion 73*a* of the signal line 73 comes into contact with the contact portion 74*a* of the signal line 74A (while the beam portions 72*b* and 72*c* are twisted). A first closed state of the switching device X7 is thus established. In the first closed state, the signal lines 73 and 74A are connected to each other so that a current is allowed to pass between the signal lines 73 and 74A. With such a switching-on operation, a first on-state of, e.g., a high-frequency signal can be achieved.

When, in the switching device X7 in the first closed state, the application of the voltage to the driving line 75A is stopped to extinguish the electrostatic attraction force acting between the driving electrode portions 75*a* and 76*a*, the movable portion 72 and the beam portions 72*b* and 72*c* return to their natural states and the contact portion 73*a* of the signal line 73 moves away from the contact portion 74*a* of the signal line 74A. The open state of the switching device X7 is thus established.

Figure 41B:
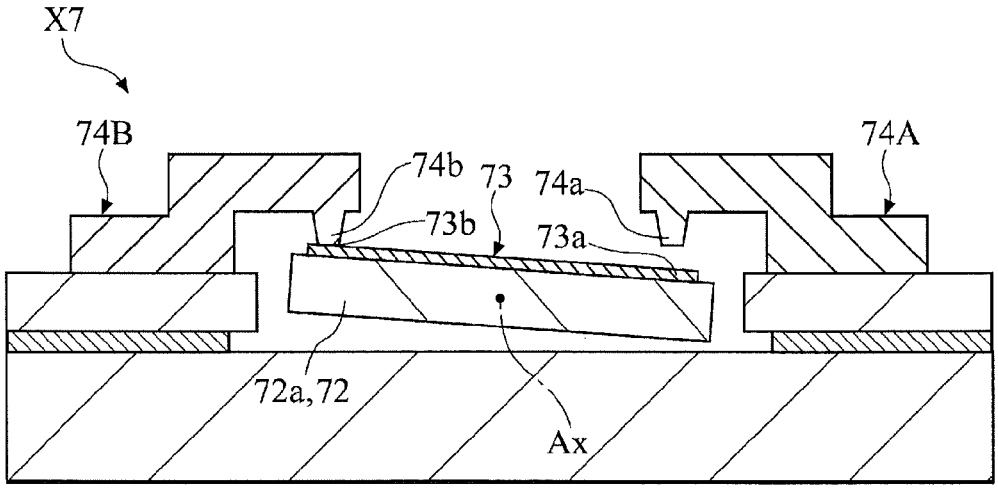

Further, in the switching device X7, when a driving voltage is applied to the driving line 75B, an electrostatic attraction force is generated between the driving electrode portion 75*b* of the driving line 75B and the driving electrode portion 76*b* of the driving line 76B (connected to the ground), and the movable portion 72 is operated or elastically deformed, as illustrated in FIG. 41B, until the contact portion 73*b* of the signal line 73 comes into contact with the contact portion 74*b* of the signal line 74B (while the beam portions 72*b* and 72*c* are twisted). A second closed state of the switching device X7 is thus established. In the second closed state, the signal lines 73 and 74B are connected to each other so that a current is allowed to pass between the signal lines 73 and 74B. With such a switching-on operation, a second on-state of, e.g., a high-frequency signal can be achieved.

When, in the switching device X7 in the second closed state, the application of the voltage to the driving line 75B is stopped to extinguish the electrostatic attraction force acting between the driving electrode portions 75*b* and 76*b*, the movable portion 72 and the beam portions 72*b* and 72*c* return to their natural states and the contact portion 73*b* of the signal line 73 moves away from the contact portion 74*b* of the signal line 74B. The open state of the switching device X7 is thus established.

As described above, the switching device X7 is able to function as an SPDT switch.

More specifically, the switching device X7 is constituted as a pair of SPST switches (each having one input and one output), which partly share the structure. One SPST switch (first switch) includes the contact portion 73*a*, the signal line 74A, i.e., the contact portion 74*a*, and the driving lines 75A and 76A. The other SPST switch (second switch) includes the contact portion 73*b*, the signal line 74B, i.e., the contact portion 74*b*, and the driving lines 75B and 76B.

In the first switch of the switching device X7, passage and non-passage of, e.g., a high-frequency signal between the signal lines 73 and 74A are selected respectively by closing and opening between the contact portions 73*a* and 74*a*. Stated another way, the first switch includes a single opening/closing point (single contact). The first switch thus constructed is less susceptible to the sticking failure that has been described above in connection with the known switching device Z2. Similarly, in the second switch, passage and non-passage of, e.g., a high-frequency signal between the signal lines 73 and 74B are selected respectively by closing and opening between the contact portions 73*b* and 74*b*. Stated another way, the second switch includes a single opening/closing point (single contact). The second switch thus constructed is also less susceptible to the sticking failure that has been described above in connection with the known switching device Z2. Accordingly, the switching device X7, i.e., the SPDT switch including the first and second switches, is suitable for realizing a long contact opening/closing life of the SPDT switch.

In the switching device X7, the driving lines 75A and 75B extending over the movable land portion 72*a*, the beam portion 72*c*, and the stationary portion 71, as well as the driving lines 76A and 76B arranged on the stationary portion 71 are all disposed separately from the signal lines 73, 74A and 74B. Stated another way, in the switching device X7, the signal lines 73, 74A and 74B are electrically separated from the driving lines 75A, 75B, 76A and 76B. The switching device X7 thus constructed is less susceptible to the signal leakage from the signal line to the driving line, which has been described above in connection with the known switching device Z1. Accordingly, the switching device X7 is suitable for not only reducing an insertion loss, but also obtaining a superior high-frequency characteristic.

In the switching device X7, as illustrated in the plan view of FIG. 38, a first signal path constituted by the signal lines 73 and 74A is disposed between the driving line 76A (ground line) and the ground line 77A and between the ground line 77A and 77B, and the driving line 76A and the ground lines 77A and 77B have shapes extending along the first signal path. In other words, the first signal path (i.e., the signal lines 73 and 74A) and the ground lines (i.e., the driving line 76A and the ground lines 77A and 77B) constitute coplanar passages. Also, as illustrated in the plan view of FIG. 38, a second signal path constituted by the signal lines 73 and 74B is disposed between the driving line 76B (ground line) and the ground line 77B and between the ground line 77A and 77B, and the driving line 76B and the ground lines 77A and 77B have shapes extending along the second signal path. In other words, the second signal path (i.e., the signal lines 73 and 74B) and the ground lines (i.e., the driving line 76B and the ground lines 77A and 77B) constitute coplanar passages. Using the coplanar passages is preferable including in suppressing the signal leakage from the signal lines 73, 74A and 74B.

Similarly to the second modification of the switching device X1, the switching device X7 may include the stopper portion 20 (including the projected portion 20*a*) to prevent the driving electrode portions 75*a* and 76*a* and the driving electrode portions 75*b* and 76*b* from contacting with each other and short-circuiting when driven. Further, similarly to the fourth modification of the switching device X1 in which the signal line 13 and the driving line 15 partly have the thicker portions 13*a* and 15*a*, respectively, the switching device X7 may be modified such that the signal line 73 and the driving lines 75A and 75B may partly have thicker portions.

Figure 42:
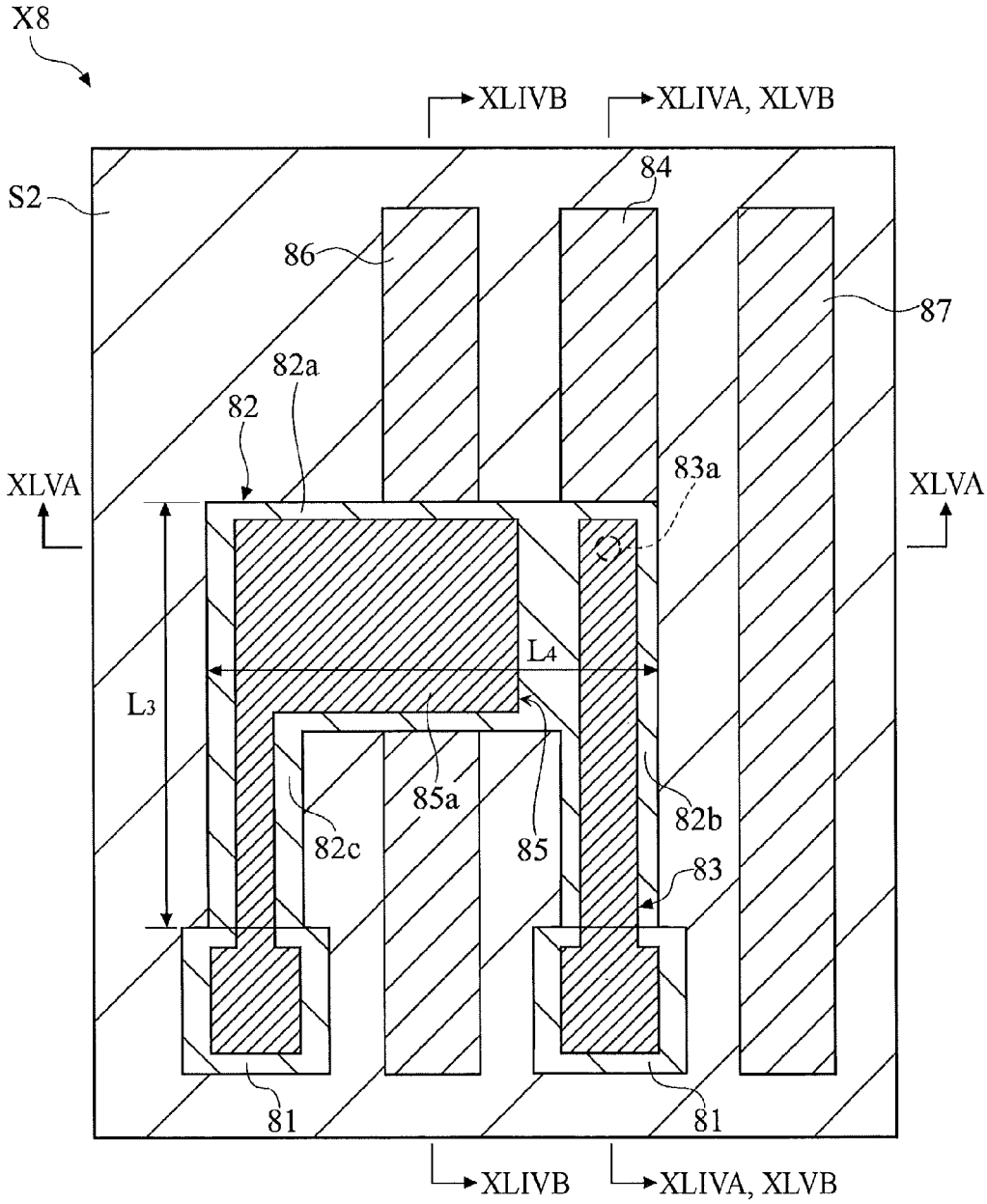
FIG. 42 is a plan view of a switching device according to an embodiment of the present invention.
Figure 43:
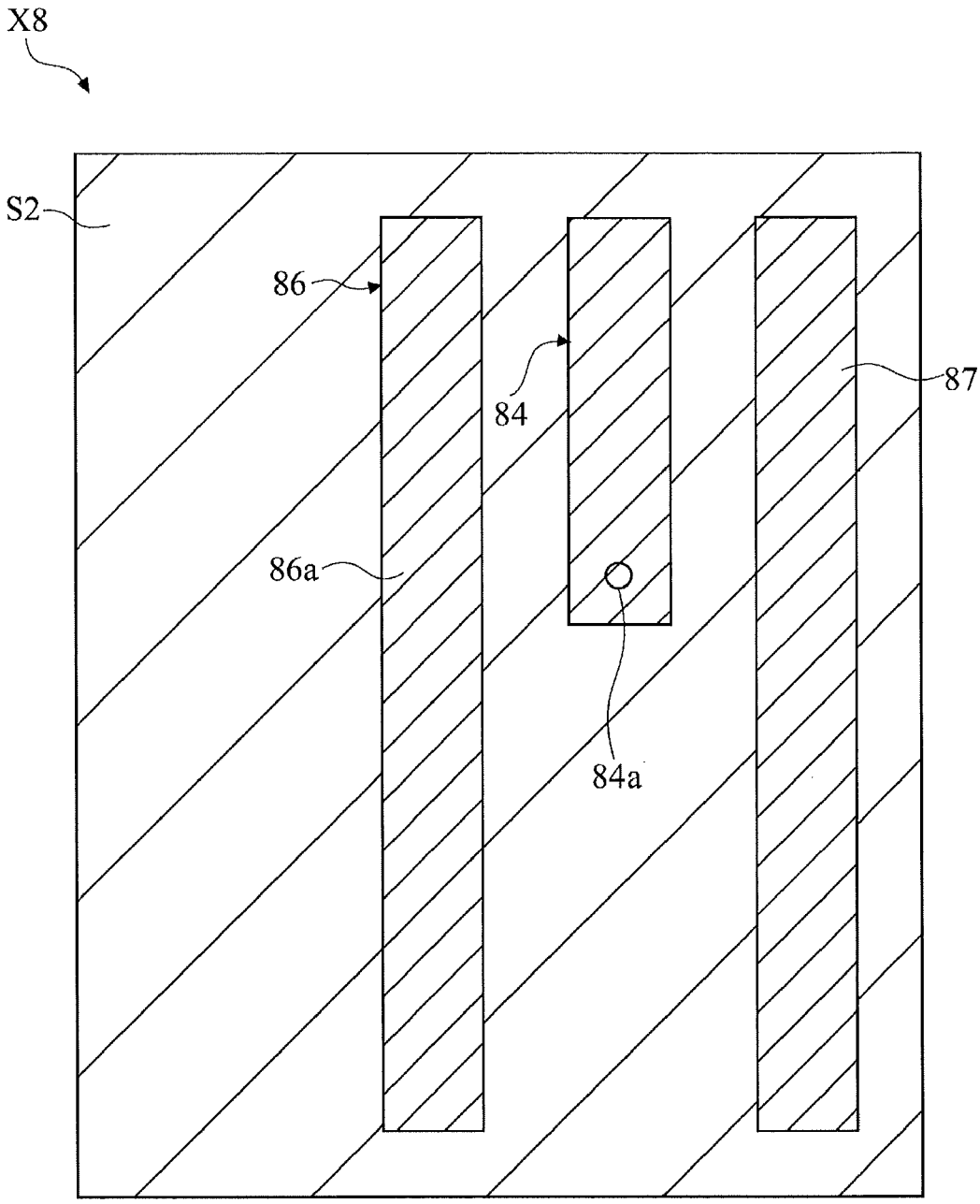
FIG. 43 is a plan view, partly omitted, of the switching device illustrated in FIG. 42.
Figure 44A:
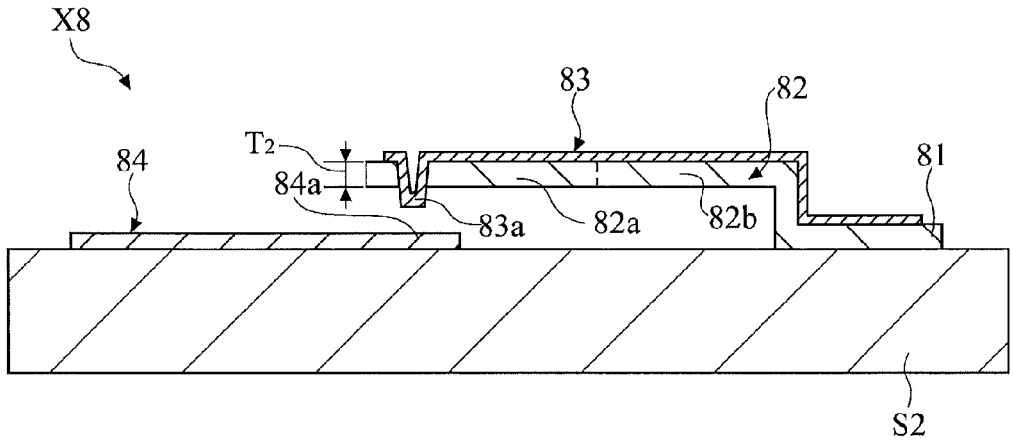
FIG. 44A is a sectional view taken along a line XLIVA-XLIVA in FIG. 42.
Figure 44B:
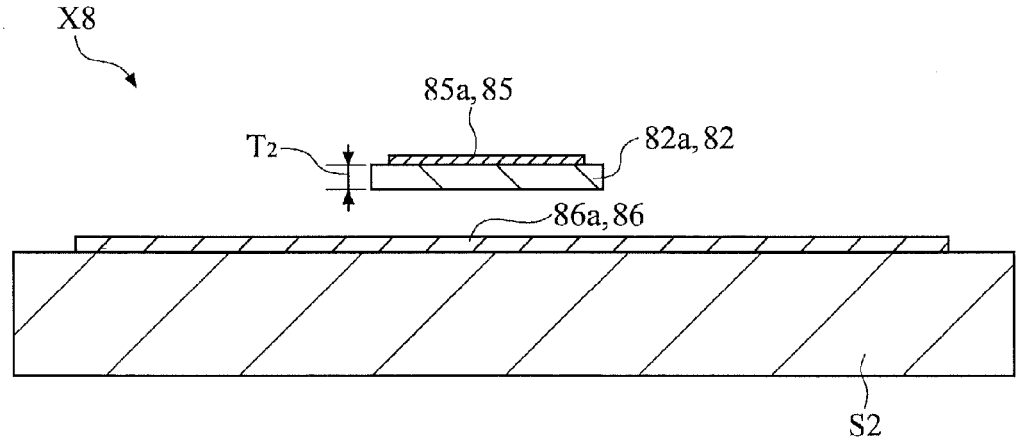
FIG. 44B is a sectional view taken along a line XLIVB-XLIVB in FIG. 42.
Figure 45A:
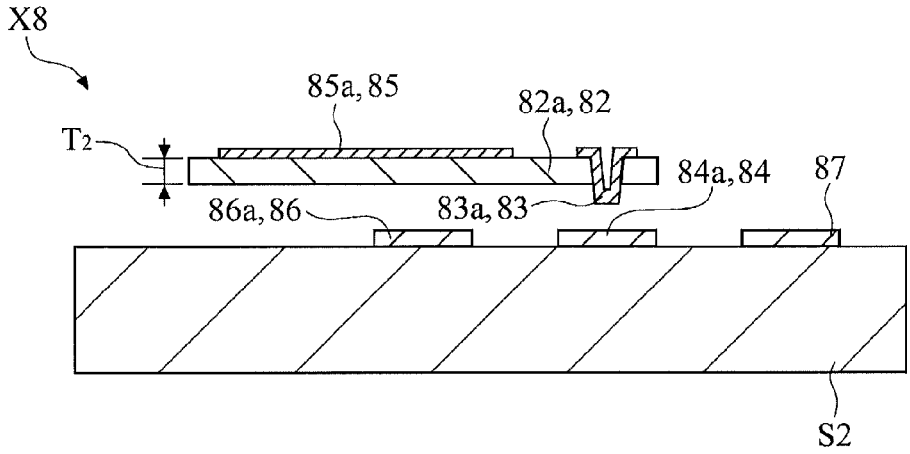
FIG. 45A is a sectional view taken along a line XLVA-XLVA in FIG. 42.

FIGS. 42, 43, 44A, 44B and 45A 45B illustrate a switching device X8 according to an embodiment of the present invention. FIG. 42 is a plan view of the switching device X8. FIG. 43 is a plan view, partly omitted, of the switching device X8. FIGS. 44A, 44B and 45A (45B) are sectional views taken along lines XLIVA-XLIVA, XLIVB-XLIVB and XLVA-XLVA (XLVB-XLVB) in FIG. 42, respectively.

The switching device X8 includes a substrate S2, a stationary portion 81 (omitted in FIG. 43), a movable portion 82 (omitted in FIG. 43), signal lines 83 and 84, driving lines 85 and 86, and a ground line 87.

The substrate S2 is made of, e.g., glass or GaAs and has a surface on which the signal line 84, the driving line 86, and the ground line 87 are formed by patterning.

As illustrated in FIG. 44A, the stationary portion 81 is joined to the substrate S2 and is made of, e.g., silicon oxide or polysilicon. In an embodiment, the stationary portion 81 corresponds, together with substrate S2, to the stationary portion according to an embodiment.

The movable portion 82 has a movable land portion 82*a* and beam portions 82*b* and 82*c*, as most clearly illustrated in FIG. 42, and it is spaced from the substrate S2 as illustrated in FIGS. 44A to 45A. In an embodiment, the beam portions 82*b* and 82*c* each couple the stationary portion 81 and the movable portion 82 with each other, and they are arranged side by side to extend parallel to each other between the stationary portion 81 and the movable portion 82. In other words, the movable portion 82 is supported by the movable portion 81 in a cantilevered structure. A thickness $T_2$ of the movable portion 82, denoted in FIG. 44A to 45A, is 15 μm or less, for example. Further, a length $L_3$ of the movable portion 82, denoted in FIG. 42, is 200 to 400 μm, for example, and a length $L_4$ thereof is 300 to 500 μm, for example. The movable portion 82 thus formed is made of, e.g., silicon oxide or polysilicon.

As most clearly illustrated in FIG. 42, the signal line 83 is disposed to extend over the movable land portion 82*a*, the beam portion 82*b*, and the stationary portion 81. Also, as illustrated in FIGS. 44A and 45A, the signal line 83 has a projected portion or a contact portion 83*a* which penetrates through the movable land portion 82*a* toward the signal line 84 to be capable of contacting the signal line 84. A thickness of the signal line 83 is, e.g., 0.5 to 5 μm. Further, the signal line 83 is connected to a predetermined circuit, which is a switching target, through predetermined wiring (not shown). The signal line 83 is made of a predetermined conductive material and has a multilayered structure comprising, for example, an undercoat film of Mo and an Au film overlying the undercoat film. The signal line 83 thus formed corresponds to a first signal line according to an embodiment.

As illustrated in FIG. 44A, for example, the signal line 84 is disposed on the substrate S2 and has a region positioned to face the signal line 83. The signal line 84 includes, in its region positioned to face the signal line 83, a contact portion 84*a* capable of contacting the signal line 83. A thickness of the signal line 84 is, e.g., 0.5 to 5 μm. Further, the signal line 84 is connected to a predetermined circuit, which is a switching target, through predetermined wiring (not shown). The signal line 84 is made of a predetermined conductive material and has a multilayered structure comprising, for example, an undercoat film of Mo and an Au film overlying the undercoat film. The signal line 84 thus formed corresponds to a second signal line according to an embodiment.

As most clearly illustrated in FIG. 42, the driving line 85 is disposed to extend over the movable land portion 82*a*, the beam portion 82*c*, and the stationary portion 81. Also, the driving line 85 has a driving electrode portion 85*a* on the movable land portion 82*a*. The driving electrode portion 85*a* corresponds to a movable driving electrode portion according to an embodiment. A thickness of the driving line 85 is, e.g., 0.5 to 5 μm. The driving line 85 can be made of the same material as that of the signal line 83. The driving line 85 thus formed corresponds to a first driving line according to an embodiment.

As illustrated in FIG. 44B, the driving line 86 is disposed on the substrate S2 and has a driving electrode portion 86*a* positioned to face the driving electrode portion 85*a* of the driving line 85. The driving electrode portion 86*a* corresponds to a stationary driving electrode portion according to an embodiment. A thickness of the driving line 86 is, e.g., 0.5 to 5 μm. Further, the driving line 86 is extended along the signal lines 83 and 84 as illustrated in FIG. 42, and is connected to the ground through predetermined wiring (not shown) (hence the driving line 86 serves also as a ground line). The driving line 86 can be made of the same material as that of the signal line 84. The driving line 86 thus formed corresponds to a second driving line according to an embodiment.

The ground line 87 is extended along the signal lines 83 and 84 as illustrated in FIG. 42, and is connected to the ground through predetermined wiring (not shown). The ground line 87 can be made of the same material as that of the signal line 84.

Figure 45B:
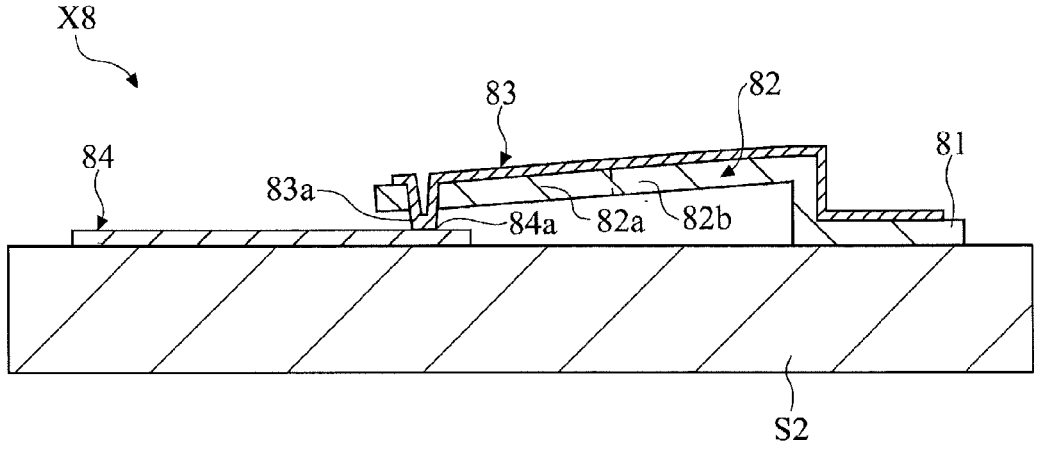
FIG. 45B is a sectional view taken along a line XLVB-XLVB in FIG. 42, the view illustrating a closed state.

In the switching device X8 having the above-described structure, when a driving voltage is applied to the driving line 85, an electrostatic attraction force is generated between the driving electrode portion 85*a* of the driving line 85 and the driving electrode portion 86*a* of the driving line 86 (connected to the ground), and the movable portion 82 is operated or elastically deformed until the contact portion 83*a* of the signal line 83 comes into contact with the contact portion 84*a* of the signal line 84. The closed state of the switching device X8 is thus established as illustrated in FIG. 45B. In the closed state, the signal lines 83 and 84 are connected to each other so that a current is allowed to pass between the signal lines 83 and 84. With such a switching-on operation, the on-state of, e.g., a high-frequency signal can be achieved.

On the other hand, when, in the switching device X8 in the closed state, the application of the voltage to the driving line 85 is stopped to extinguish the electrostatic attraction force acting between the driving electrode portions 85*a* and 86*a*, the movable portion 82 returns to its natural state and the signal line 83, specifically the contact portion 83*a*, moves away from the signal line 84, specifically from the contact portion 84*a*. The open state of the switching device X8 is thus established as illustrated in FIGS. 44A and 45A. In the open state, the signal lines 83 and 84 are electrically separated from each other, whereby a current is prevented from passing between the signal lines 83 and 84. With such a switching-off operation, the off-state of, e.g., a high-frequency signal can be achieved.

In the switching device X8, the signal line 83 is disposed to extend over the movable land portion 82*a*, the beam portion 82*b*, and the stationary portion 81, and has the contact portion 83*a* on the movable portion 82, specifically on the movable land portion 82*a*. The signal line 84 has the contact portion 84*a* positioned to face the contact portion 83*a*. Passage and non-passage of, e.g., a high-frequency signal between the signal lines 83 and 84 are selected respectively by closing and opening between the contact portions 83*a* and 84*a*. Stated another way, the switching device X8 includes a single opening/closing point (single contact). The switching device X8 thus constructed is less susceptible to the sticking failure that has been described above in connection with the known switching device Z2. Accordingly, the switching device X8 is suitable for realizing a long contact opening/closing life.

In the switching device X8, the driving line 85 is disposed to extend over the movable land portion 82*a*, the beam portion 82*c*, and the stationary portion 81, and has the driving electrode portion 85*a* on the movable land portion 82*a*. The driving line 86 has the driving electrode portion 86*a* positioned to face the driving electrode portion 85*a*. With the driving voltage applied between the driving electrode portions 85*a* and 86*a*, an electrostatic attraction force is generated between the driving electrode portions 85*a* and 86*a* so that the movable land portion 82*a* to which the driving electrode portion 85*a* is joined is operated or elastically deformed toward the driving electrode portion 86*a*. The driving line 85 is disposed separately from the signal line 83 (namely, the driving line 85 is routed from the movable land portion 82*a* to the stationary portion 81 while passing the beam portion 82*c* differing from the beam portion 82*b* on which the signal line 83 passes). Also, the driving line 86 is disposed separately from the signal line 84. Stated another way, in the switching device X8, the signal lines 83 and 84 are electrically separated from the driving lines 85 and 86. The switching device X8 thus constructed is less susceptible to the signal leakage from the signal line to the driving line, which has been described above in connection with the known switching device Z1. Accordingly, the switching device X8 is suitable for not only reducing an insertion loss, but also obtaining a superior high-frequency characteristic.

In the switching device X8, as illustrated in the plan view of FIG. 42, a signal path constituted by the signal lines 83 and 84 is disposed between the driving line 86 (ground line) and the ground line 87, and the driving line 86 and the ground line 87 have shapes extending along the signal path (the signal path, the driving line 86, and the ground line 87 are arranged parallel to one another). In other words, the signal path (i.e., the signal lines 83 and 84) and two ground lines (i.e., the driving line 86 and the ground line 87) constitute coplanar passages. Using the coplanar passages is preferable including in suppressing the signal leakage from the signal lines 83 and 84.

In the switching device X8, similarly to the arrangement described above in the first modification of the switching device X1 regarding the signal line 13 and the driving lines 15 on the movable portion 12, the signal line 83 and the driving line 85 on the movable portion 82 may be arranged in a symmetrical pattern shape. Similarly to the second modification of the switching device X1, the switching device X8 may include the stopper portion 20 (including the projected portion 20*a*) to prevent the driving electrode portions 85*a* and 86*a* and the driving electrode portions 85*b* and 86*b* from contacting with each other and short-circuiting when driven. Similarly to the third modification of the switching device X1 in which the signal lines 13 and 14 have the contact portions 13*a* and 14*a* on the beam portion 12*b*, the switching device X8 may be modified such that the contact portions 83*a* and 84*a* of the signal lines 83 and 84 are positioned on the beam portion 82*b*. Further, similarly to the fourth modification of the switching device X1 in which the signal line 13 and the driving line 15 partly have the thicker portions 13*a* and 15*a*, respectively, the switching device X8 may be modified such that the signal line 83 and the driving line 85 may partly have thicker portions.

FIGS. 46A to 49C illustrate a method of manufacturing the switching device X8 as successive changes in sections corresponding to part of FIG. 44A and part of FIG. 45A.

Figures 46A, 46B, 46C:
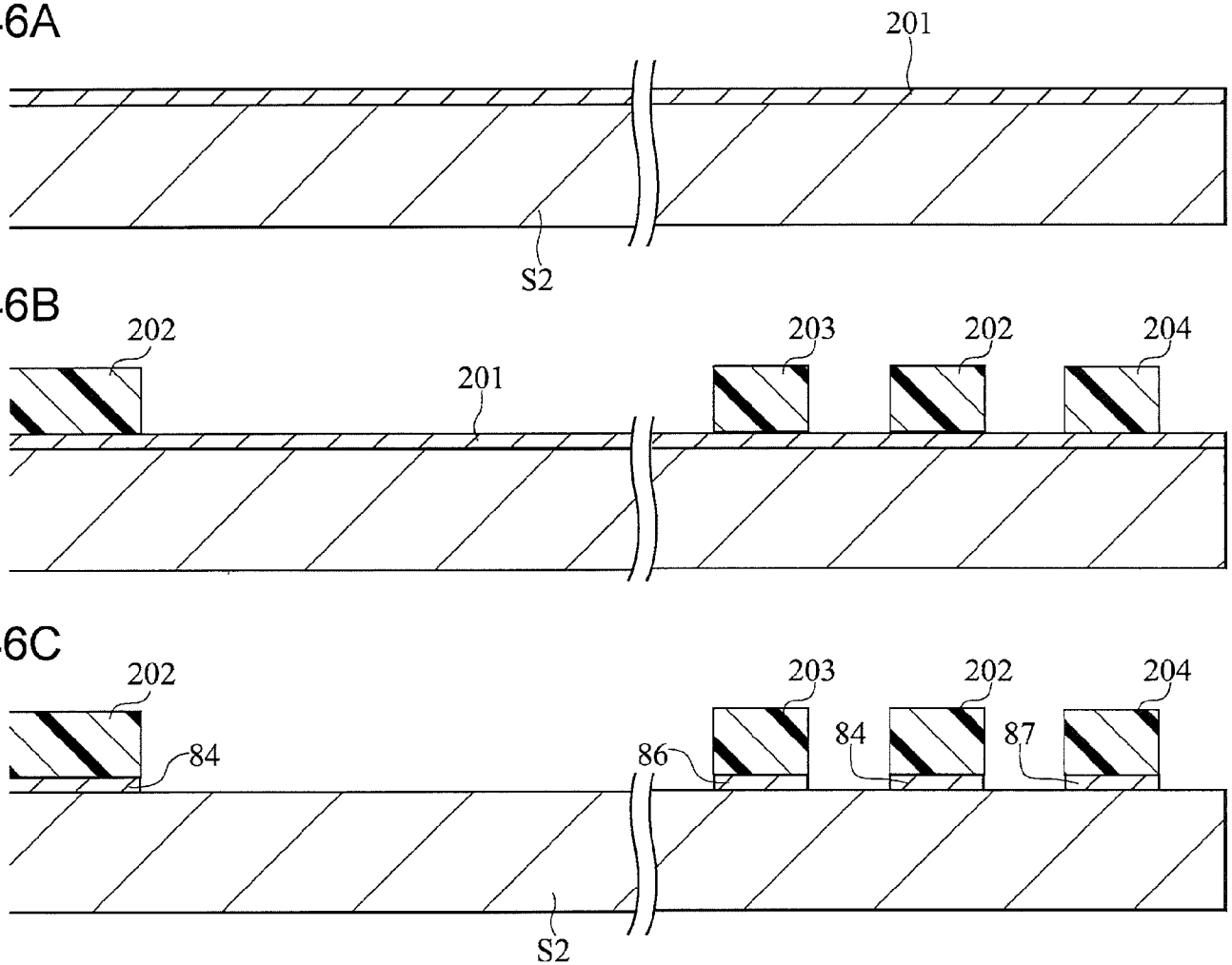
FIGS. 46A, 46B and 46C illustrate successive operations in part of a method of manufacturing the switching device illustrated in FIG. 42.

In the manufacturing method, as illustrated in FIG. 46A, a conductor film 201 is first formed on the substrate S2. The conductor film 201 can be formed by sputtering, for example, such that a Mo film is formed on the substrate S2 and an Au film is successively formed on the Mo film. The Mo film has a thickness of, e.g., 50 nm, and the Au film has a thickness of, e.g., 500 nm.

Next, as illustrated in FIG. 46B, resist patterns 202, 203 and 204 are formed on the conductor film 201 by photolithography. The resist pattern 202 has a pattern shape corresponding to the signal line 84. The resist pattern 203 has a pattern shape corresponding to the driving line 86. The resist pattern 204 has a pattern shape corresponding to the ground line 87.

Next, as illustrated in FIG. 46C, the signal line 84, the driving line 86, and the ground line 87 are formed on the substrate S2 by etching the conductor film 201 with the resist patterns 202 to 204 used as masks.

Figure 47A:
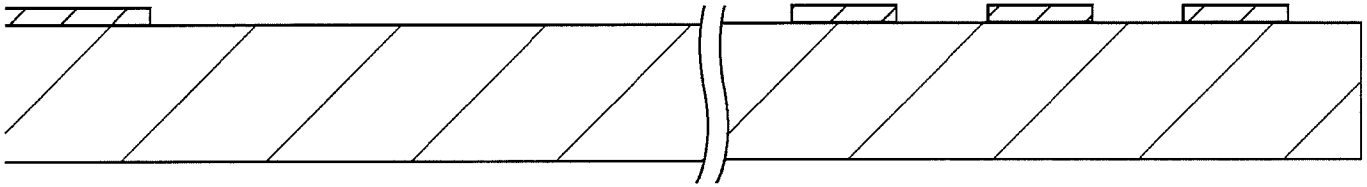
FIGS. 47A, 47B and 47C illustrate successive operations subsequent to FIG. 46C.
Figure 47B:
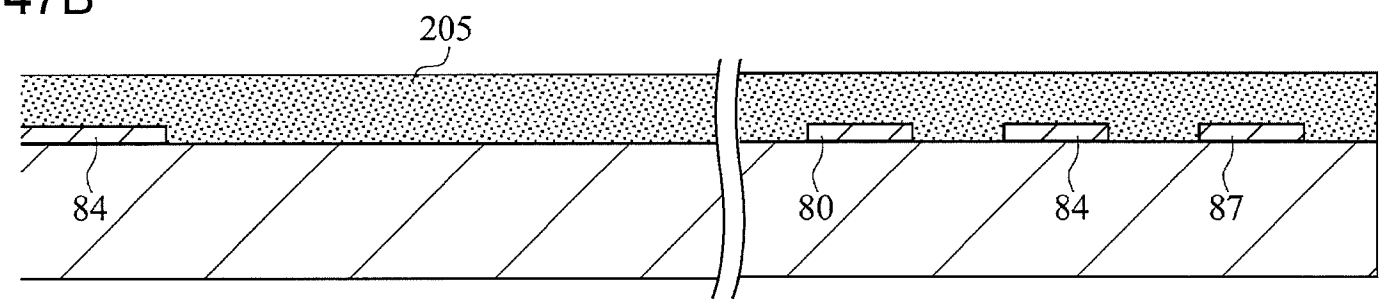

After removing the resist patterns 202 to 204 as illustrated in FIG. 47A, a sacrifice layer 205 is formed on the substrate S2 so as to cover the signal line 84, the driving line 86, and the ground line 87 as illustrated in FIG. 47B. The sacrifice layer 205 can be made of, e.g., polyimide. Spin coating, for example, can be employed as a method of forming the sacrifice layer 205. The sacrifice layer 205 formed in this operation has a thickness of, e.g., 5 μm. Silicon oxide may also be used as the material of the sacrifice layer.

Figure 47C:
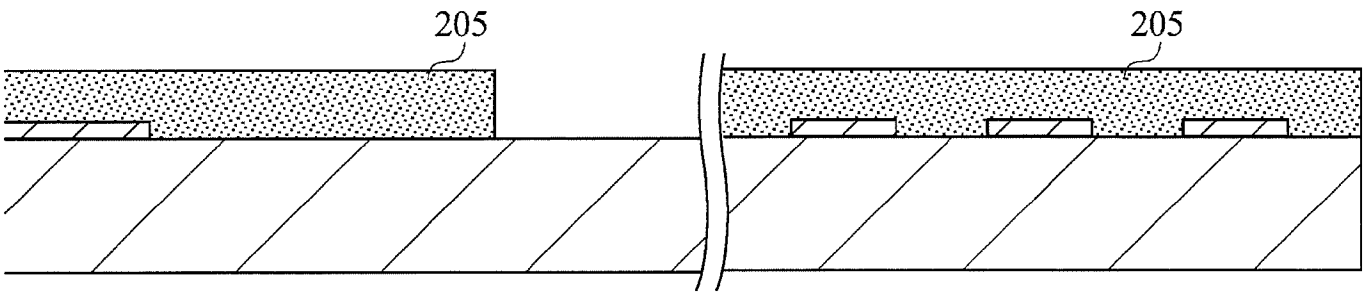

Next, as illustrated in FIG. 47C, the sacrifice layer 205 is patterned. More specifically, a predetermined resist pattern is formed on the sacrifice layer 205 by photolithography, and the sacrifice layer 205 is then etched with the resist pattern used as a mask.

Figures 48A, 48B, 48C:
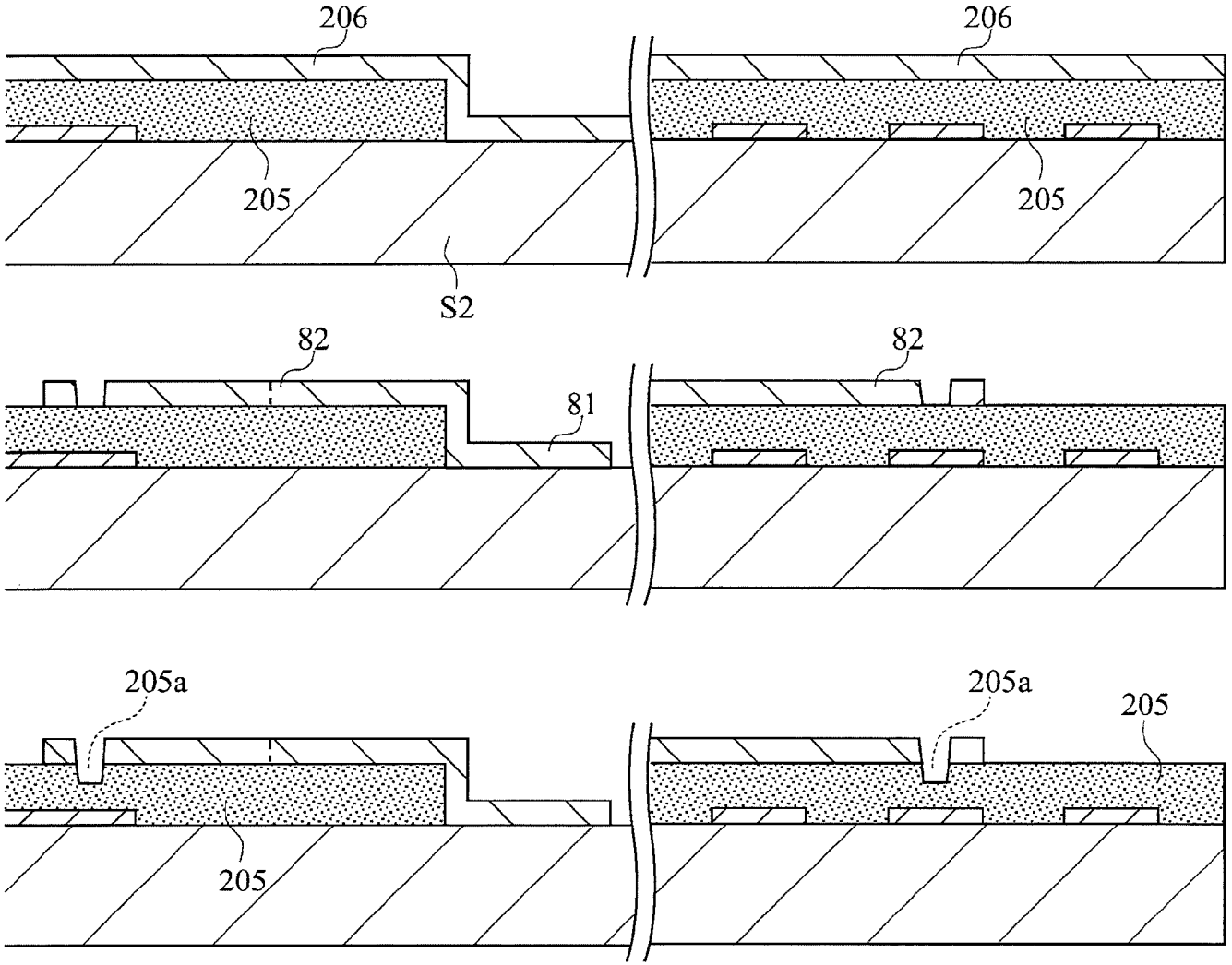
FIGS. 48A, 48B and 48C illustrate successive operations subsequent to FIG. 47C.

Next, as illustrated in FIG. 48A, a material film 206 for constituting the stationary portion 81 and the movable portion 82 is formed so as to cover the sacrifice layer 205 and the substrate S2. The material film 206 can be formed, for example, by coating a film of silicon oxide or polysilicon in a thickness of 5 μm over the sacrifice layer 205 and the substrate S2 by CVD.

Next, as illustrated in FIG. 48B, the material film 206 is patterned. More specifically, a predetermined resist pattern is formed on the material film 206 by photolithography, and the material film 206 is then etched with the resist pattern used as a mask. The stationary portion 81 and the movable portion 82 are formed in this operation.

Next, as illustrated in FIG. 48C, recesses 205*a* are formed in the sacrifice layer 205. More specifically, a predetermined resist pattern is formed on the sacrifice layer 205 and the material film 206 by photolithography, and the sacrifice layer 205 is then etched to a predetermined depth with the resist pattern used as a mask. The etching can be performed as ion etching (RIE), for example. The recesses 205*a* are each used to form a projection serving as the contact portion 83*a* of the signal line 83.

Figure 49A:
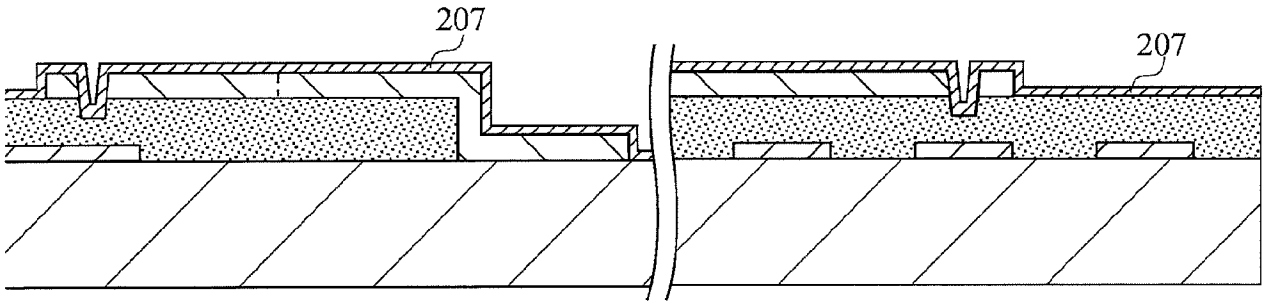
FIGS. 49A to 49C illustrate successive operations subsequent to FIG. 48C.

Next, a conductor film 207 is formed as illustrated in FIG. 49A. The conductor film 207 can be formed by sputtering, for example, such that a Mo film is formed in a thickness of 200 nm and an Au film is successively formed in a thickness of 500 nm on the Mo film.

Figure 49B:
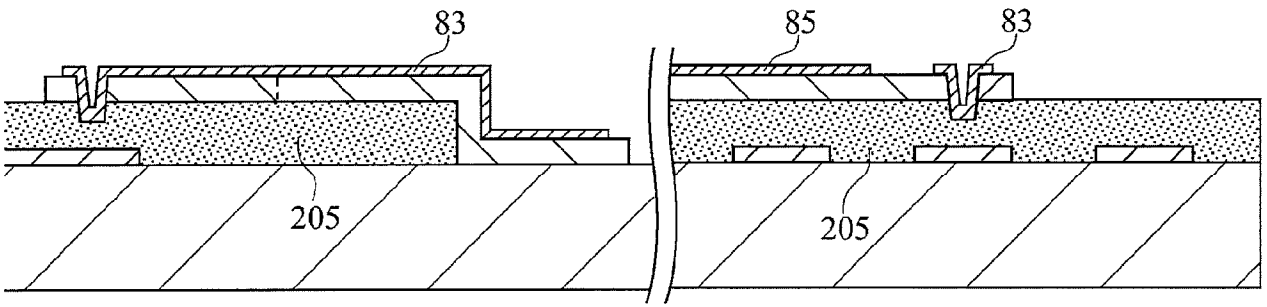

Next, the conductor film 207 is patterned as illustrated in FIG. 49B. More specifically, a predetermined resist pattern is formed on the conductor film 207 by photolithography, and the conductor film 207 is then etched with the resist pattern used as a mask. The signal line 83 and the driving line 85 are formed in this operation.

Figure 49C:
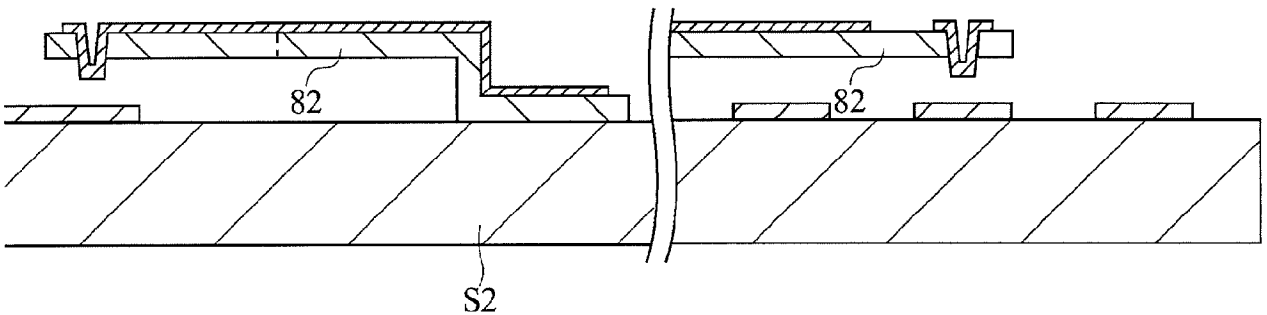

Next, the sacrifice layer 205 is removed as illustrated in FIG. 49C. For example, oxygen plasma ashing can be employed as a method for removing the sacrifice layer 205. In this operation, the movable portion 82 can be released from the substrate S2. As a result, the switching device X8 can be appropriately manufactured.

The above-described switching devices X1 to X8 according to the embodiments of the present invention can be each used as a switch constituting part of a variable phase shifter. Alternatively, the switching devices X1 to X8 can be each used an RF circuit selector switch which is included in a semiconductor tester for electrically inspecting an LSI.

Figure 50:
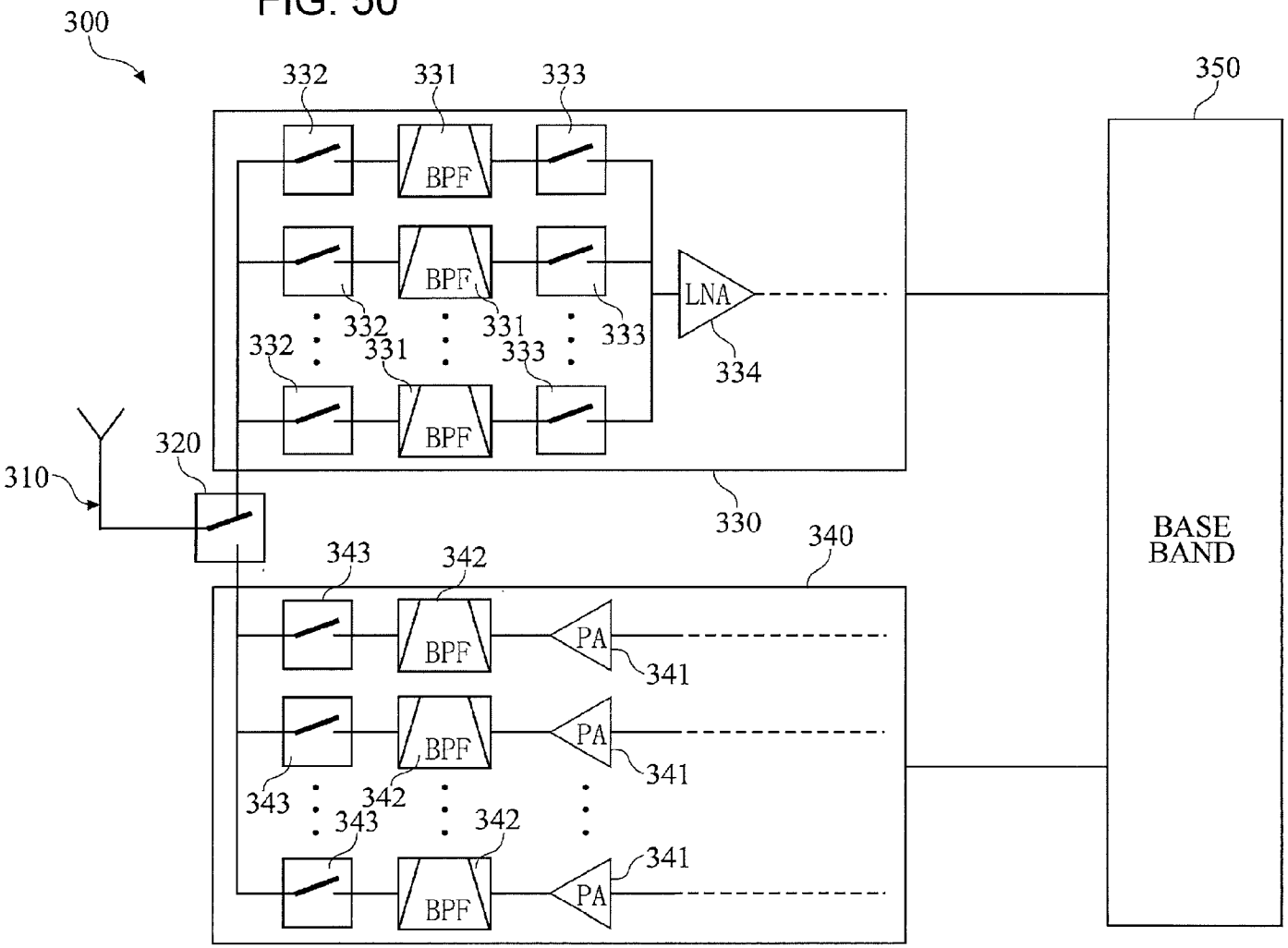
FIG. 50 illustrates a partial configuration of a communication apparatus according to an embodiment of the present invention.
Figure 51:
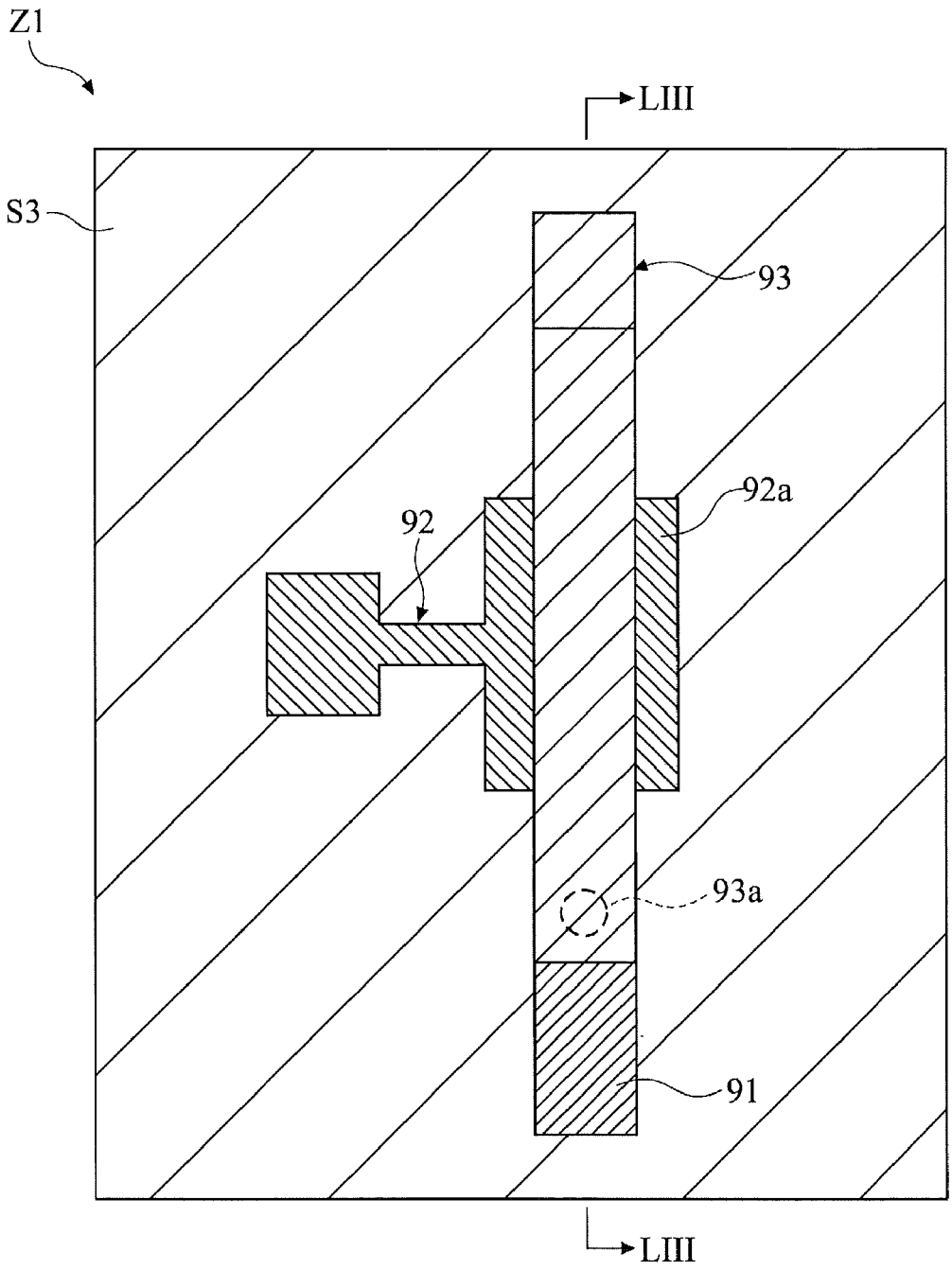
FIG. 51 is a plan view illustrating one example of known switching devices.
Figure 52:
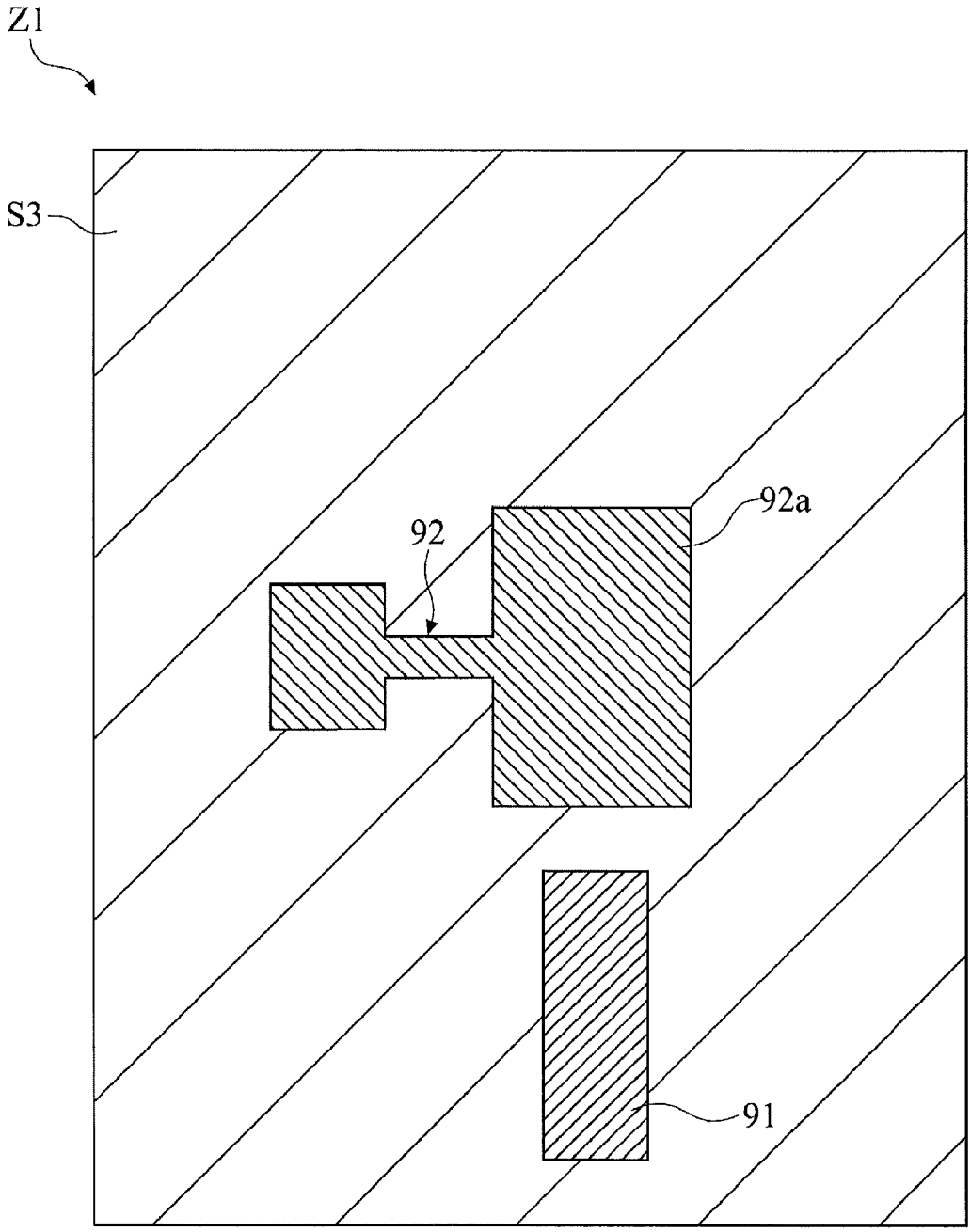
FIG. 52 is a plan view, partly omitted, of the switching device illustrated in FIG. 51.
Figure 53:
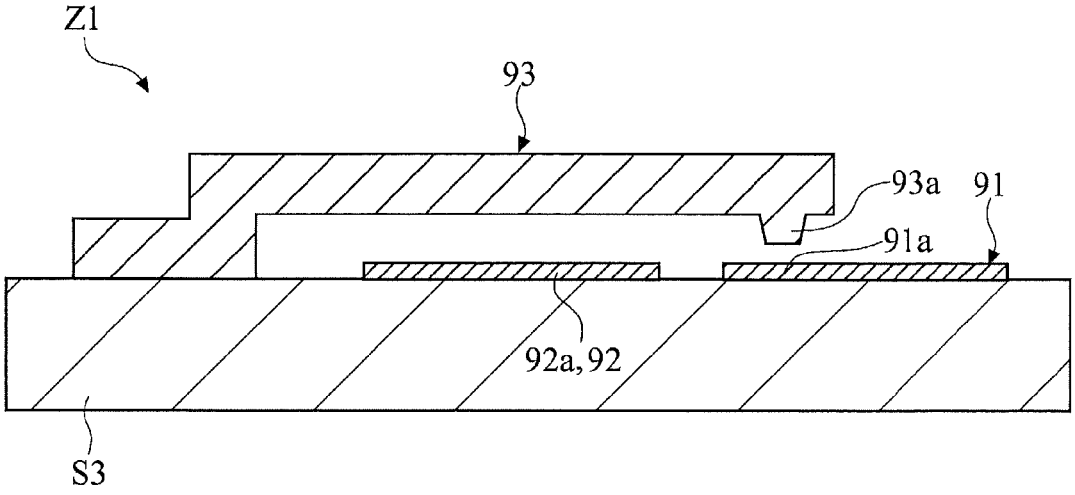
FIG. 53 is a sectional view taken along a line LIII-LIII in FIG. 51.
Figure 54:
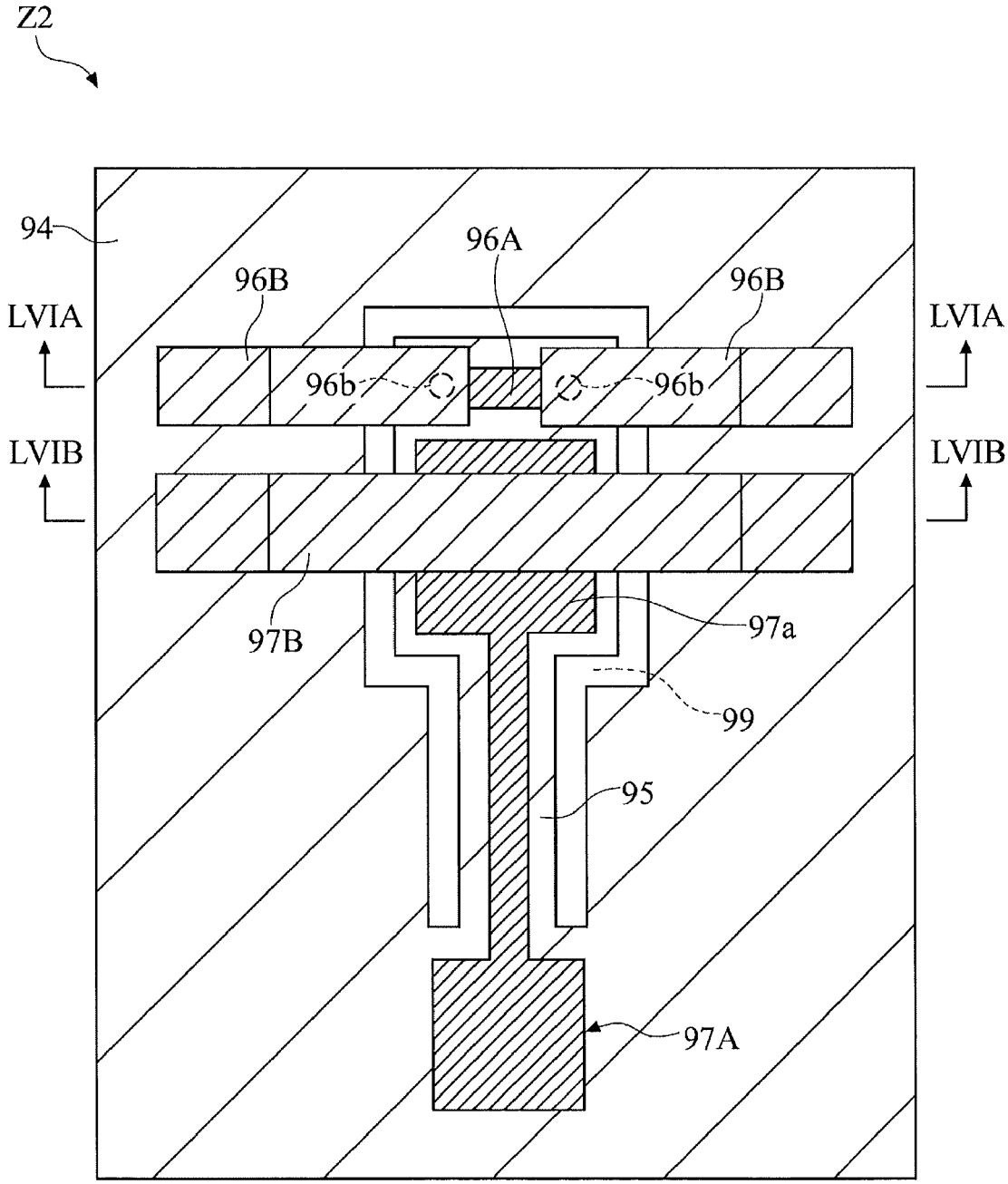
FIG. 54 is a plan view illustrating another example of known switching devices.
Figure 55:
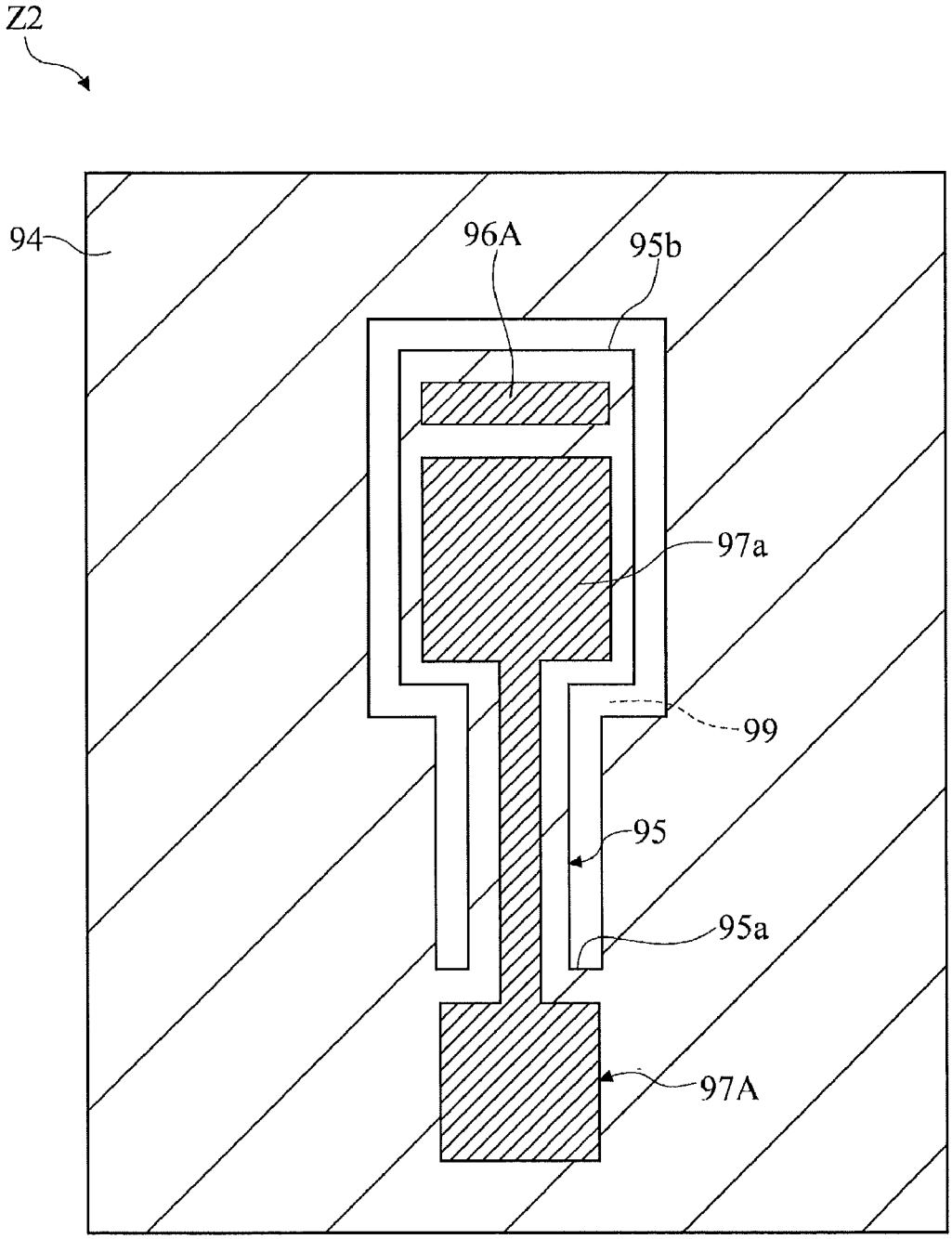
FIG. 55 is a plan view, partly omitted, of the switching device illustrated in FIG. 54.
Figure 56A:
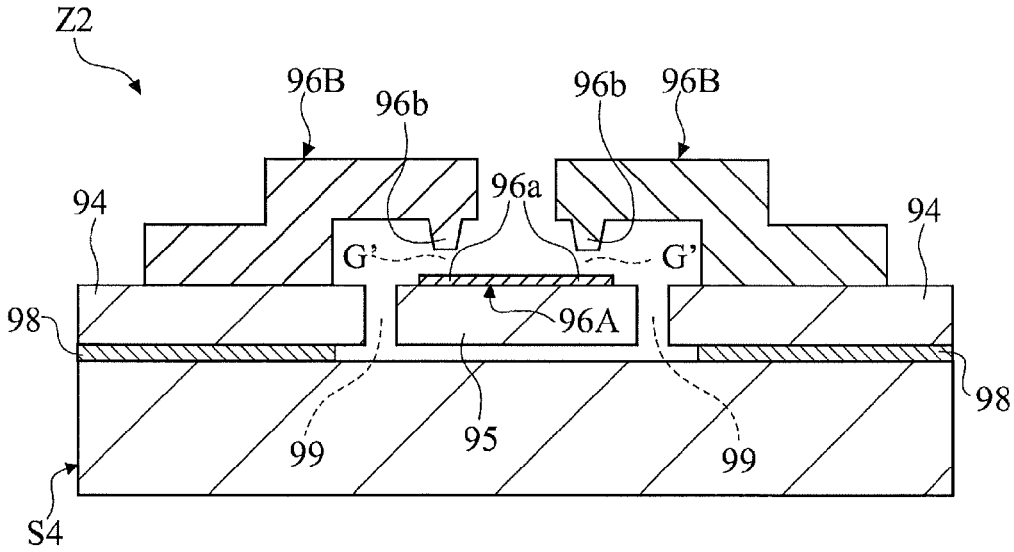
FIG. 56A is a sectional view taken along a line LVIA-LVIA in FIG. 54.
Figure 56B:
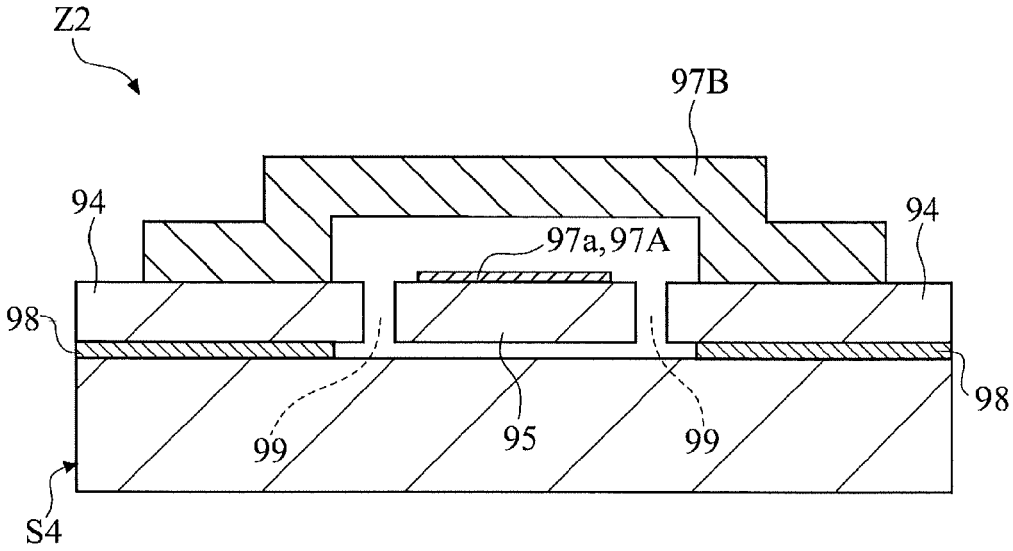
FIG. 56B is a sectional view taken along a line LVIB-LVIB in FIG. 54.

FIG. 50 illustrates a partial configuration of a communication apparatus 300 according to an embodiment of the present invention. The communication apparatus 300 includes an antenna 310, a transmission/reception selector switch 320, a reception circuit unit 330, a transmission circuit unit 340, and a base band unit 350. The communication apparatus 300 is constituted as a wireless communication apparatus, e.g., a cell phone, which employs a time-division communication system and can perform transmission and reception in multiple frequency bands.

The transmission/reception selector switch 320 serves, in a communicating mode of the communication apparatus 300, to selectively change over at a high speed a state where the antenna 310 is connected to the reception circuit unit 330 and a state where the antenna 310 is connected to the transmission circuit unit 340. The switching speed is, e.g., 0.1 to 10 μsec. The time-division communication system can be realized with such high-speed changing-over. The transmission/reception selector switch 320 is constituted by the above-described switching device X7, which is the SPDT switch (having one input and two outputs). For example, the signal line 73 in the switching device X7, illustrated in FIG. 49, is electrically connected to the antenna 310, the signal line 74A is electrically connected to the reception circuit unit 330, and the signal line 74B is electrically connected to the transmission circuit unit 340.

The reception circuit unit 330 has a circuit configuration for processing (such as amplifying, frequency-converting, and demodulating) a signal of a predetermined frequency, which is taken from the antenna 310. The reception circuit unit 330 includes, as part thereof, a plurality of band pass filters (BPFs) 331, a plurality of band selector switches 332 and 333, and a wide-band low noise amplifier (LNA) 334, and it is connected to the base band unit 350. The plurality of band pass filters 331 are each constituted so as to allow passage of a signal in a predetermined frequency band. The frequency bands allowing the signal passage differ among the plurality of band pass filters 331. The plurality of band pass filters 331 serve to select one desired frequency band in the system. The band selector switches 332 are disposed on respective input terminal sides of the band pass filters 331 (i.e., on the side closer to the antenna 310). The band selector switches 333 are disposed on respective output terminal sides of the band pass filters 331 (i.e., on the side closer to the wide-band low noise amplifier 334). When a set of band selector switches 332 and 333 with one predetermined band pass filter 331 interposed between them are both turned to a closed state, that one band pass filter 331 is selected in the reception circuit unit 330. Those band selector switches 332 and 333 are each constituted by any one of the above-described switching devices X1 to X6 and X8. The wide-band low noise amplifier 334 amplifies the intensity of a signal having passed through the one band pass filter 331.

The transmission circuit unit 340 has a circuit configuration for generating a signal to be transmitted from the antenna 310. The transmission circuit unit 340 includes, as part thereof, an oscillation circuit (not shown), a plurality of power amplifiers 341, a plurality of band pass filters (BPFs) 342, and a plurality of band selector switches 343, and it is connected to the base band unit 350. Each power amplifier 341 serves to amplify the transmitted signal to a required level of output. Each band pass filter 342 serves to select the desired frequency band in the system. The band selector switches 343 are disposed on respective output terminal sides of the power amplifiers 341 (i.e., on the side closer to the antenna 310) and serve to selectively change over the communication apparatus 300 to be adapted for the desired frequency band in the system. When one predetermined band selector switch 343 is turned to a closed state, one predetermined set of power amplifier 341 and band pass filter 342 is selected in the transmission circuit unit 340. Those band selector switches 343 are each constituted by any one of the above-described switching devices X1 to X6 and X8.

By including the above-described antenna 310, transmission/reception selector switch 320, reception circuit unit 330, and transmission circuit unit 340, the communication apparatus 300 is able to operate as a multiband communication apparatus adaptable for a communication system that utilizes a plurality of different frequency bands in the time-division communication system.

Further, while modification(s) and component(s) are described herein with relation to one another, no limitation is intended thereby. All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention.

The embodiments can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on computer-readable media comprising computer-readable recording media. The program/software implementing the embodiments may also be transmitted over transmission communication media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW. An example of communication media includes a carrier-wave signal.

Further, according to an aspect of the embodiments, any combinations of the described features, functions and/or operations can be provided.

Although the embodiments of the present inventions have been described in detail, it should be understood that the various changes, substitutions, and alterations could be made hereto without departing from the spirit and scope of the invention, the scope of which is defined in the claims and their equivalents.

What is claimed is:

1. A switching device, comprising:

a stationary portion;

a movable portion having a movable land portion, a first beam portion, and a second beam portion, the first and second beam portions coupling the movable land portion and the stationary portion with each other;

a first signal line disposed to extend over the movable land portion, the first beam portion, and the stationary portion, and having a movable contact portion on the movable land portion;

a second signal line having a stationary contact portion positioned to face the movable contact portion and fixed to the stationary portion;

a first driving line disposed to extend over the movable land portion, the second beam portion, and the stationary portion, and having a movable driving electrode portion on the movable land portion; and a second driving line having a stationary driving electrode portion positioned to face the movable driving electrode portion and fixed to the stationary portion.

2. The switching device according to claim 1, wherein the movable portion is supported towards the stationary portion in a cantilevered structure.

3. The switching device according to claim 1, wherein the movable portion is supported towards the stationary portion in a both-end supported structure.

4. The switching device according to claim 1, wherein the movable portion has a third beam portion coupling the movable land portion and the stationary portion with each other, and wherein the switching device includes:

a third driving line disposed to extend over the movable land portion, the third beam portion, and the stationary portion, and having an additional movable driving electrode portion that is spaced from the movable driving electrode portion on the movable land portion; and a fourth driving line having an additional stationary driving electrode portion positioned to face the additional movable driving electrode portion and fixed to the stationary portion, the movable contact portion of the first signal line being positioned between the movable driving electrode portion and the additional movable driving electrode portion in a direction in which the movable driving electrode portion and the additional movable driving electrode portion are spaced from each other.

5. The switching device according to claim 4, wherein the first beam portion, the second beam portion, and the third beam portion are extended in parallel and provided between the movable land portion and the stationary portion, and the first beam portion is positioned between the second beam portion and the third beam portion.

6. The switching device according to claim 4, wherein the second beam portion and the third beam portion are extended in parallel between the movable land portion and the stationary portion, and the first beam portion couples the movable land portion and the stationary portion with each other on a side opposite to the second beam portion and the third beam portion.

7. The switching device according to claim 1, wherein the first signal line has an additional movable contact portion on the movable land portion, wherein the switching device includes:

a third signal line having an additional stationary contact portion positioned to face the additional movable contact portion and fixed to the stationary portion;

a third driving line disposed to extend over the movable land portion, the second beam portion, and the stationary portion, and having an additional movable driving electrode portion that is spaced from the movable driving electrode portion on the movable land portion; and a fourth driving line having an additional stationary driving electrode portion positioned to face the additional movable driving electrode portion and fixed to the stationary portion, wherein the additional movable contact portion is spaced from the movable contact portion in a direction in which the movable driving electrode portion and the additional movable driving electrode portion are spaced from each other, the movable land portion is positioned between the first beam portion and the second beam portion, the first and second beam portions defining an axis for swing motion of the movable land portion, and the axis extends between the movable driving electrode portion and the additional movable driving electrode portion and between the movable contact portion and the additional movable contact portion as viewed in the direction in which the movable driving electrode portion and the additional movable driving electrode portion are spaced from each other.

8. The switching device according to claim 1, comprising:

a first ground line extending along at least the first signal line and the second signal line, and a second ground line extending along at least the first signal line and the second signal line on a side opposite to the first ground line.

9. The switching device according to claim 1, wherein the first driving line has, in part thereof on the movable portion, a pattern shape that is congruent to a pattern shape of the first signal line on the movable portion.

10. The switching device according to claim 1, comprising:

a stopper portion positioned to face the movable land portion on a side where the movable contact portion is disposed.

11. The switching device according to claim 1, wherein the first signal line has a thicker portion on the first beam portion.

12. The switching device according to claim 1, wherein the first driving line has a thicker portion on the second beam portion.

13. A method for the manufacture of a switching device, comprising:

forming a movable portion having a movable land portion, a first beam portion, and a second beam portion, the first and second beam portions coupling the movable land portion with a stationary portion with each other;

depositing a first signal line to extend over the movable land portion, the first beam portion, and the stationary portion, and having a movable contact portion on the movable land portion;

depositing a second signal line having a stationary contact portion positioned to face the movable contact portion and fixed to the stationary portion;

depositing a first driving line to extend over the movable land portion, the second beam portion, and the stationary portion, and having a movable driving electrode portion on the movable land portion; and positioning a second driving line having a stationary driving electrode portion to face the movable driving electrode portion and fixed to the stationary portion.

14. A switching device, comprising:

a stationary portion;

a movable portion having a movable land portion, a first beam portion, and a second beam portion, the first and second beam portions coupling the movable land portion and the stationary portion with each other;

a first signal line disposed to extend over the first beam portion and the stationary portion, and having a movable contact portion on the first beam portion;

a second signal line having a stationary contact portion positioned to face the movable contact portion and fixed to the stationary portion;

a first driving line disposed to extend over the movable land portion, the second beam portion, and the stationary portion, and having a movable driving electrode portion on the movable land portion; and a second driving line having a stationary driving electrode portion positioned to face the movable driving electrode portion and fixed to the stationary portion.

* * * * *